US006746224B2

(12) United States Patent
Itoh et al.

(10) Patent No.: US 6,746,224 B2
(45) Date of Patent: Jun. 8, 2004

(54) SCROLL COMPRESSOR

(75) Inventors: Takahide Itoh, Kasugai (JP); Makoto Takeuchi, Nagoya (JP); Hiroshi Yamazaki, Nagoya (JP); Yasuharu Maruiwa, Kuwana (JP); Yukio Nagato, Suzuka (JP); Chikako Sasakawa, Tokai (JP); Susumu Matsuda, Suzuka (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 104 days.

(21) Appl. No.: 10/049,911

(22) PCT Filed: Jun. 22, 2001

(86) PCT No.: PCT/JP01/05353

§ 371 (c)(1),
(2), (4) Date: Feb. 20, 2002

(87) PCT Pub. No.: WO01/98662

PCT Pub. Date: Dec. 27, 2001

(65) Prior Publication Data

US 2002/0114720 A1 Aug. 22, 2002

(30) Foreign Application Priority Data

| | | |
|---|---|---|
| Jun. 22, 2000 | (JP) | 2000-188199 |
| Jun. 23, 2000 | (JP) | 2000-190068 |
| Jun. 23, 2000 | (JP) | 2000-190069 |
| Jun. 23, 2000 | (JP) | 2000-190070 |
| Aug. 28, 2000 | (JP) | 2000-258072 |
| Aug. 28, 2000 | (JP) | 2000-258073 |

(51) Int. Cl.[7] ..... F03C 2/00
(52) U.S. Cl. ..... 418/55.2; 418/55.5; 418/57
(58) Field of Search ..... 418/55.2, 55.5, 418/57

(56) References Cited

U.S. PATENT DOCUMENTS 5,496,161 A * 3/1996 Machida et al. ..... 418/55.2

FOREIGN PATENT DOCUMENTS

| | | |
|---|---|---|
| EP | 0846862 A1 | 6/1998 |
| JP | 58-30494 | 2/1983 |
| JP | 60-017956 | 5/1985 |
| JP | 63-80088 | 11/1988 |

(List continued on next page.)

OTHER PUBLICATIONS

U.S. patent application Ser. No. 10/049,911, filed Feb. 20, 2002, Itoh et al.

(List continued on next page.)

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

In a scroll compressor furnished with a fixed scroll and an orbiting scroll, and provided with steps on end plates of the fixed scroll and the orbiting scroll, formed such that the height thereof is high at a central side and low at an outer peripheral end side in a spiral direction of the walls, and with upper rims of the walls formed in a stepped shape corresponding to the steps, gaps are respectively provided between the end plates and upper rims of the walls, and a height of the gaps at room temperature is formed higher than a height under operating conditions. Moreover, the steps are provided at positions which exceeds a pitch angle of π (rad) along the spiral direction from the outer peripheral end. Furthermore, a concavity is formed in the end plate of the fixed scroll, and a discharge valve is provided in the concavity. Moreover, a plate which is freely movable in an orbit axis direction of the orbiting scroll is arranged, and a pressing device which presses the plate is provided. In addition, a shape of connecting wall faces which connect adjacent parts on one side face of the end plates, is determined by an envelope drawn by an orbit locus of a connecting rim which connects adjacent parts of the upper rims. Furthermore, there is provided a communication passage which communicates between two compression chambers which are developed by contact of the connecting rim and the connecting wall face.

3 Claims, 36 Drawing Sheets

FOREIGN PATENT DOCUMENTS

| | | | | | |
|---|---|---|---|---|---|
| JP | 4-311693 | | | 11/1992 | |
| JP | 05071477 | A | * | 3/1993 | ..... F04C/18/02 |
| JP | 06010857 | A | * | 1/1994 | ..... F04C/18/02 |
| JP | 08028461 | A | * | 1/1996 | ..... F04C/18/02 |
| JP | 9-317667 | | | 12/1997 | |

OTHER PUBLICATIONS

U.S. patent application Ser. No. 10/158,058, filed May 31, 2002, pending.

U.S. patent application Ser. No. 10/414,015, filed Apr. 16, 2003, Takeuchi et al.

U.S. patent application Ser. No. 09/985,493, filed Nov. 5, 2001, pending.

U.S. patent application Ser. No. 10/040,630, filed Jan. 9, 2002, pending.

U.S. patent application Ser. No. 10/040,622, filed Jan. 9, 2002, pending.

U.S. patent application Ser. No. 10/049,903, filed Feb. 20, 2002, pending.

* cited by examiner

PROCESS A
PROCESS B

Ca
Cb

Ca
Cb

Ca
Cb

Ca
Cb

Cbo
Cao

Cbo
Cao

Cbo
Cao

SCROLL COMPRESSOR

TECHNICAL FIELD

The present invention relates to a scroll compressor furnished in an air conditioner, a refrigerator, or the like.

BACKGROUND ART

A scroll compressor is one where a fixed scroll and an orbiting scroll are arranged as a pair of spiral walls assembled together, and the orbiting scroll is orbitally rotated with respect to the fixed scroll in order to gradually reduce the volume of a compression chamber formed between the walls and thereby compress the fluid inside the compression chamber.

The compression ratio in the design of the scroll compressor is a ratio of the maximum capacity of the compression chamber (the capacity at a point in time where the wall pairs are combined to form the compression chamber) to the minimum capacity of the compression chamber (the capacity immediately before the wall pairs become disengaged and the compression chamber disappears), and is expressed by the following equation (I):

$$Vi=\{A\ (\theta suc)\cdot L\}/\{A\ (\theta \mathrm{top})\cdot L\}=A\ (\theta suc)/A\ (\theta \mathrm{top}) \qquad (I)$$

In equation (I), A(θ) is a function representing the cross-sectional area parallel to the orbit plane of the compression chamber for which the volume is changed corresponding to the orbiting angle θ of the orbiting scroll, θsuc is the orbit angle of the orbiting scroll for when the compression chamber becomes a maximum volume, θtop is the orbit angle of the orbiting scroll for when the compression chamber becomes a minimum volume, and L is the length of the lap (overlap) of the wall pairs.

Conventionally, in order to improve the compression ratio Vi of a scroll compressor, a method was adopted of increasing the winding number for the walls of the two scrolls so that the cross-section area A(θ) of the compression chamber at the time of maximum volume was increased. However, with this conventional method of increasing the winding number of the walls, the external shape of the scroll is increased so that the compressor itself is increased in size. Hence there is a problem in that it is difficult to employ this in an air conditioner such as for an automobile where restrictions on size are severe.

In order to solve the above problems, in Japanese Examined Patent Application, Second Publication, No. 60-17956, there is proposed a scroll compressor where spiral shape upper rims of the walls of both the fixed scroll and the orbiting scroll are made of a stepped shape with the central side low and the outer peripheral end side high, and corresponding to the stepped shape of these upper rims, the side faces of end plates of the two scrolls are both are formed stepped with the central side high and the outer peripheral end side low.

The device shown in FIG. 41A is a fixed scroll 150, and comprises an end plate 150*a* and a wall 150*b* of a spiral shape upstanding on one side face of the end plate 150*a*. Furthermore, the device shown in FIG. 41B is an orbiting scroll 151. The orbiting scroll 151 also comprises an end plate 151*a* and a spiral wall 151*b* upstanding on one side face of the end plate 151*a,* similar to that of the fixed scroll 150.

On the side faces of the end plates 150*a* and 151*a* of the fixed scroll 150 and the orbiting scroll 151, there is formed steps 152 at a position π radians (rad) from the outer peripheral end of the spirals of the walls 150*b* and 151*b,* and these steps have their central sides high and their outer peripheral end sides low. Furthermore, corresponding to the steps 152 of the end plates 150*a* and 151*a,* there are formed steps 153 on the spiral shape upper rims of the walls 150*b* and 151*b* furnished on the two scrolls 150 and 151, with their central sides low and the outer peripheral end sides high.

In the scroll compressor as described above, the condition where the respective walls 150*b* and 151*b* of the fixed scroll 150 and the orbiting scroll 151 are engaged, and a compression chamber P of maximum capacity is formed, is shown in FIG. 42A, and a cross-section along the spiral direction of the compression chamber P, is shown in FIG. 42B. The leftward direction of FIG. 42B is the spiral central side.

As will be understood from FIG. 42B, a lap length L1 on the outer peripheral end side from the step 152 is formed longer than a lap length Ls for the inside. Therefore, compared to the case where the lap lengths are the same, it can be seen that the maximum volume of the compression chamber P becomes larger by the amount that the lap length outside from the step 52 is longer. Consequently, it is possible to improve the design compression ratio even if the winding number of the walls is not increased.

As described above, since the lap length of the compression chamber at the time of maximum capacity is L1 and the lap length of the compression chamber at the time of minimum capacity is Ls, then a design compression ratio Vi' can be expressed by the following equation (II).

$$Vi'=\{A\ (\theta suc)\cdot L1\}/\{A\ (\theta \mathrm{top})\cdot Ls\} \qquad (II)$$

In equation (II), the lap length L1 of the compression chamber at the time of maximum capacity is larger than the lap length of the compression chamber at the time of minimum capacity so that L1/Ls>1 results. Therefore, it is possible to increase the design compression ratio even if the winding number for the walls is not increased.

Furthermore, Japanese Unexamined Patent Application, First Publication, No. 4-311693 discloses a structure which adopts a stepped shape for the scroll, and there is provided a tip seal on an outer peripheral lap tip, with the, purpose of reducing leakage at the outer peripheral side.

Incidentally, in general in a scroll compressor, since the compression chamber P becomes a higher pressure at the central portion of the scroll, the temperature is higher compared to at the outer peripheral portion. Therefore, the thermal expansion amount for the wall becomes larger at the central portion, so that geometric distortion occurs in the engagement between the fixed scroll 150 and the orbiting scroll 151, with the problem of likelihood in an increase in leakage and a reduction in reliability.

Furthermore, in the conventional scroll compressor, the steps 152 formed on the side faces of the end plates 150*a* and 151*a* of the scrolls 150 and 151 are positioned at π (rad) from the outer peripheral end of the spiral. Therefore, as will be understood from FIG. 42B, the lap length Ls from the step 152 towards the central portion is shorter than the lap length L1 for the outer peripheral end side, so that even at the time of maximum volume, a sufficiently large volume cannot be obtained.

Moreover, as shown in the cross-sectional view of FIG. 43, the construction is such that a discharge port 154 passing through the end plate 150*a* is formed in the central portion of the fixed scroll 150 for discharging high pressure fluid inside the compression chamber P. However, since the volume inside this discharge port 154 is comparatively large, there is a problem in that the fluid cannot be discharged smoothly, making it difficult to improve the operating efficiency.

As described above, in relation to where the step 152 is formed on the side face of the end plate 150*a* of the fixed scroll 150, then for the central portion of the end plate 150*a*, the thickness becomes comparatively thicker than for the outer peripheral portion bounded by the step 152. Therefore, the length of the discharge port 154 becomes longer, and consequently the volume inside the discharge port 154 becomes comparatively large.

The fluid flowing from the compression chamber P to inside the discharge port 154 causes elastic deformation at a rectangular flat plate discharge valve 155, so that the discharge port 154 is opened, and due to the opening, the fluid flows out towards a discharge cavity (not shown in the figure). However, since the volume of the discharge cavity is large, up until the discharge valve 155 is again closed due to the pressure rise inside the discharge cavity, the fluid has not been sufficiently introduced and thus remains.

Then, the remaining fluid flows in reverse, returning to inside the compression chamber P, and thus raising the pressure of the fluid which is to be compressed next. Obviously, in compressing high pressure fluid extra power must be added compared to when compressing low pressure fluid, that is, the power for rotating the orbiting scroll 151 with respect to the fixed scroll 150 must be increased. Consequently, the motor, being the rotational drive source for the orbiting scroll 151, is subjected to an extra load due to the fluid which flows in reverse from the discharge port 154. Therefore, more electric power is consumed, making it difficult to improve the operating efficiency.

Furthermore, this is not only limited to the device where the step shape is adopted for the scroll as described above, but also in the conventional general scroll compressor, a technique for variably controlling the discharge volume is occasionally adopted. This is because for example in an air-conditioning plant, while performing steady operation, the conveyance of a large amount of refrigerant is not required compared to for example at the time of starting.

In volume control, it is common to adopt a technique for flowing a part of the suction fluid from the high pressure side to the low pressure side, to thereby reduce the discharge volume. However, if a part of the fluid which has been once compressed to a high pressure is reflowed from the high pressure side to the low pressure side, this causes drive source power loss, and is inefficient.

Furthermore, in the scroll compressor which adopts the stepped shape as mentioned above for the scroll, there is a problem in how to maintain the gas tightness when a connecting rim which connects the upper rim of the low position and the upper rim of the high position of the wall bodies against the connecting wall face which connects the deep lower face of the bottom and the shallow lower face of the bottom of the end plate.

For example, in Japanese Examined Patent Application, Second Publication, No. 60-17956, it is disclosed that the shape of a portion being the connecting rim, is formed in a semicircular shape of a radius $\pi/2$, which is smoothly continuous with the two side faces of the spiral shape walls, and the shape of a portion being the connecting wall face, is formed so as to be a semicircle of a radius $r_o+(\pi/2)$ ($r_o$; orbit radius of the orbiting scroll) with the central point of the adjacent wall as the center.

However, it is known that in order to form such a connecting rim as a semicircular shape which is smoothly continuous with the two side faces of the wall, an extremely high processing technique is required. Therefore processing cost is considerably increased, which becomes an inhibiting factor for mass production.

Furthermore, there is a problem in that it takes time to machine the scroll, and cost is high. Therefore, a scroll compressor is proposed where a step is provided in the scroll wall of either one of the fixed scroll and the orbiting scroll, and a step is provided in the end plate of the other scroll which is to correspond to this (refer to FIG. 8 of Japanese Examined Patent Application, Second Publication, No. 60-17956). In this compressor, the step machining for the wall and the step machining for the end plate are completed at one location for each of the two scrolls, thus realizing high processability.

However, the condition exists where the volume of the two facing compression chambers on either side of the center of the scroll compressor are not equal during the compression process. Therefore, at the time of actual driving, the pressure balance between the two compression chambers is lost, and in the worst case, this can contribute to damage of the internal structure of the compressor.

The present invention takes into consideration the above situation with the object of providing a scroll compressor as hereunder.

(1) A scroll compressor for which the scrolls can be reliably engaged even at the time of thermal expansion, and the compression efficiency can be improved and a high reliability maintained.

(2) A scroll compressor for which a maximum volume for the compression chamber can be sufficiently obtained to enable improvement in the compression ratio.

(3) A scroll compressor in which improvement of the operating efficiency is not prevented by fluid remaining inside the discharge port, thus enabling operating efficiency to be improved.

(4) A scroll compressor where volume control is possible and performance is improved, without producing drive source power loss.

(5) A scroll compressor for which processability of the connecting edge can be increased and a reduction in cost realized, while also maintaining gas tightness between the fixed scroll and the orbiting scroll.

(6) A scroll compressor for which time and cost necessary in machining of the scrolls can be reduced, and which can be safely driven.

DISCLOSURE OF INVENTION

The first object of the present invention is to provide a scroll compressor which is furnished with a fixed scroll having a spiral wall upstanding on one side face of an end plate, and secured in place, and an orbiting scroll having a spiral wall upstanding on one side face of an end plate, and supported so as to be orbitally movable while being prevented from rotation, with pairs of the walls engaged with each other, and provided with a stepped shape on one side face of at least one of the end plates of the fixed scroll and the orbiting scroll, having a high part with a height thereof which is high at a central side in a spiral direction, a low part with a height thereof which is low at an outer peripheral end side, and a step which constitutes a border of these high and low parts, and an upper rim of the wall of at least one of the fixed scroll and the orbiting scroll is divided into a plurality of parts, to give a stepped shape having, corresponding to the parts, a low upper rim where the height of the part is low at a central side in the spiral direction, and a high upper rim where the height of the part is high at an outer peripheral end side, wherein a gap is provided between the end plate and a corresponding upper rim of the wall, and a height of the gap in a height direction of the wall at room temperature is formed higher than a height for a case where the wall is thermally expanded in a height direction of the wall at a time of scroll compressor operation.

When the compressor is driven, the central portion of the scroll becomes a higher temperature, and the amount of thermal expansion of the wall becomes large. In this scroll compressor, since a gap having a height higher than the amount of thermal expansion of the wall is formed, then even if the wall expands, the wall upper rim does not interfere with the facing end plate. Furthermore, it is preferable for the gap to be sufficiently small to the extent that the wall and the end plate do not come into contact (for example, 10 $\mu$m to 50 $\mu$m).

Furthermore, for the outer peripheral end side along the spiral from the step, the height of the wall is formed high. If the wall is high, the displacement in the height direction due to thermal expansion is large. Furthermore, at the spiral central portion since as mentioned above the high temperature is high, then the thermal expansion amount is large. Consequently, the height of the gap for the central portion side and the outer peripheral end side of the step is determined taking into consideration the temperature and the height condition of the wall.

Moreover, in the scroll compressor, the height of the gap formed on the central side in the spiral direction from the step may be formed higher than the height of the gap formed on the outer peripheral end side from the step.

At the central portion of the scroll, due to the high temperature the amount of thermal expansion of the wall becomes large. Therefore, by making the gap for the central portion side from the step high, interference of the wall and the end plate at the central portion side is prevented. Furthermore, the gap height after thermal expansion can be appropriately formed for either of the central portion side and the outer peripheral end side from the step.

The second object of the present invention is to provide a scroll compressor which is furnished with at fixed scroll having a spiral wall upstanding on one side face of an end plate, and secured in place, and an orbiting scroll having a spiral wall upstanding on one side face of an end plate, and supported so as to be orbitally movable while being prevented from rotation, with pairs of the walls engaged with each other, and provided with a stepped shape on one side face of at least one of the end plates of the fixed scroll and the orbiting scroll, having a high part with a height thereof which is high at a central side in a spiral direction, a low part with a height thereof which is low at an outer peripheral end side, and a step which constitutes a border of these high and low parts, and an upper rim of the wall of at least one of the fixed scroll and the orbiting scroll is divided into a plurality of parts, to give a stepped shape having, corresponding to the parts, a low upper rim where the height of the part is low at a central side in the spiral direction, and a high upper rim where the height of the part is high at an outer peripheral end side, wherein the step is provided at a position which exceeds a pitch angle of $\pi$ (rad) along the spiral of the wall from the outer peripheral end of the wall towards the central portion.

In this scroll compressor, the step provided on the end plate is provided at a position which exceeds a pitch angle of $\pi$ (rad) from the outer peripheral end of the spiral towards the central portion, with the spiral center as a reference. That is, for example, a step 52 shown in FIG. 11 (*b*) becomes positioned to the left in the figure, and hence the position where the lap length of the compression chamber is L1 at the time of maximum volume becomes larger, so that the maximum volume of the compression chamber can be made even greater.

Furthermore, in the abovementioned scroll compressor, the step may be provided at a position which does not exceed a pitch angle of $2\pi+\pi/4$ (rad) along the spiral of the wall from the outer peripheral end of the wall towards the central portion.

Since the differential pressure of the compression chambers partitioned on the inside and outside by the spiral of the wall becomes larger the closer to the center of the spiral, then in the case where the step is provided close to the center, the fluid inside the compression chamber on the inside from the step is likely to pass through the step and leak to the compression chamber on the outside. Therefore, the step is preferably not provided too close to the center, and is preferably provided at a position which does not exceed the pitch angle of $2\pi+\pi/4$ (rad).

Furthermore, in the abovementioned scroll compressor, the step may be provided within range of a pitch angle of $2\pi\pm\pi/4$ (rad) along the spiral of the wall from the outer peripheral end of the wall towards the central portion.

By providing the step in the vicinity of $2\pi$ (rad) as in this scroll compressor, the maximum volume of the compression chamber can be made sufficiently large, and leakage of the fluid inside the compression chamber caused by the differential pressure can also be prevented.

Furthermore, in the scroll compressor, in the fixed scroll, a discharge port may be formed in a central portion of the end plate, and the step may be provided at a position which exceeds a pitch angle of $2\pi$ (rad) along the spiral of the wall from the discharge port towards the outer peripheral end side.

In this scroll compressor, in the case where the number of turns of the scroll is sufficient, then by providing the step at a position on the outer peripheral end at least $2\pi$ (rad) from the position forming the discharge port, that is at a position where the compression chamber including the step does not face the discharge port, the compression chamber including the step does not attain discharge pressure. Consequently, the seal differential pressure between the spiral central portion side and the outer peripheral end side on either side of the step can be kept small.

The third object of the present invention is to provide a scroll compressor which is furnished with a fixed scroll having a spiral wall upstanding on one side face of an end plate, and secured in place, and an orbiting scroll having a spiral wall upstanding on one side face of an end plate, and supported so as to be orbitally movable while being prevented from rotation, with pairs of the walls engaged with each other, and provided with a stepped shape on one side face of at least one of the end plates of the fixed scroll and the orbiting scroll, having a high part with a height thereof which is high at a central side in a spiral direction, a low part with a height thereof which is low at an outer peripheral end side, and a step which constitutes a border of these high and low parts, and an upper rim of the wall of at least one of the fixed scroll and the orbiting scroll is divided into a plurality of parts, to give a stepped shape having, corresponding to the parts, a low upper rim where the height of the part is low at a central side in the spiral direction, and a high upper rim where the height of the part is high at an outer peripheral end side, wherein, on the end plate of the fixed scroll, when viewed facing from a rear face on an opposite side to the face on which the wall is formed, there is formed a concavity positioned further towards a central portion side in the spiral direction than the low part, and in the concavity there is provided a discharge valve for preventing reverse flow of fluid discharging from the front face to the rear face from the discharge port passing through the end plate.

By forming a concavity, the material thickness of the end plate of the fixed scroll at the part in which the discharge port is positioned can be made thin. Furthermore, the discharge port internal volume can be made small and hence fluid remaining here can be reduced.

Moreover, in the above scroll compressor, in the fixed scroll, the step may be provided within range of a pitch angle of $2\pi\pm\pi/4$ (rad) along the spiral of the wall from the outer peripheral end towards the central portion, and the concavity, when the end plate is viewed facing from the rear face may be surrounded by the low part from the outer peripheral end up until the step.

As mentioned above, by forming a concavity, the material thickness of the end plate of the fixed scroll at the part in which the discharge port is positioned can be made thin. Furthermore, the discharge port internal volume can be made small and hence fluid remaining here can be reduced.

Moreover, in the above scroll compressor, the discharge valve may be a spiral reed valve having a blocking portion which covers and closes the opening of the discharge port, a resilient portion formed in a spiral shape from the blocking portion, and a securing portion which secures the outer peripheral end of the resilient portion.

By adopting a spiral reed valve being a relatively small valve, the discharge valve can be installed without difficulty even in a narrow concavity.

Moreover, in the above scroll compressor, the discharge valve may be a free valve being a plate having a surface area greater than an opening area of the discharge port, and arranged inside the concavity.

By adopting a free valve, being a relatively small valve, this can be installed without difficulty even in a narrow concavity. For this free valve, it is more preferable to adopt a circular free valve of a disc shape.

Moreover, in the above scroll compressor, with the exception of a portion which covers the opening of the discharge port, a plurality of ventilation areas may be formed radially from the central portion.

Since the free valve has a central portion with a closing area sufficient to cover the opening of the discharge port, the opening is reliably closed when the discharge port is closed. Furthermore, when the fluid is discharged from the discharge port, this can pass through the free valve not only past the outer periphery of the free valve but also through the respective ventilation areas. Therefore, additional resistance on the fluid passing through the free valve can be reduced.

Moreover, in the above scroll compressor, the discharge valve may be a check valve furnished with a valve body which covers the discharge port, and an urging member which urges the valve towards the discharge port.

By adopting a check valve being a relatively small valve, this can be installed without difficulty even in a narrow concavity.

The fourth object of the present invention is to provide a scroll compressor which is furnished with a fixed scroll having a spiral wall upstanding on one side face of an end plate, and secured in place, and an orbiting scroll having a spiral wall upstanding on one side face of an end plate, and supported so as to be orbitally movable while being prevented from rotation, with pairs of the walls engaged with each other, and provided with a stepped shape on one side face of at least one of the end plates of the fixed scroll and the orbiting scroll, having a high part with-a height thereof which is high at a central side in a spiral direction, a low part with a height thereof which is low at an outer peripheral end side, and a step which constitutes a border of these high and low parts, and an upper rim of the wall of at least one of the fixed scroll and the orbiting scroll is divided into a plurality of parts, to give a stepped shape having, corresponding to the parts, a low upper rim where the height of the part is low at a central side in the spiral direction, and a high upper rim where the height of the part is high at an outer peripheral end side, wherein there is provided a plate arranged at the low part of one side face of one of the fixed scroll and the orbiting scroll, which is freely movable in an orbit axis direction of the orbiting scroll, and a pressing device which presses the plate to the upper rim of the other of the wall of either of the fixed scroll and the orbiting scroll.

In this scroll compressor, in the case of performing volume control, the plate is moved freely in the orbit axis direction without operating the pressing device. As a result, in the scroll compressor comprising the fixed scroll and the orbiting scroll, even though the compression chamber tends to develop between the two scroll walls at the part positioned on the outer peripheral end side where the walls are high, the plate is subjected to pressure and moves so that leakage of the fluid occurs, so that the compression chamber moves towards the central side without actually performing compression. Then, when the part positioned on the central side where the walls are low is reached, and the part where the walls are high is passed, a compression chamber with no leakage is finally developed, and compression results. As a result, the volume change of the compression chamber from when compression is started until discharge, is small, and hence the discharge volume is reduced. Moreover, since the compression chamber is not developed until the wall positioned on the central side reaches to the low portion, power for compressing the fluid is not required.

In the case where volume control is not performed, the pressing device is operated so that the plate is pressed to the other wall of either of the fixed scroll or the orbiting scroll. As a result, even if the wall positioned at the outer peripheral end side is a high portion, the plate forms a part of the compression chamber so that the gas tightness is maintained. Therefore, a compression chamber without leaks is developed from the outer peripheral end side up until the central side, to perform compression.

Moreover, in the above scroll compressor, the plate may be a shape which approximately coincides with the low portion when either one of the fixed scroll and the orbiting scroll, is viewed from the surface on which the wall of is formed.

In this scroll compressor, by forming the plate to approximately coincide with the part positioned on the outer peripheral end side, then in the case where volume control is not performed, the gas tightness of the compression chamber which is formed at the part positioned on the outer peripheral end side where the wall is high, is maintained. Furthermore, the plate can be pressed without providing another drive source.

Furthermore, in the abovementioned scroll compressor, the pressing device may be provided with an introduction path which introduces pressure inside a compression chamber with the high part of the scroll on which the plate is arranged formed as one wall, into a space between the low part and the plate.

In this scroll compressor, in the case where volume control is not performed, the pressure inside the compression chamber positioned on the central side in the spiral direction, which is a higher pressure, is introduced to between the plate and the part positioned on the outer peripheral end side, so that the plate is pressed against the pressure inside the compression chamber which is a lower pressure than for the central side, so that the gas tightness of the compression chamber is maintained.

Moreover, in the above scroll compressor, an urging device may be provided which urges the plate in a direction towards the low part.

In this scroll compressor, by providing an urging device, and pulling the plate to a part positioned on the outer peripheral end side, then in the case where the pressing force on the plate by the pressing device for performing volume control is released, a gap occurs between the plate and the opposite wall. As a result, a redundant pressure increase caused by the active fluid leakage at the outer peripheral end side is prevented.

Moreover, in the above scroll compressor, there may be provided a stopper which restricts a movement range of the plate.

In this scroll compressor, by providing a stopper to restrict the movement range of the plate, pressing of the plate too far to the facing wall is prevented. Therefore, deformation of the plate or the occurrence of heat due to excessive friction with the wall is minimized.

The fifth object of the present invention is to provide a scroll compressor which is furnished with a fixed scroll having a spiral wall upstanding on one side face of an end plate, and secured in place, and an orbiting scroll having a spiral wall upstanding on one side face of an end plate, and supported so as to be orbitally movable while being prevented from rotation, with pairs of the walls engaged with each other, and provided with a stepped shape on one side face of at least one of the end plates of the fixed scroll and the orbiting scroll, having a high part with a height thereof which is high at a central side in a spiral direction, a low part with a height thereof which is low at an outer peripheral end side, and a step which constitutes a border of these high and low parts, and an upper rim of the wall of at least one of the fixed scroll and the orbiting scroll is divided into a plurality of parts, to give a stepped shape having, corresponding to the parts, a low upper rim where the height of the part is low at a central side in the spiral direction, and a high upper rim where the height of the part is high at an outer peripheral end side, wherein, for the steps of the respective end plates, a shape of connecting wall faces which connect the high and low parts which are adjacent to each other, is determined by an envelope drawn by an orbit locus of a connecting rim of the upper rims which connects the upper rim of the low part and the upper rim of the high part which are adjacent to each other.

In this scroll compressor, the shape of the connecting wall face is determined by the envelope drawn by the orbit locus of the connecting rim at the time of orbital motion. That is to say, viewing the connecting rim in a plane parallel with the orbit plane, when the center of a circle with the orbit radius as the radius is moved along the connecting rim, the envelope drawn becomes a shape so as to be the outline of the locus of the moved circle on the orbit plane of the connecting wall face. As a result, the gas tightness of the connecting wall face can be maintained irrespective of the shape of the connecting rim. Therefore, if a relatively simple shape is adopted for the connecting rim, processability is improved.

Furthermore, in the abovementioned scroll compressor, the connecting rim may be formed by a plane perpendicular to the spiral direction of the wall.

In this scroll compressor, by forming the connecting rim by a plane which intersects the spiral direction of the wall, then for example in the case of machining the connecting rim, processability can be significantly improved.

Moreover, in the above scroll compressor, a border of the plane and the side face of the wall may be chamfered.

In this scroll compressor, by chamfering the border of the plane and the side face of the wall, the strength near the connecting rim of the wall is maintained, and improvement in machining accuracy achieved.

Furthermore, in the above scroll compressor, a small gap may be provided between the connecting rim on either-one of the fixed scroll and orbiting scroll, and the connecting wall face of the other.

When the scroll compressor is driven, there is a change in the contact pressure due to thermal expansion of the scroll itself. Therefore, in this scroll compressor, by providing a small gap beforehand between the connecting rim and the connecting wall face, then even if the two scrolls thermally expand, the contact pressure does not increase more than necessary, and stabilized drive is achieved.

The sixth object of the present invention is to provide a scroll compressor which is furnished with a fixed scroll having a spiral wall upstanding on one side face of an end plate, and secured in place, and an orbiting scroll having a spiral wall upstanding on one side face of an end plate, and supported so as to be orbitally movable while being prevented from rotation, with pairs of the walls engaged with each other, and an upper rim of the wall furnished on one of either of the fixed scroll and the orbiting scroll is divided into a plurality of parts to give a stepped shape having a low upper rim where the height thereof is low at a central side in the spiral direction, and a high upper rim where the height thereof is high at an outer peripheral end side, and one side face of the end plate furnished on the other of either of the fixed scroll and the orbiting scroll is of a stepped shape having, corresponding to the parts of the upper rims, a high part where the height of the end plate is high at a central side in the spiral direction, and a low part where the height thereof is low at an outer peripheral end side, wherein there is provided a communication passage which communicates between the two compression chambers which are developed by the contact of a connecting rim connecting the low upper rim and the high upper rim, and a connecting wall face connecting the high part and the low part.

Furthermore, in the above scroll compressor, a discharge port may be provided in either one of the fixed scroll and the orbiting scroll.

Moreover, in the abovementioned scroll compressor, opposite ends of the communicating path may be respectively opened at two places where the outside face and the inside face of the walls which develop the compression chamber simultaneously engage.

In the above scroll compressor, in some processes of compression in the two facing compression chambers, the volumes are different. However, in these compression process, the fluid flows through the communication path between the two compression chambers, and hence an imbalance in internal pressure is corrected. As a result, the compressor can be safely driven.

Furthermore, by providing a step only on the wall of the scroll of either one of the fixed scroll and the orbiting scroll, and providing a step only on the end plate of the other scroll which is to correspond to this, processing of the scrolls becomes simpler than heretofore. Hence processability can be improved and the cost required for processing can be reduced.

Moreover, by providing a discharge port in the scroll having no step, the discharge port volume is reduced, and power loss due to reverse flow of the fluid from the discharge port to the compression chamber is suppressed. Hence compression efficiency is improved.

In addition, the seventh object of the present invention is to provide the scroll compressor which is furnished with a fixed scroll having a spiral wall upstanding on one side face of an end plate, and secured in place, and an orbiting scroll having a spiral wall upstanding on one side face of an end plate, and supported so as to be orbitally movable while being prevented from rotation, with pairs of the walls engaged with each other, and upper rims of the respective walls are divided into a plurality of parts to give a stepped shape having a low upper rim where the height thereof is low at a central side in the spiral direction, and a high upper rim where the height thereof is high at an outer peripheral end side, and one side face of each of the end plates is of a stepped shape having, corresponding to the respective parts of the upper rims, a high part where the height of the end plate is high at a central side in the spiral direction, and a low part where the height thereof is low at an outer peripheral end side, wherein a step of the low upper rim and high upper rim of one of either of the fixed scroll and the orbiting scroll is set to be greater than a step of the low upper rim and high upper rim of the other scroll, and a step of the high part and low part of the other scroll is set to be less than a step of the high part and low part of the one scroll, and there is provided a communication passage which communicates between the two compression chambers which are made by the contact of a connecting rim connecting the low upper rim and the high upper rim, and a connecting wall face connecting the high part and the low part.

Furthermore, in the above scroll compressor, a discharge port may be provided in the other scroll for which the step of the low upper rim and high upper rim is set relatively small and the step of the high part and low part is set large.

Moreover, in the abovementioned scroll compressor, opposite ends of the communicating path may be respectively opened at two places where the outside face and the inside face of the walls which develop the compression chamber simultaneously engage.

In the above scroll compressor, in some processes of compression in the two facing compression chambers, the volumes are different. However, in this compression process the fluid flows through the communication path between the two compression chambers, and hence an imbalance in internal pressure is corrected. As a result, the compressor can be safely driven.

Moreover, by providing a discharge port in the scroll with the small step, the discharge port volume is reduced, and power loss due to reverse flow of the fluid from the discharge port to the compression chamber is suppressed. Hence compression efficiency is improved.

BEST MODE FOR CARRYING OUT THE INVENTION

Figure 1:
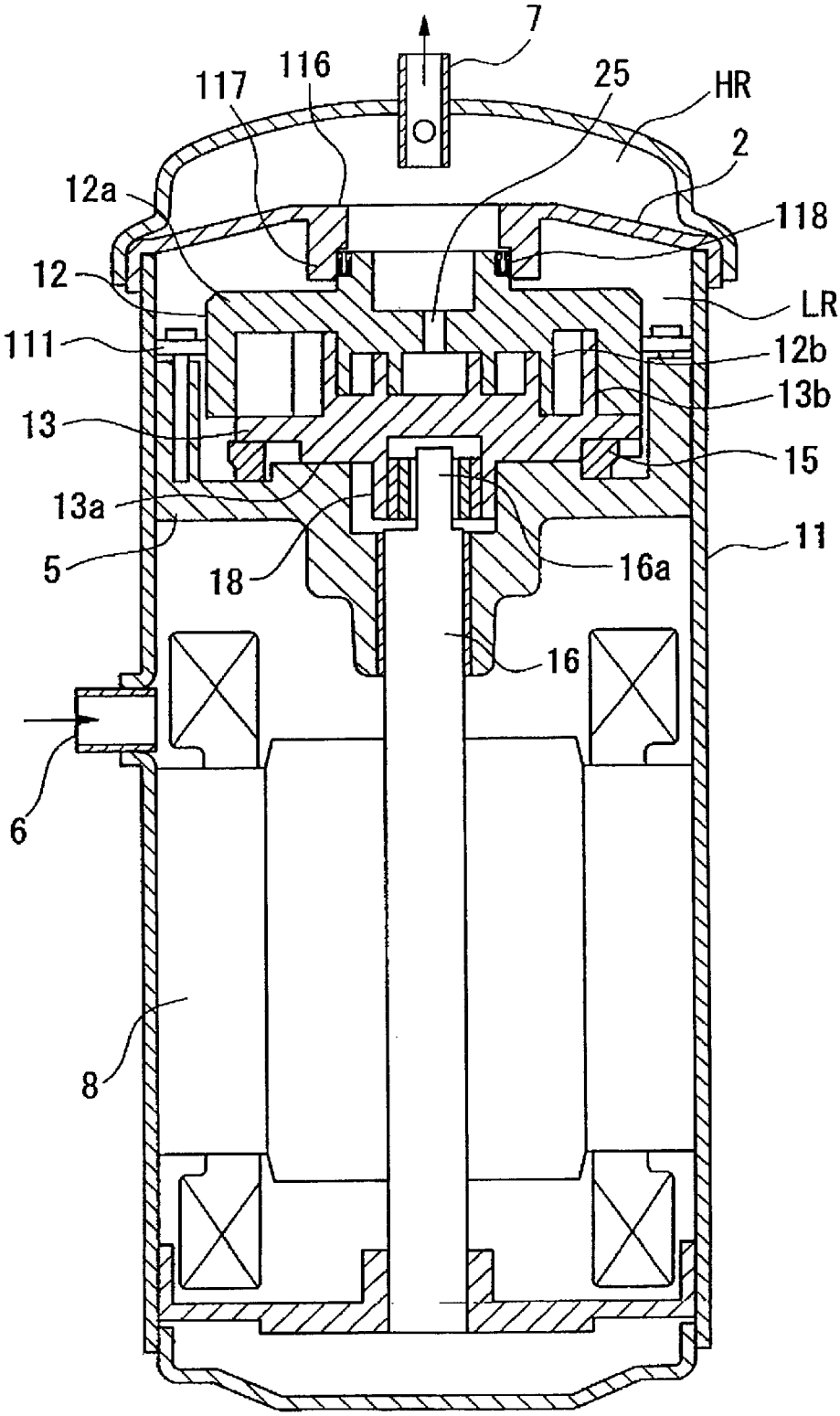
FIG. 1 is a cross-sectional view illustrating an overall construction of a scroll compressor shown as a first embodiment of the present invention.

FIG. 1 shows the construction of a back pressure type scroll compressor illustrating a first embodiment of the present invention.

The scroll compressor comprises; a sealed housing 11, a discharge cover 2 for separating the housing 11 interior into a high pressure chamber HR and a low pressure chamber LR, a frame 5, a suction pipe 6, a discharge pipe 7, a motor 8, a rotating shaft 16, a rotation prevention mechanism 15, a fixed scroll 12, and an orbiting scroll 13 engaged with the fixed scroll 12.

Figure 2:
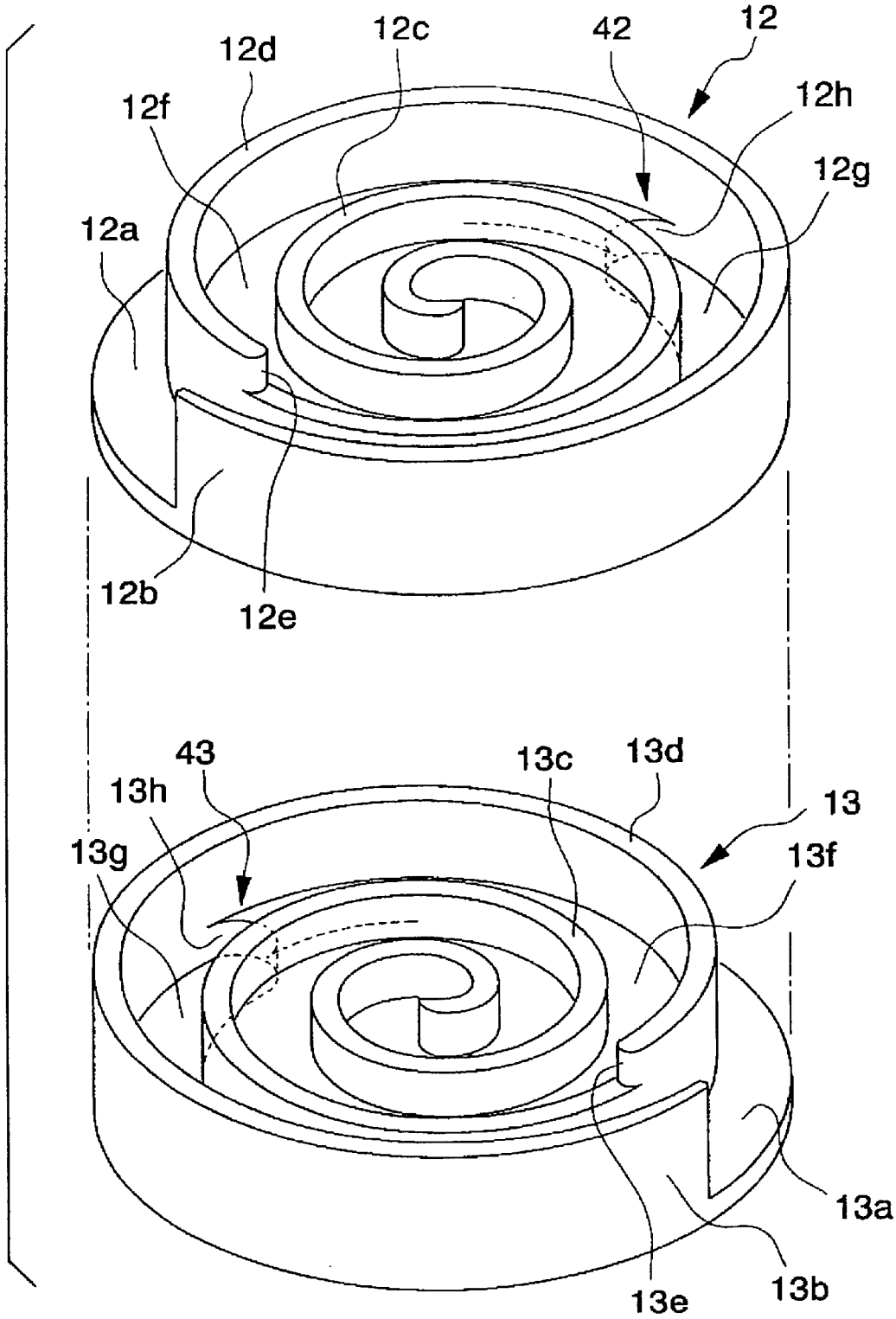
FIG. 2 is perspective views of a fixed scroll and an orbiting scroll used in the scroll compressor.

As shown in FIG. 2, the construction is such that for the fixed scroll 12, a spiral wall 12*b* is upstanding on one side face of an end plate 12*a*. For the orbiting scroll 13, the construction is such that a spiral wall 13*b* is upstanding on one side face of an end plate 13*a* as with the fixed scroll 12. In particular, the wall 13*b* is made substantially the same shape as the wall 12*b* for the fixed scroll 12 side. The orbiting scroll 13 is assembled to the fixed scroll 12, eccentric thereto by an orbit radius and out of phase by 180 degrees, with the walls 12*b* and 13*b* engaged with each other.

In this back pressure type scroll compressor, the fixed scroll 12 is not completely secured to the frame 5 with bolts or the like, and can move within a restricted range.

In this case, a cylindrical boss 18 is formed on the rear face side of the orbiting scroll 13, and an eccentric portion 16*a* provided on an upper end of the rotation shaft 16 which is driven by the motor 8 for orbital movement, is inserted into the boss 18. As a result, the orbiting scroll 13 performs orbital movement with respect to the fixed scroll 12, while rotation thereof is prevented by the action of the rotation prevention mechanism 15.

On the other hand, the fixed scroll 12 is supported so as to float freely with respect to the frame 5 secured to the housing 11 via a support spring 111, and a discharge port 25 for compressed fluid is provided in the center of the rear face of the end plate 13*a*. Furthermore, around the discharge port 25 there is provided a cylindrical flange 116 protruding from the rear face of the end plate 12*a* of the fixed scroll 12, and this cylindrical flange 116 is engaged with a cylindrical flange 117 on the discharge cover 2 side. At the portion where these cylindrical flanges 116 and 117 engage, the high pressure chamber HR and the low pressure chamber LR are separated, and since it is necessary to apply the high pressure (back pressure) to the rear face of the fixed scroll 12 to press this downwards, a seal structure using a seal member 118 is adopted. This seal member 118 has a U-shaped cross-section. The high pressure chamber HR in this case also functions as a back pressure chamber which applies the high pressure discharge pressure to the rear face of the fixed scroll 12.

On the end plate 12*a* of the fixed scroll 12, on the one side face on which the wall 12*b* is upstanding, there is provided a step 42 formed so that this is high on the central portion side along the spiral direction of the wall 12*b* and low on the outer peripheral end side.

For the end plate 13*a* for the orbiting scroll 13 side, as with the end plate 12*a*, on the one side face on which the wall 13*b* is upstanding there is provided a step 43 formed so as to be high on the central portion side along the spiral direction of the wall 13*b* and low on the outer peripheral end side.

The steps 42 and 43 are provided at positions advanced by π (rad) from the outer peripheral ends of the respective walls 12*b* and 13*b*, with the spiral center of the wall 12*b* and the wall 13*b* as a reference.

By forming the step 42, the bottom face of the end plate 12*a* is divided into two parts, namely a shallow bottom face 12*f* provided towards the central portion and a deep bottom face 12*g* provided towards the outer peripheral end. The step 42 is formed between the adjacent bottom faces 12*f* and 12*g*, so that a vertical sheer connecting wall face 12*h* exists connecting the bottom faces 12*f* and 12*g*. By forming the step 43 on the bottom face of the end plate 13*a* as with the end plate 12*a*, this is divided into two parts, namely a shallow bottom face 13*f* provided towards the central portion and a deep bottom face 13*g* provided towards the outer peripheral end. The step 43 is formed between the adjacent bottom faces 13*f* and 13*g*, so that a vertical sheer connecting wall face 13*h* exists connecting the bottom faces 13*f* and 13*g*.

Furthermore, for the wall 12*b* on the fixed scroll 12 side, corresponding to the step 43 of the orbiting scroll 13, the spiral shaped upper rim thereof is divided into two parts, resulting in a stepped shape which is low at the central portion side of the spiral and high at the outer peripheral end side. The wall 13*b* on the orbiting scroll 13 side also, as with the wall 12*b*, corresponding to the stepped portion 42 of the fixed scroll 12, the spiral shaped upper-rim is divided into two parts, resulting in a stepped shape which is low at the central portion side of the spiral and high at the outer peripheral end side.

More specifically, the upper rim of the wall 12*b* is divided into two parts, namely a low upper rim 12*c* provided towards the central portion and a high upper rim 12*d* provided towards the outer peripheral end, and between the adjacent upper rims 12*c* and 12*d*, there exists a connecting rim 12*e* perpendicular to the orbit plane, which connects the two. The wall 13*b* also as with the wall 12*b* is divided into two parts, namely a low upper rim 13*c* provided towards the central portion and a high upper rim 13*d* provided towards the outer peripheral end, and between the adjacent upper rims 13*c* and 13*d*, there exists a connecting rim 13*e* perpendicular to the orbit plane, which connects the two.

The connecting rim 12*e*, when the wall 12*b* is viewed in the direction from the orbiting scroll 13, is smoothly continuous with the inner and outer two side faces of the wall 12*b*, and forms a semicircle having a diameter equal to the thickness of the wall 12*b*. The connecting rim 13*e* also, as with the connecting rim 12*e*, is smoothly continuous with the inner and outer two side faces of the wall 13*b*, and forms a semicircle having a diameter equal to the thickness of the wall 13*b*.

Furthermore, the connecting wall face 12*h*, when the end plate 12*a* is viewed from the orbit axis direction, forms a circular arc coinciding with an envelope drawn by the connecting rim 13*e* along the orbit of the orbiting scroll, and the connecting wall face 13*h* also, as with the connecting wall face 12*h*, forms a circular arc coinciding with an envelope drawn by the connecting rim 12*e*.

Here a tip seal is not provided on the upper rim of the wall 12*b* of the fixed scroll 12 and the wall 13*b* of the orbiting scroll 13, and sealing of a later described compression chamber C is performed by pressing the edge face of the walls 12*b* and 13*b* against the end plates 12*a* and 13*a*.

Figure 3:
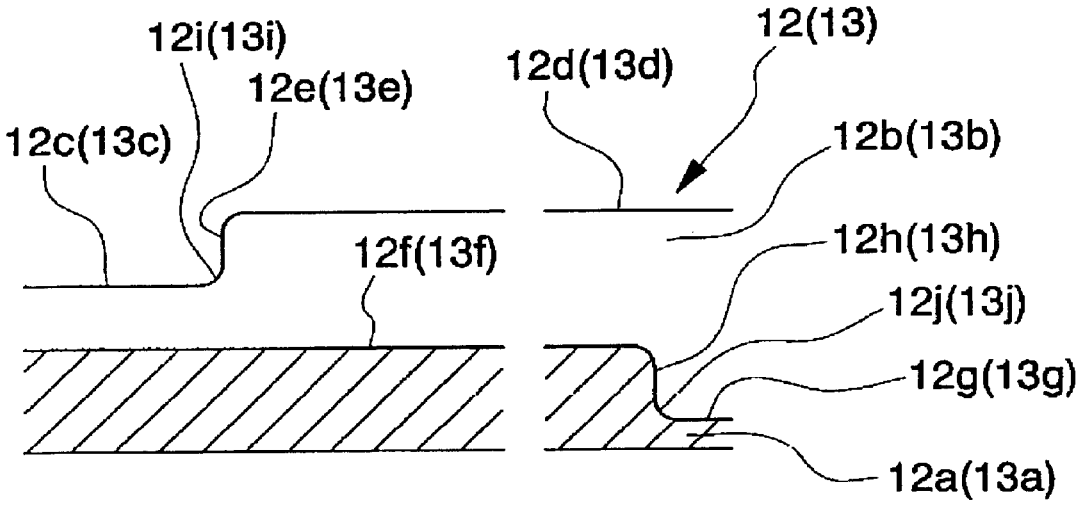
FIG. 3 is a cross-sectional view along a spiral direction of the fixed scroll and the orbiting scroll.

As shown in FIG. 3, on the wall 12*b*, at the portion where the upper rim 12*c* and the connecting rim 12*e* approach each other, a rib 12*i* is provided to give build up. The rib 12*i* is for avoiding stress concentration, and constitutes a concave surface formed integral with the wall 12*b* and smoothly continuous with the upper rim 12*c* and the connecting rim 12*e*. On the wall 13*b* also, at the portion where the upper rim 13*c* and the connecting rim 13*e* approach each other, a rib 13*i* is provided in the same shape for a similar reason.

On the end plate 12*a* also, at the portion where the bottom face 12*g* and the connecting wall face 12*h* approach each other, a rib 12*j* is provided to give build up. The rib 12*j* is for avoiding stress concentration, and constitutes a concave surface formed integral with the wall 12*b* and smoothly continuous with the bottom face 12*g* and the connecting wall face 12*h*. On the end plate 13*a* also, at the portion where the bottom face 13*g* and the connecting wall face 13*h* approach each other, a rib 13*j* is provided in the same shape for a similar reason.

On the wall 12*b*, the portion where the upper rim 12*d* and the connecting rim 12*e* approach each other, and on the wall 13*b*, the portion where the upper rim 13*d* and the connecting rim 13*e* approach each other, are respectively chamfered in order to avoid interference with the ribs 13*j* and 12*j* at the time of assembly.

When the orbiting scroll 13 is assembled to the fixed scroll 12, the low upper rim 13*c* abuts against the shallow bottom face 12*f*, and the high upper rim 13*d* abuts against the deep bottom face 12*g*. At the same time, the low upper rim 12*c* abuts against the shallow bottom face 13*f*, and the high upper rim 12*d* abuts against the deep bottom face 13*g*. As a result, between the two scrolls is compartmentalized by the facing end plates 12*a* and 13*a* and the walls 12*b* and 13*b* to form a compression chamber C.

Figure 4A:
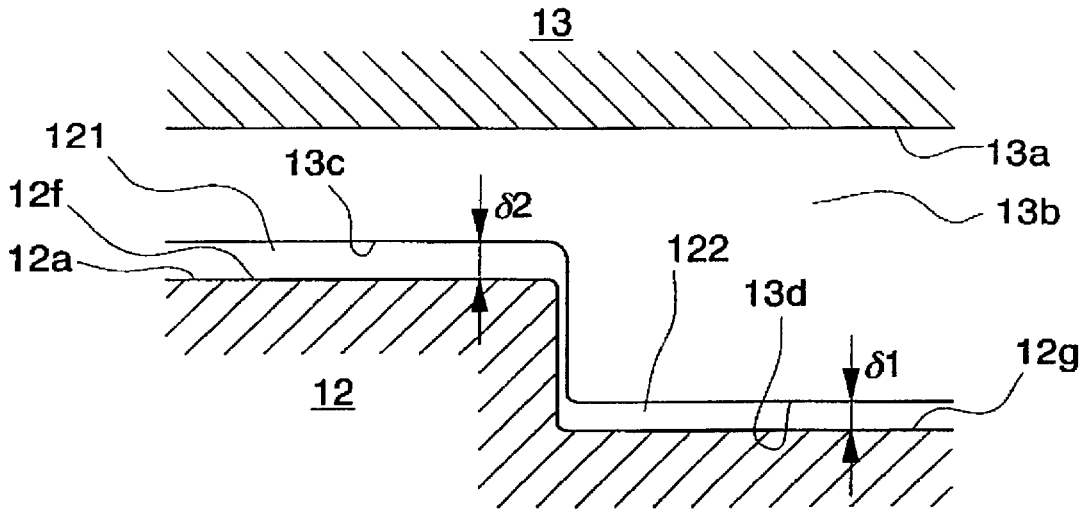
FIG. 4A is a cross-sectional view along a lengthwise direction of a compression chamber showing an engagement condition of the fixed scroll and the orbiting scroll at room temperature.

With the orbiting scroll 13 assembled to the fixed scroll 12, the cross-section along the lengthwise direction of the compression chamber C is shown in FIG. 4A. FIG. 4A shows the engagement condition of the end plate 12*a* of the fixed scroll 12 and the wall 13*b* of the orbiting scroll 13, for when the orbiting scroll 13 is assembled to the fixed scroll 12, in a room temperature condition.

As shown in the figure, a clearance 121 of a height $\delta 2$ is formed between the bottom face 12*f* and the upper rim 13*c*, and a clearance 122 of a height $\delta 1$ is formed between the bottom face 12*g* and the upper rim 13*d*. The height of these clearances 121 and 122 is set so that $\delta 2 > \delta 1$ results.

Figure 4B:
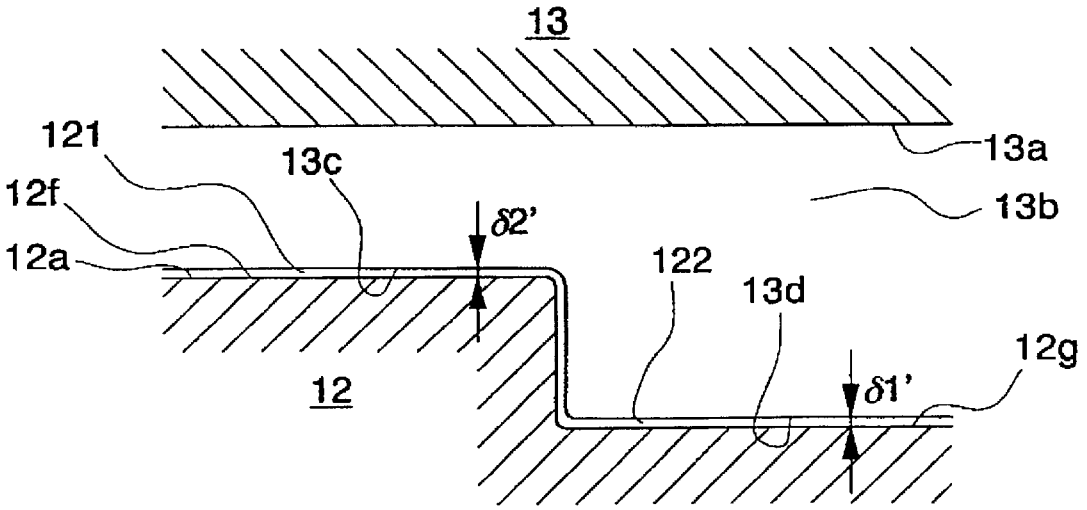
FIG. 4B is a cross-sectional view along the lengthwise direction of the compression chamber showing an engagement condition of the fixed scroll and the orbiting scroll at the time of operation.

In FIG. 4B, the scroll compressor of the present example has been operated so that the fixed scroll 12 and the orbiting scroll 13 are in a thermally expanded condition. As shown in the figure, the height of the clearance 121 between the bottom face 12*f* and the upper rim 13*c* becomes $\delta 2'$, and the height of the clearance 122 between the bottom face 12*g* and the connecting rim 13*e* becomes $\delta 1'$. The values for these $\delta 1'$ and $\delta 2'$ are approximately 10 $\mu$m to 50 $\mu$m.

Furthermore, while omitted from the figure, the engagement of the end plate 13*a* of the orbiting scroll 13 and the wall 12*b* of the fixed scroll 12 is constructed similarly to the above construction. That is, a clearance of a height $\delta 2$ is formed between the bottom face 13*f* and the upper rim 12*c*, and a clearance of a height $\delta 1$ ($<\delta 2$) is formed between the bottom face 13*g* and the upper rim 12*d*.

The compression chamber C moves towards the central portion from the outer peripheral end following the orbital movement of the orbiting scroll 13. However, while the contact point of the walls 12*b* and 13*b* exists towards the outer peripheral end from the connecting rim 12*e*, the connecting rim 12*e* slides on the connecting wall face 13*h* so that leakage of fluid between the adjacent compression chambers C (one not in the sealed condition) on either side of the wall 12 does not occur, and while the contact point of the walls 12*b* and 13*b* does not exist towards the outer peripheral end from the connecting rim 12*e*, this does not slide on the connecting wall face 13*h*, in order to ensure an equal pressure between the compression chambers C (both in the sealed condition) on either side of the wall 12.

The connecting rim 13*e* also in a similar manner, while the contact point of the walls 12*b* and 13*b* exists towards the outer peripheral end from the connecting rim 12*e*, slides on the connecting wall face 12*h* so that leakage of fluid between the adjacent compression chambers C (one not in the sealed condition) on either side of the wall 13 does not occur, and while the contact point of the walls 12*b* and 13*b* does not exist towards the outer peripheral end from the connecting rim 13*e*, this does not slide on the connecting wall face 12*h*, in order to ensure an equal pressure between the compression chambers C (both in the sealed condition) on either side of the wall 13. Here the sliding contact of the connecting rim 12*e* and the connecting wall face 13*h*, and the connecting rim 13*e* and the connecting wall face 12*h* occurs in the same period during a half rotation of the orbiting scroll 13.

The process of fluid compression at the time of driving the scroll compressor constructed as described above is explained sequentially as shown in FIG. 5 through FIG. 8.

Figure 5:
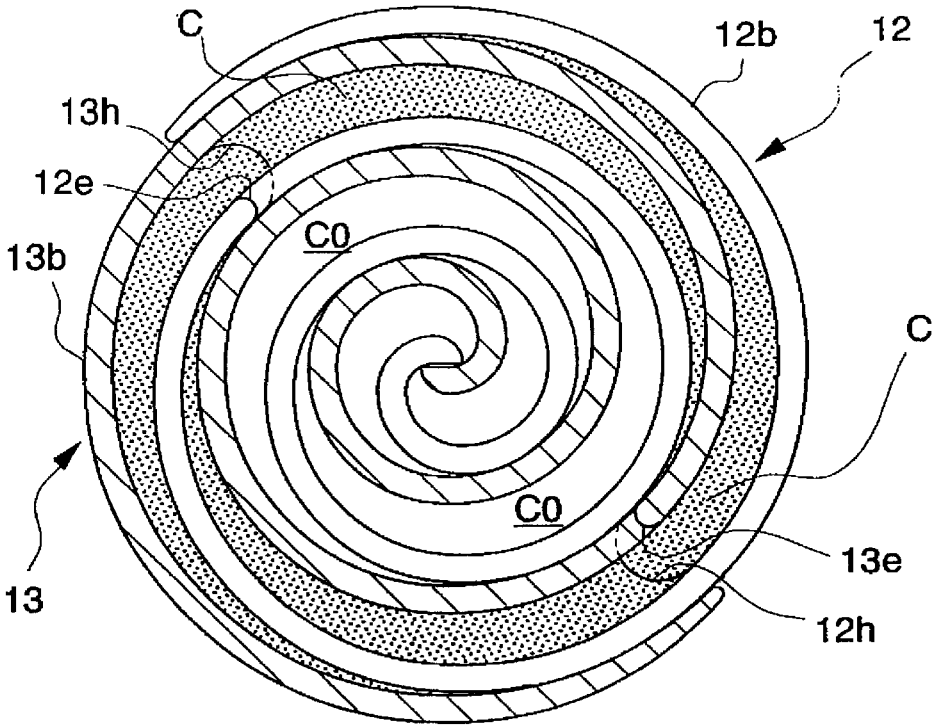
FIG. 5 is a diagram showing a process of fluid compression at the time of driving the scroll compressor.

In the condition shown in FIG. 5, two compression chambers C of maximum volume are formed at opposite positions on either side of the center of the scroll compression mechanism, by abutting the outer peripheral end of the wall 12*b* against the outside face of the wall 13*b*, and abutting the outer peripheral end of the wall 13*b* against the outside face of the wall 12*b*, and a fluid is introduced to between the end plates 12*a* and 13*a*, and the walls 12*b* and 13*b*. At this point in time, the connecting rim 12*e* and the connecting wall face 13*h*, and the connecting rim 13*e* and the connecting wall face 12*h* are slidingly contacted. Subsequently, immediately after, they contacted are separated from each other.

Figure 6:
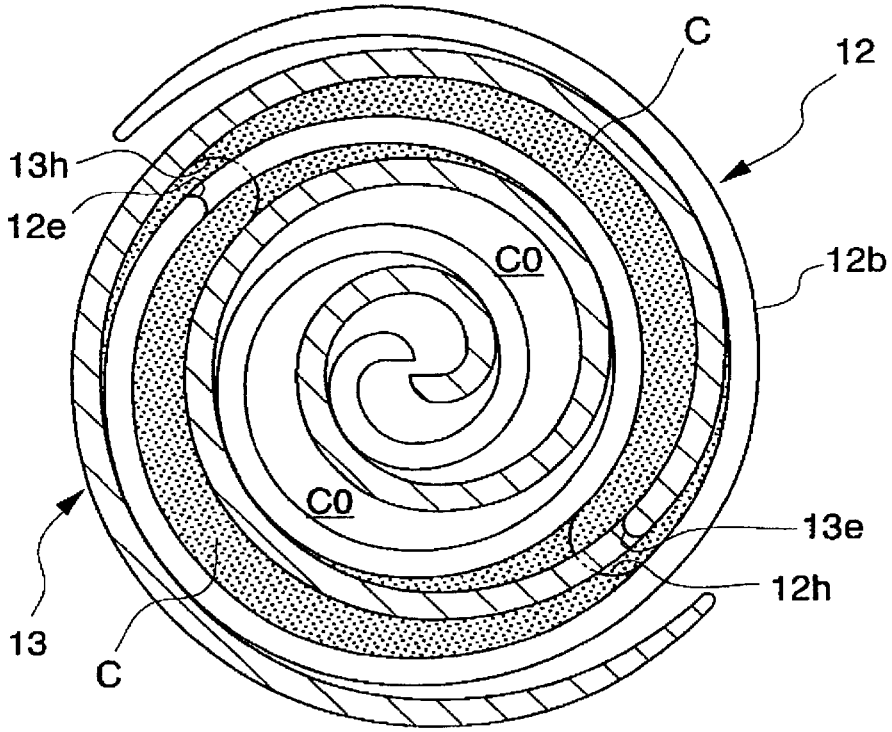
FIG. 6 is a diagram showing a process of fluid compression at the time of driving the scroll compressor.

In the process where the orbiting scroll 13 orbits by $\pi/2$ from the condition of FIG. 5 to reach the condition shown in FIG. 6, the compression chambers C proceed towards the central portion while maintaining the sealed condition, so that the volume is gradually reduced and the fluid compressed, and compression chambers CO which precede the compression chambers C also proceed towards the central portion while maintaining the sealed condition, so that the volume is gradually reduced to continuously compress the fluid. In this process, the respective sliding contacts between the connecting rim 12*e* and the connecting wall face 13*h*, and the connecting rim 13*e* and the connecting wall face 12*h* are cancelled, and the two adjacent compression chambers C on either side of the wall 13*b* become a communicated condition with equal pressure.

Figure 7:
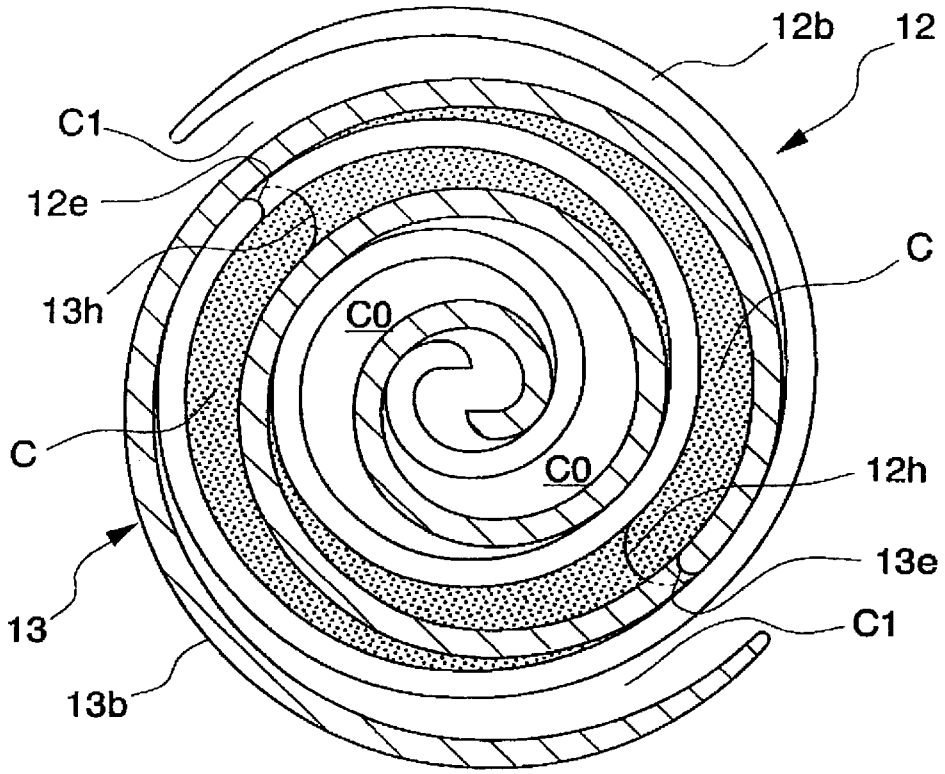
FIG. 7 is a diagram showing a process of fluid compression at the time of driving the scroll compressor.

In the process where the orbiting scroll 13 orbits by $\pi/2$ from the condition of FIG. 6 to reach the condition shown in FIG. 7, the compression chambers C proceed towards the central portion while maintaining the sealed condition, and the volume is gradually reduced and the fluid compressed, and the compression chambers CO also proceed towards the central portion while maintaining the sealed condition and the volume is gradually reduced and the fluid is continuously compressed. In this process, the equal pressure between the two adjacent compression chambers C continues, with the respective sliding contacts between the connecting rim 12*e* and the connecting wall face 13*h*, and the connecting rim 13*e* and the connecting wall face 12*h* being cancelled.

In the condition shown in FIG. 7, between the inside face of the wall 12*b* close to the outer peripheral end and the outside face of the wall 13*b* positioned inwards thereof, there is formed a space C1 which subsequently becomes a compression chamber. Similarly between the inside face of the wall 13*b* close to the outer peripheral end and the outside face of the wall 12*b* positioned inwards thereof, there is also formed a space C1 which subsequently becomes a compression chamber. A low pressure fluid flows from the low pressure chamber LR to these spaces C1. At this point in time, the connecting rim 12*e* and the connecting rim 13*e* start respective sliding contact with the connecting wall face 13*h* and the connecting wall face 12*h*, so that a sealed condition of the compression chambers C preceding the space C1 is maintained.

Figure 8:
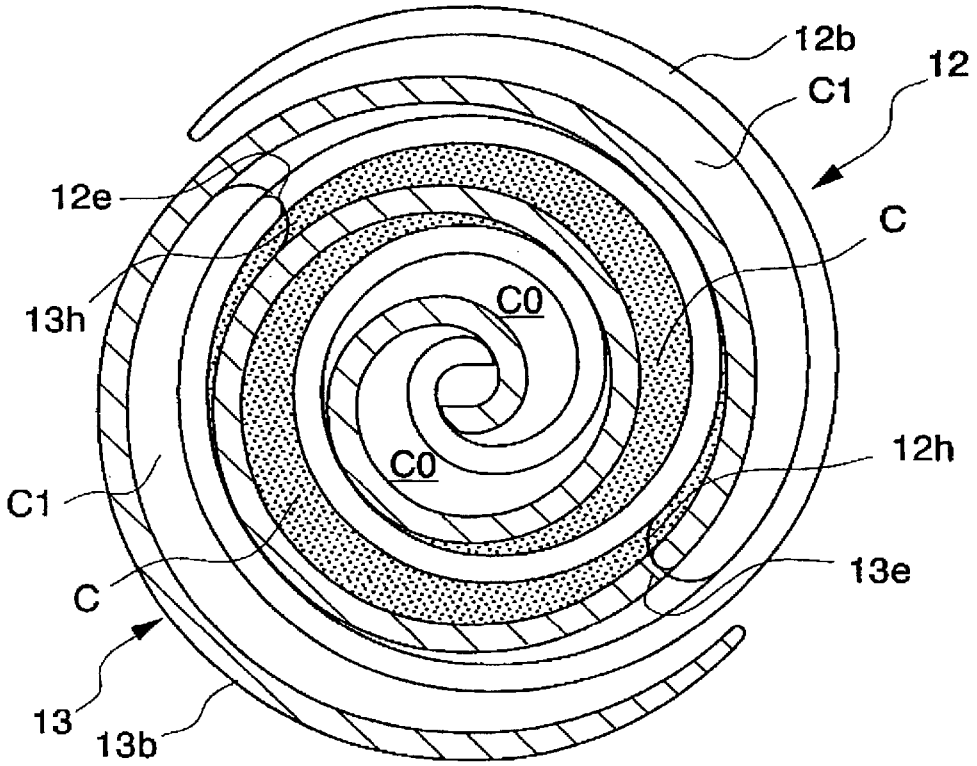
FIG. 8 is a diagram showing a process of fluid compression at the time of driving the scroll compressor.

In the process where the orbiting scroll 13 rotates by $\pi/2$ from the condition of FIG. 7 to reach the condition shown in FIG. 8, the spaces C1 proceed towards the central portion of the scroll compression mechanism, while the size expands, and the compression chambers C preceding the spaces C1 also proceed towards the central portion so that the volume is gradually reduced to compress the fluid. In this process, the respective sliding contact between the connecting rim 12*e* and the connecting wall face 13*h*, and the connecting rim 13*e* and the connecting wall face 12*h* continues, so that the sealed condition of the compression chambers C is maintained with a seal between the spaces C 1.

In the process where the orbiting scroll 13 orbits further by $\pi/2$ from the condition of FIG. 8 to again reach the condition shown in FIG. 5, the spaces C1 proceed towards the central portion of the scroll compressor mechanism while the size is further increased, and the compression chambers C preceding the spaces C1 also proceed towards the central portion while maintaining the sealed condition, so that the volume is gradually reduced to compress the fluid. In this process however, the respective sliding contact between the connecting rim 12*e* and the connecting wall face 13*h*, and the connecting rim 13*e* and the connecting wall face 12*h* is cancelled, but the sealed condition of the compression chambers C is maintained with a seal between the spaces C1. Then, when the condition of FIG. 5 is reached, the compression chambers C shown in FIG. 8 correspond to the compression chambers CO shown in FIG. 5 and the spaces C1 shown in FIG. 8 correspond to the compression chambers C shown in FIG. 5.

After this, by continuing the compression, the compression chambers C assume a minimum volume and the fluid is discharged from the compression chambers C.

The discharged fluid is introduced to the high pressure chamber HR. Then, the fixed scroll 12 is subjected to the high pressure back pressure and is pressed against the orbiting scroll 13 side. Furthermore, in the seal member 118, by introducing the high pressure fluid to inside the U-shape portion, this is expanded by the differential pressure so that the seal face is pressed towards the vertical faces of the circular flanges 116 and 117 to thereby seal between the high pressure chamber HR and the low pressure chamber LR.

Next is a description of the shape change of the compression chambers C.

The change of the size of the compression chambers C from the maximum volume to the minimum volume is shown by; the compression chambers C in FIG. 5→the compression chambers C in FIG. 7→the compression chambers CO in FIG. 5→the compression chambers CO in FIG. 8. Here the developed shapes of the compression chamber in the respective conditions are shown in FIG. 9A to FIG. 9D.

Figure 9A:
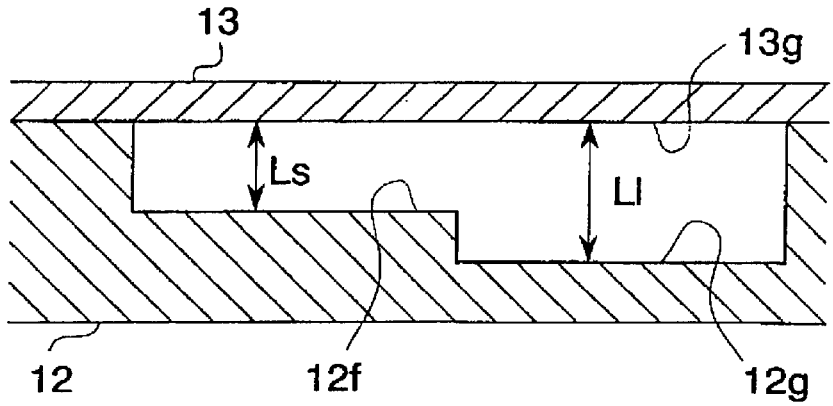
FIGS. 9A to 9D are diagrams showing developed shapes of the compression chamber of the scroll compressor.

In the condition of maximum volume of FIG. 9A, the compression chamber becomes a variable strip shape with the width becoming narrower along the orbit axis direction. This width, at the outer peripheral end side of the scroll compressor becomes a lap length L1 approximately equal to the height of the wall 12*b* from the bottom face 12*g* to the upper rim 12*d* (or the height of the wall 13*b* from the bottom face 13*g* to the upper rim 13*d*), and at the central portion side, this becomes a lap length Ls (<L1) approximately equal to the height from the bottom face 12*f* to the upper rim 12*d* (or the height of the wall 13*b* from the bottom face 13*f* to the upper rim 13*d*).

Figure 9B:
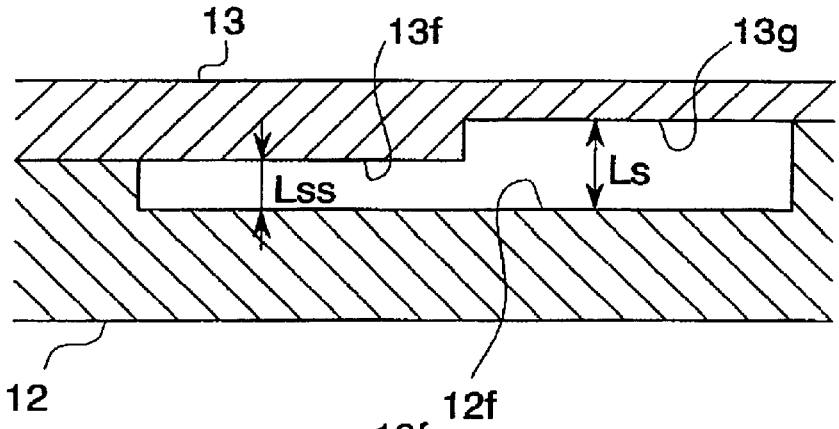

Also in the condition of FIG. 9B, the compression chamber becomes a variable strip shape with the width becoming narrower along the orbit axis direction. This width, at the outer peripheral end side of the scroll compressor becomes a lap length Ls, and at the central portion side, this becomes a lap length Lss (<Ls) approximately equal to the height from the bottom face 12*f* to the upper rim 12*c* (or the height of the wall 13*b* from the bottom face 13*f* to the upper rim 13*c*).

Figure 9C:
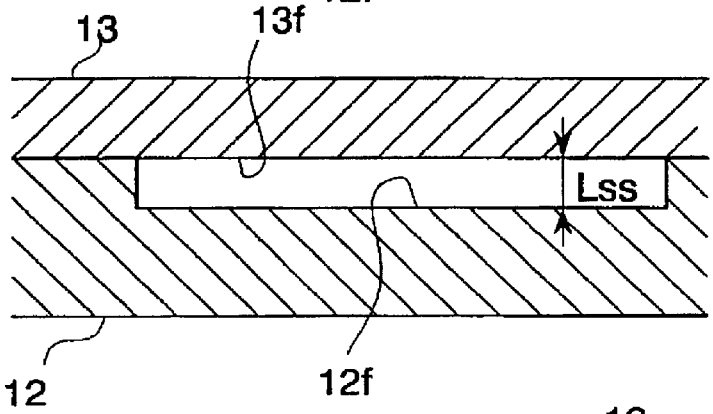

Furthermore, with progress of compression, as shown in FIG. 9C, the width of compression chamber becomes a uniform lap length Lss.

Figure 9D:
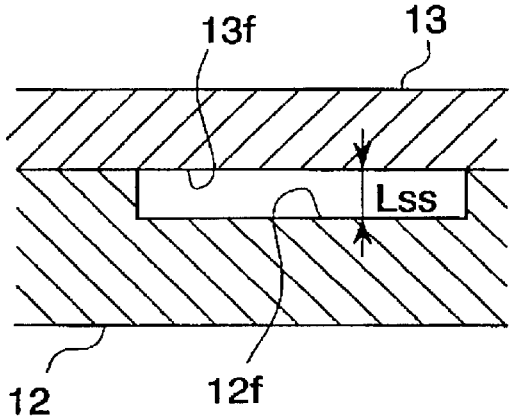

Then, as shown in FIG. 9D, the length thereof becomes a minimum value so that the compression chamber becomes a minimum volume.

As described above, in the scroll compressor of this example, in the room temperature condition the clearance 121 of a height δ2 is formed between the bottom face 12*f* and the upper rim 13*c*, and the clearance 122 of height δ1 is formed between the bottom face 12*g* and the upper rim 13*d*. Furthermore, the height of these clearances 121 and 122 is set so that δ2>δ1 results. Then, when the scroll compressor of this example is operated, this becomes a higher temperature closer to the central portion of the scroll, and the amount of thermal expansion of the walls 12*b* and 13*b* increases. Here, since δ2>δ1 results as mentioned above, the difference in the expansion amount between the central portion and the outer peripheral portion is compensated for. Hence after expansion, the heights δ1' and δ2' of the clearances 121 and 122 both become suitable values, so that compression at good efficiency can be performed.

Furthermore, the height of the clearances 121 and 122 is setup beforehand so that even if the walls 12*b* and 13*b* are thermally expanded, these do not come in contact with the respective end plates 13*a* and 12*a*. Therefore, when the scroll compressor is operated, the walls 12*b* and 13*b* and the end plates 13*a* and 12*a* do not come in contact and hinder the orbital movement of the orbiting scroll 13.

Furthermore, in the abovementioned scroll compressor, the volume change of the compression chamber is not brought about by only a reduction in the cross-section area parallel to the orbit plane as heretofore, but as shown in FIG. 9A to FIG. 9D, is brought about by a combination of a reduction in the width in the orbit axis direction and a reduction in the cross-section area.

Consequently, by making the walls 12*b* and 13*b* a stepped shape, changing the lap length of the walls 12*b* and 13*b* near the outer peripheral end and near the central portion of the scroll compressor, and increasing the maximum volume and reducing the minimum volume of the compression chambers C, then compared to the conventional scroll compressor where the lap length of the wall pairs are constant, the compression ratio can be improved.

Furthermore, by introducing the back pressure to the high pressure chamber HR, the fixed scroll 12 is pressed towards the orbiting scroll 13. Therefore, sealing of the compression chamber C can be performed without using a tip seal.

In the above, for the walls 12*b* and 13*b*, since the amount of expansion at the central portion side is large, the height of the clearances 121 and 122 is set so that δ2 >δ1 results.

In general, if the walls 12*b* and 13*b* are high, the displacement in the height direction due to expansion is large. That is, since the height dimension of the walls 12*b* and 13*b* of the central portion side is made small compared to that of the walls 12*b* and 13*b* of the outer peripheral end side, then for the same temperature, the displacement of the central side due to thermal expansion is smaller. Consequently, the height of the clearances 121 and 122 for the central portion side and the outer peripheral end side of the step can be determined taking these conditions into consideration. That is, since the walls 12*b* and 13*b* are a stepped shape, the height of the walls can be made different at the central portion side of the step to the outer peripheral end portion side. Therefore depending on the heights of the respective walls 12*b* and 13*b* on the central portion side and the outer peripheral end side, the height of the respective clearances 121 and 122 may be formed the same, or the height of the clearance 121 for the central-portion side may be less than for the clearance 122.

In addition, in the abovementioned embodiment, the connecting rims 12*e* and 13*e* are formed perpendicular to the orbit plane of the orbiting scroll 13, and the connecting wall faces 12*h* and 13*h* corresponding to these are also formed perpendicular to the orbit plane. However, if the connecting rims 12*e* and 13*e*, and the connecting wall faces 12*h* and 13*h* maintain a corresponding relationship with each other, then it is not necessary for these to be perpendicular to the orbit plane, and for example, these may be formed at an incline to the orbit plane.

Furthermore, it is not necessary that the connecting rims 12*e* and 13*e* form a semicircle, and these may be of any shape. In this case, the envelope drawn by the connecting rims 12*e* and 13*e* does not become a circular arc, and hence the connecting wall faces 12*h* and 13*h* are also no longer a circular arc.

Moreover, the places where the steps 42 and 43 are formed need not each be at the same place, and these may be respectively provided at a plurality of places.

A second embodiment of a scroll compressor according to the present invention will now be described referring to FIG. 10 through FIG. 17A to FIG. 17D. Description is omitted for points similar to those in the first embodiment.

Figure 10:
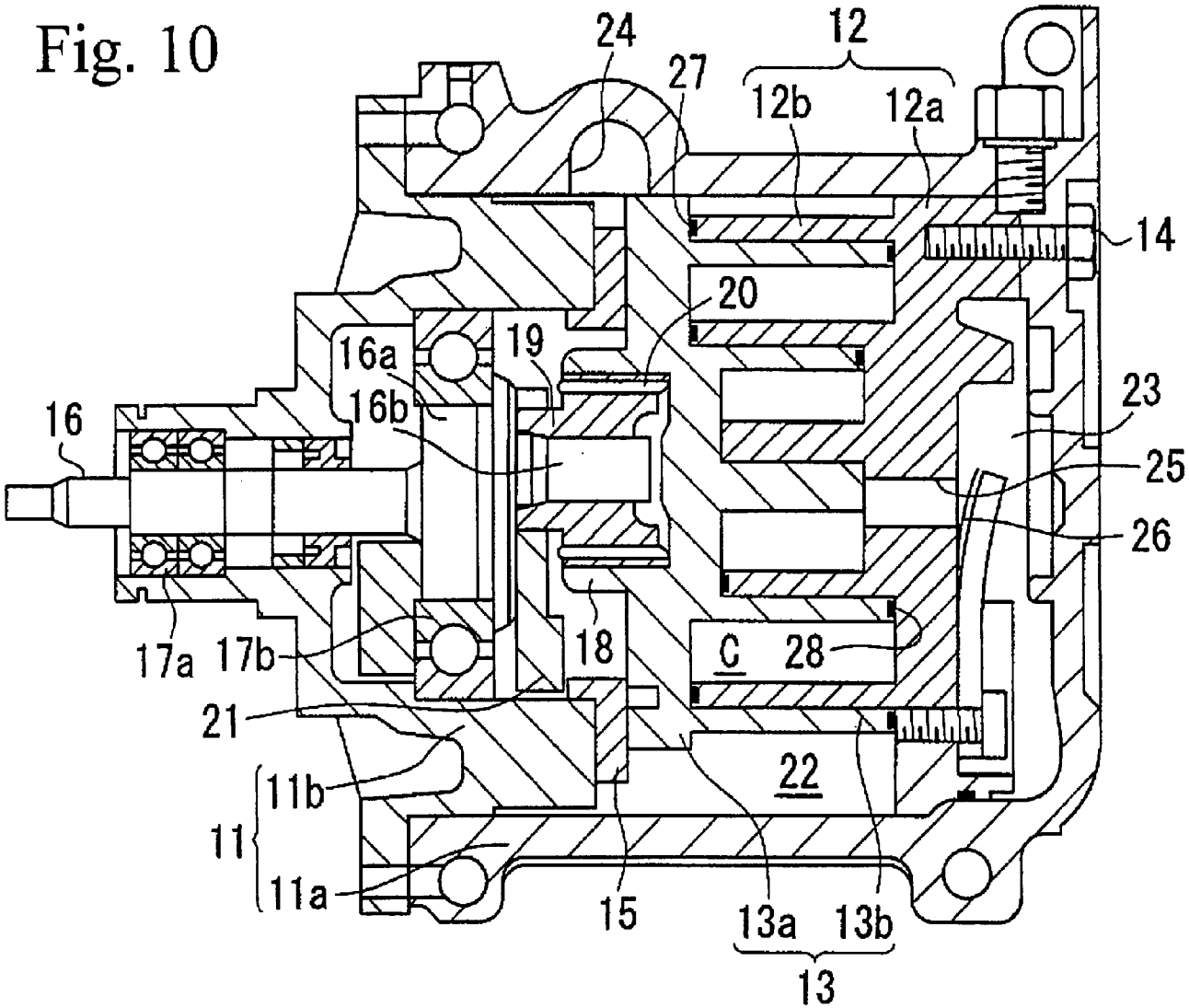
FIG. 10 is a cross-sectional view illustrating an overall construction of a scroll compressor shown as a second embodiment of the present invention.

FIG. 10 is a cross-sectional view showing an overall construction of a scroll compressor according to the present invention.

In this scroll compressor, a housing 11 comprises a cup-like housing body 11*a*, and a cover plate 11*b* secured to an opening end of the housing body 11*a*.

The scroll compressor comprising a fixed scroll 12 and an orbiting scroll 13 is disposed inside the housing 11. The fixed scroll 12 is formed with a spiral wall 12*b* upstanding on one side face of an end plate 12*a*. The orbiting scroll 13, as with the fixed scroll 12 is formed with a spiral wall 13*b* upstanding on one side face of an end plate 13*a*. In particular, the wall 13*b* is made substantially the same shape as the wall 12*b* for the fixed scroll 12 side. Furthermore, on upper rims of the walls 12*b* and 13*b*, there is disposed tip seals 27 and 28 for increasing gas tightness of the compression chambers C as described later (a description is given later for these tip seals 27 and 28).

The fixed scroll 12 is fastened to the housing body 11*a* with bolts 14. Moreover the orbiting scroll 13 is assembled to the fixed scroll 12, eccentric thereto by a mutual orbit radius and out of phase by 180 degrees, with the walls 12*b* and 13*b* engaged with each other, and is supported so as to be orbitally movable with rotation prevented by means of a rotation prevention mechanism 15 provided between the cover plate 11*b* and the end plate 13*a*.

A rotating shaft 16 incorporating a crank 16*a* is passed through the cover plate 11*b*, and is rotatably supported on the cover plat 11*b* via bearings 17*a* and 17*b*.

A boss 18 is protrudingly provided on the central portion of the other end face of the end plate 13*a* on the orbiting scroll 13 side. An eccentric portion 16*b* of the crank 16*a* is rotatably accommodated in the boss 18 via a bearing 19 and a drive bush 20, so that the orbiting scroll 13 is orbitally moved by rotating the rotating shaft 16. Furthermore, a balance weight 21 for counteracting an imbalance amount exerted on the orbiting scroll 13, is fitted to the rotating shaft 16.

A suction chamber 22 is formed in an interior of the housing 11 around the fixed scroll 12. Furthermore, a discharge cavity 23 is formed by compartmentalizing a bottom face inside the housing body 11*a* and the other side face of the end plate 12*a*.

A suction port 24 for guiding low pressure fluid towards the suction chamber 22, is provided in the housing body 11*a*, and discharge port 25 for guiding high pressure fluid towards the discharge cavity 23 from the compression chambers C which move to the central portion while the volume is gradually reduced, is provided at the center of the end plate 12*a* on the fixed scroll 12 side. Moreover, a discharge valve 26 which opens the discharge port 25 only when a pressure greater than a predetermined amount acts, is provided on the other side face center of the end plate 12*a*.

Figure 11:
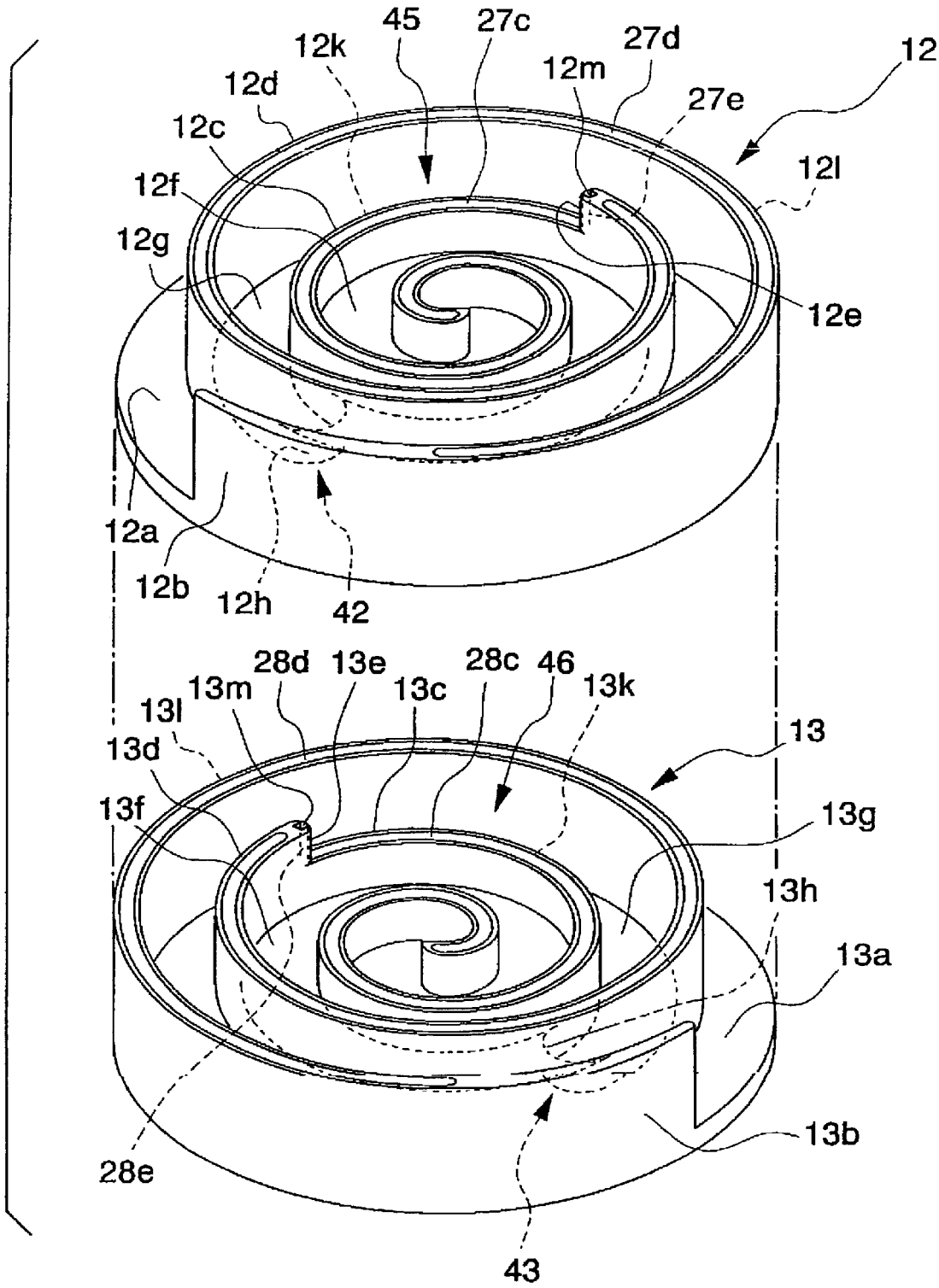
FIG. 11 is perspective views of a fixed scroll and an orbiting scroll used in the scroll compressor.

FIG. 11 is respective perspective views of the fixed scroll 12 and the orbiting scroll 13.

Steps 42 and 43 are provided at positions 2π (rad) from the outer peripheral ends of the respective walls 12*b* and 13*b*, with the spiral centers of the wall 12*b* and the wall 13*b* as a reference.

Figure 12:
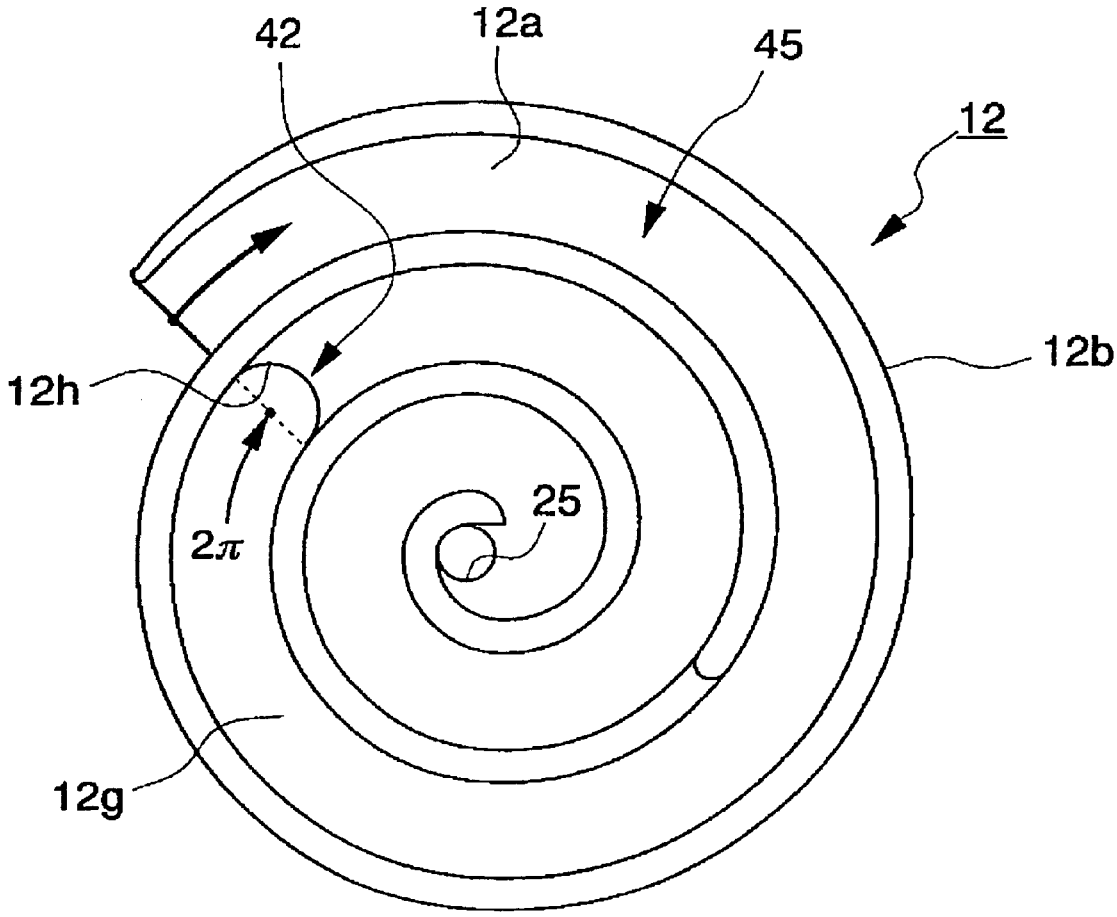
FIG. 12 is a plan view of a fixed scroll used in the scroll compressor.

As shown in FIG. 12, the spiral shape wall 12*b* forms a spiral shape flow path 45 between wall portions, and the circular arc center of the connecting wall face 12*h* constituting the step 42 is positioned in the widthwise center of the flow path 45 at a position where the flow path 45 has advanced 2π (rad) from the outer peripheral end of the wall 12*b* to the central side, with the spiral center of the wall 12*b* as a reference. Here the circular arc center of the connecting wall face 12*h* is positioned on an outer peripheral end side from a position where the flow path 45 has advanced 2π (rad) from a discharge port 25 forming position to the outer peripheral end side along the wall 12*b*.

The circular arc center of the connecting wall face 13*h* also is similarly a point advanced 2π (rad) from the outer peripheral end of the wall 12*b* to the center side, and is positioned at the widthwise center of the flow path 46 formed between the wall portions of the wall 13*b*, and is positioned on an outer peripheral end side from a position advanced 2π (rad) from the discharge port 25 forming position to the outer peripheral end side.

Furthermore, as shown in FIG. 11, tip seals 27*c*, 27*d* and 27*e* are respectively disposed in the upper rims 12*c* and 12*d* and the connecting rim 12*e* of the wall 12*b*. In a similar manner, tip seals 28*c*, 28*d*, and 28*e* are also respectively disposed in the upper rims 13*c* and 13*d* and the connecting rim 13*e* of the wall 13.

The process of fluid compression at the time of driving the scroll compressor constructed as described above is explained sequentially as shown in FIG. 13 through FIG. 16.

Figure 13:
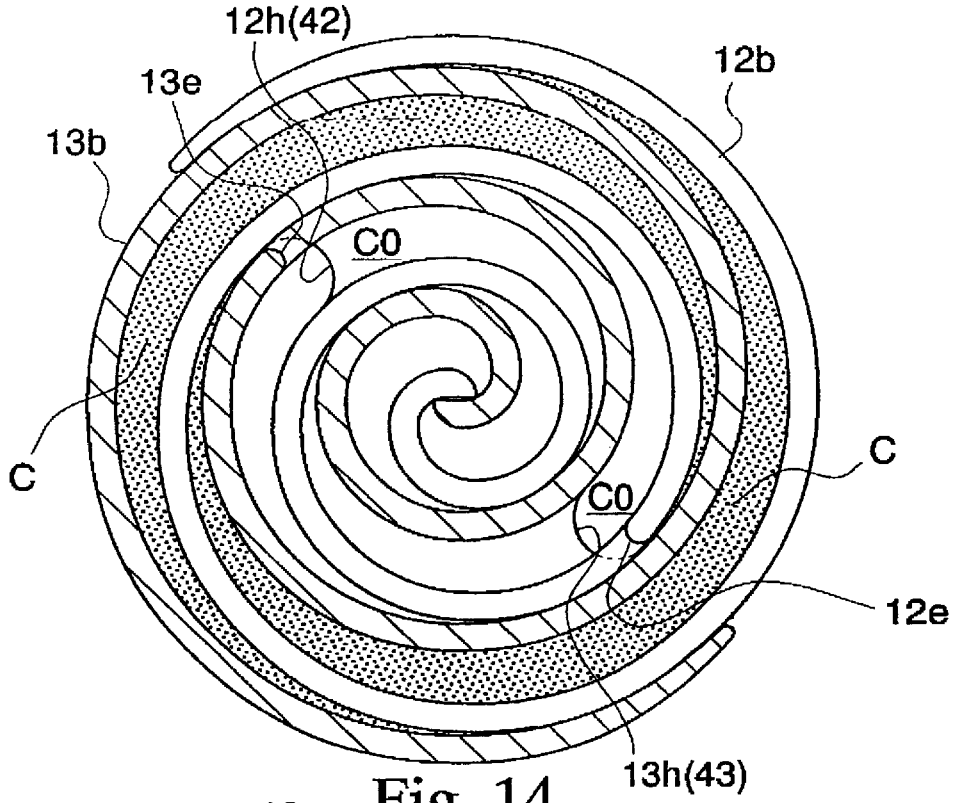
FIG. 13 is a diagram showing a process of fluid compression at the time of driving the scroll compressor.

In the condition shown in FIG. 13, two compression chambers C of maximum volume are formed at opposite positions on either side of the center of the scroll compression mechanism, by abutting the outer peripheral end of the wall 12*b* against the outside face of the wall 13*b*, and abutting the outer peripheral end of the wall 13*b* against the outside face of the wall 12*b*, and a fluid is introduced to between the end plates 12*a* and 13*a*, and the walls 12*b* and 13*b*. At this point in time, the connecting rim 12*e* and the connecting wall face 13*h*, and the connecting rim 13*e* and the connecting wall face 12*h* are slidingly contacted.

Figure 14:
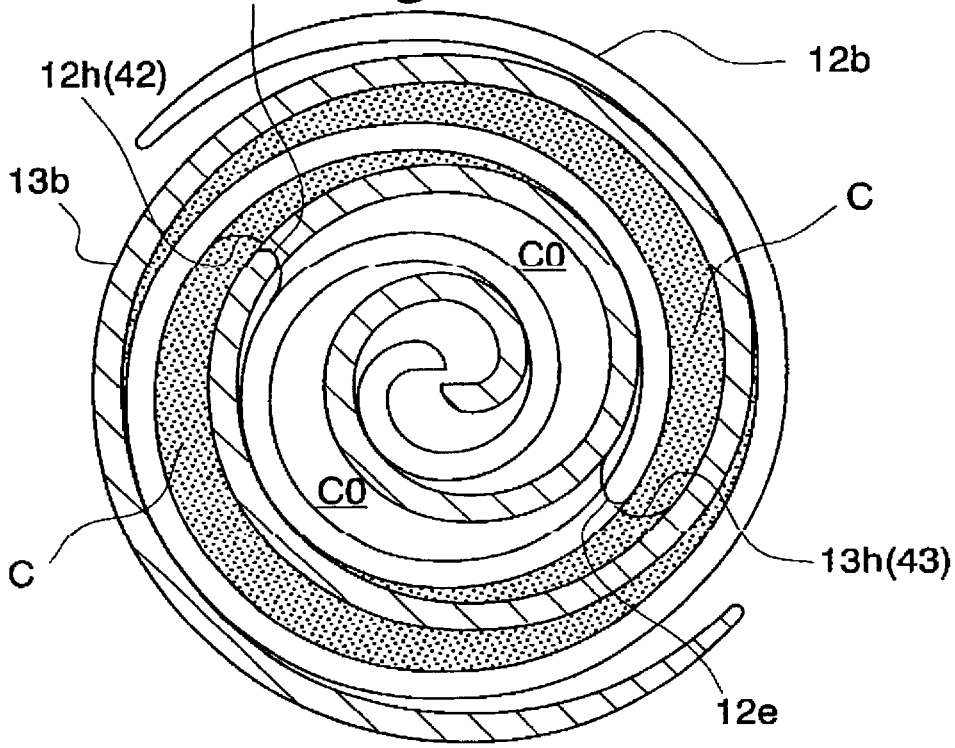
FIG. 14 is a diagram showing a process of fluid compression at the time of driving the scroll compressor.

In the process where the orbiting scroll 13 orbits by π/2 from the condition of FIG. 13 to reach the condition shown in FIG. 14, the compression chambers C proceed towards the central portion while maintaining the sealed condition, so that the volume is gradually reduced and the fluid compressed, and compression chambers CO which precede the compression chambers C also proceed towards the central portion while maintaining the sealed condition, so that the volume is gradually reduced to continuously compress the fluid. In this process, the connecting rim 12*e* starts sliding contact with the connecting wall face 13*h*, and the connecting rim 13*e* starts sliding contact with the connecting wall face 12*h*, and the sealed condition of the compression chambers CO which precede the compression chambers C is maintained.

Figure 15:
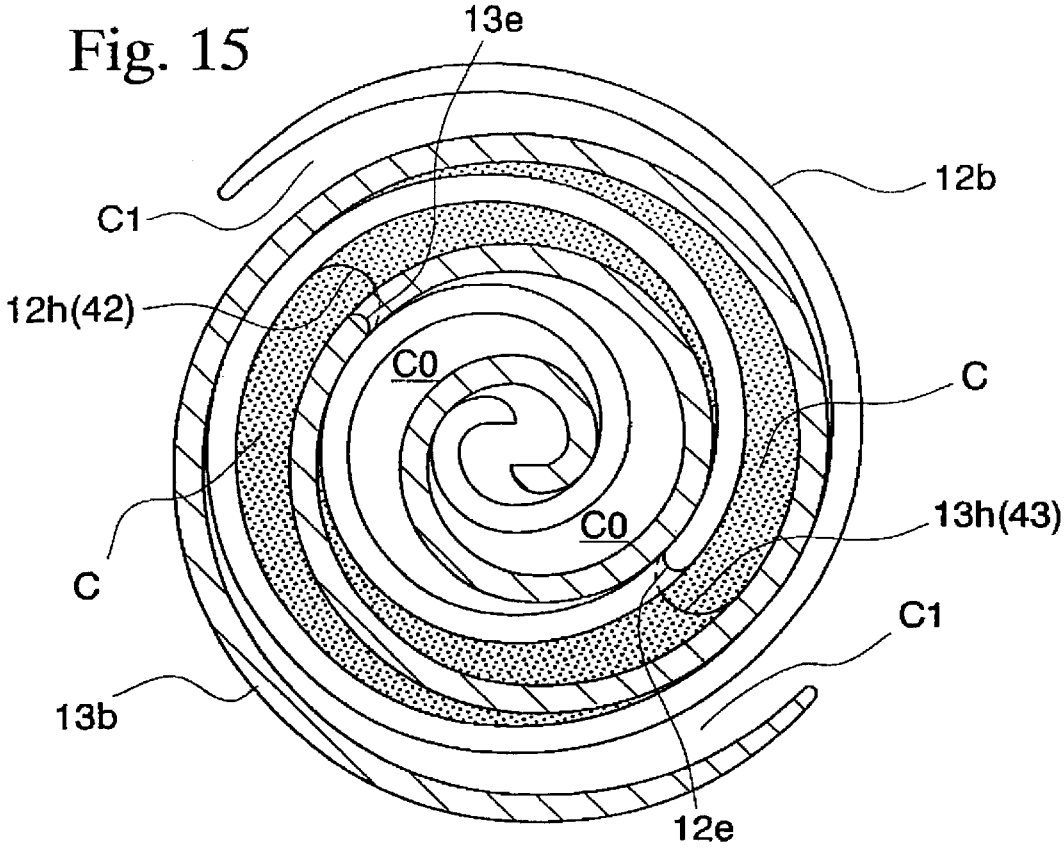
FIG. 15 is a diagram showing a process of fluid compression at the time of driving the scroll compressor.

In the process where the orbiting scroll 13 orbits by π/2 from the condition of FIG. 14 to reach the condition shown in FIG. 15, the compression chambers C proceed towards the central portion while maintaining the sealed condition, and the volume is gradually reduced and the fluid compressed, and the compression chambers CO which precede the compression chambers C also proceed towards the central portion while maintaining the sealed condition and the volume is gradually reduced and the fluid is continuously compressed. At this point in time, the connecting rim 12*e* and the connecting wall face 13*h*, and the connecting rim 13*e* and the connecting wall face 12*h* are slidingly contacted. However immediately after, this is cancelled.

In the condition shown in FIG. 15, between the inside face of the wall 12*b* close to the outer peripheral end and the outside face of the wall 13*b* positioned inwards thereof, there is formed a space C1 which subsequently becomes a compression chamber. Similarly between the inside face of the wall 13*b* close to the outer peripheral end and the outside face of the wall 12*b* positioned inwards thereof, there is also formed a space C1 which subsequently becomes a compression chamber. A low pressure fluid flows from the suction chamber 22 to these spaces C1.

Figure 16:
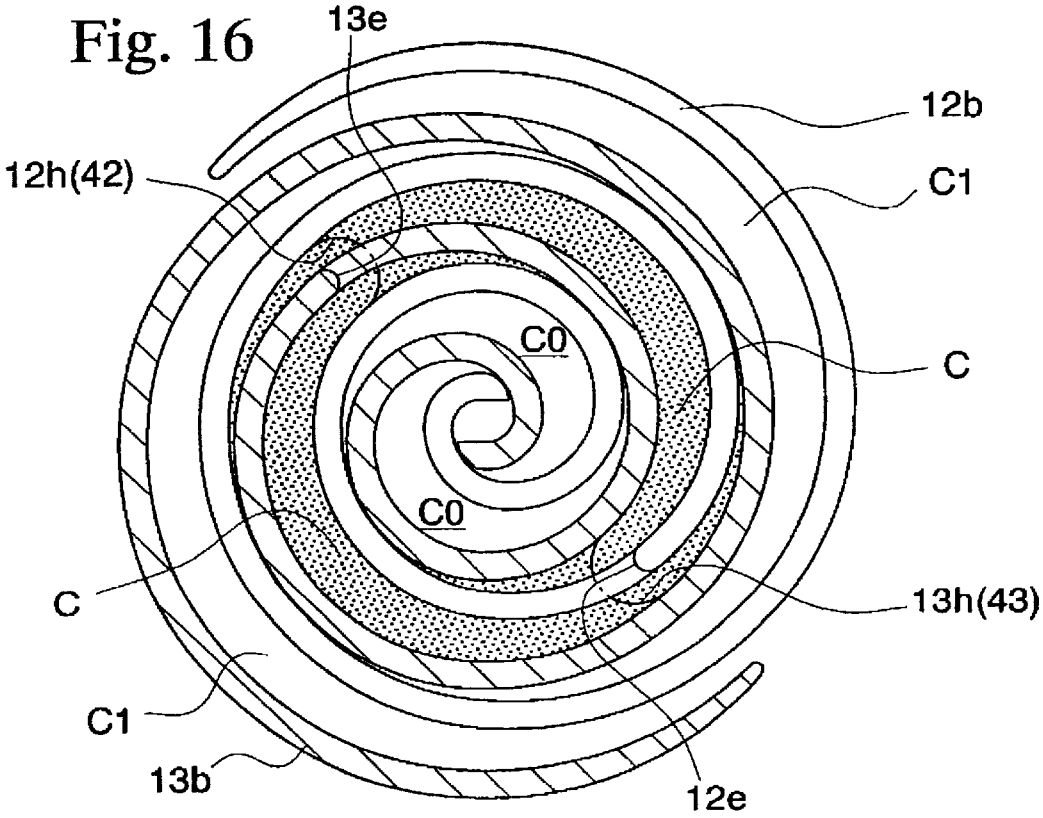
FIG. 16 is a diagram showing a process of fluid compression at the time of driving the scroll compressor.

In the process where the orbiting scroll 13 orbits by π/2 from the condition of FIG. 15 to reach the condition shown in FIG. 16, the spaces C1 proceed towards the central portion of the scroll compression mechanism, while their size expands, and the compression chambers C preceding the spaces C1 also proceed towards the central portion so that the volume is gradually reduced to compress the fluid. In this process, the respective sliding contact between the connecting rim 12*e* and the connecting wall face 13*h*, and the connecting rim 13*e* and the connecting wall face 12*h* is cancelled so that the adjacent two compression chambers C become equal pressure.

In the process where the orbiting scroll 13 orbits further by π/2 from the condition of FIG. 16 to again reach the condition shown in FIG. 13, the spaces C1 proceed towards the central portion of the scroll compressor mechanism while the size is further increased, and the compression chambers C preceding the spaces C1 also proceed towards the central portion while maintaining the sealed condition, so that the volume is gradually reduced to compress the fluid. Then, when the condition of FIG. 13 is reached, the compression chambers C shown in FIG. 16 correspond to the compression chambers C0 shown in FIG. 13 and the spaces C1 shown in FIG. 16 correspond to the compression chambers C shown in FIG. 13.

After this, by continuing the compression, the compression chambers C become a minimum volume and discharges the fluid from the scroll compressor.

The change of the size of the compression chambers C from the maximum volume to the minimum volume (the volume when the discharge valve 26 is open) is shown by; the compression chambers C in FIG. 13→the compression chambers C in FIG. 15→the compression chambers C0 in FIG. 13→the compression chambers C0 in FIG. 16. Here the developed shapes of the compression chamber in the respective conditions are shown in FIG. 17A to FIG. 17D.

Figure 17A:
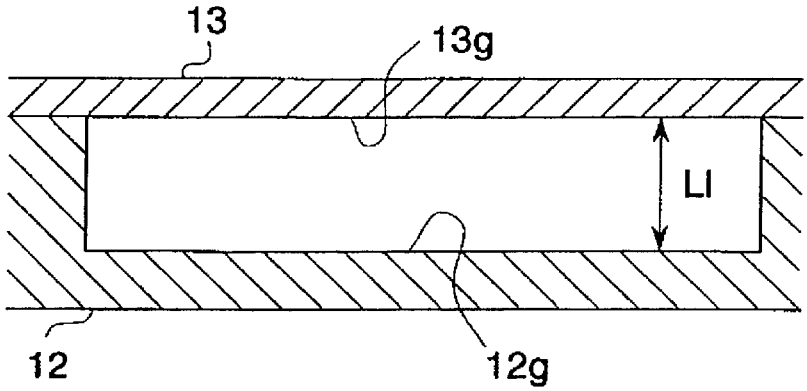
FIGS. 17A to 17D are diagrams showing developed shapes of the compression chamber of the scroll compressor.

In the condition of maximum volume of FIG. 17A, the width of the compression chamber becomes a lap length L1 approximately equal to the height of the wall 12*b* from the bottom face 12*g* to the upper rim 12*d* (or the height of the wall 13*b* from the bottom face 13*g* to the upper rim 13*d*).

Figure 17B:
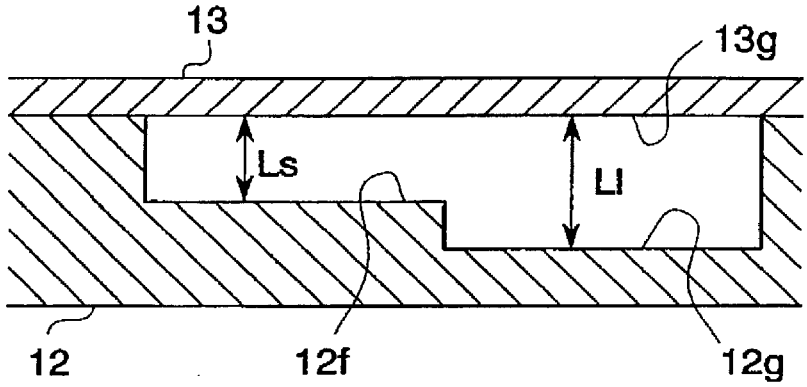

In the condition of FIG. 17B, the compression chamber becomes a variable section thin strip shape with the width becoming narrower along the orbit axis direction. This width, at the outer peripheral end side of the scroll compressor becomes a lap length L1, and at the central portion side, this becomes a lap length Ls (<L1) approximately equal to the height from the bottom face 12*f* to the upper rim 12*d* (or the height of the wall 13*b* from the bottom face 13*f* to the upper rim 13*d*).

Figure 17C:
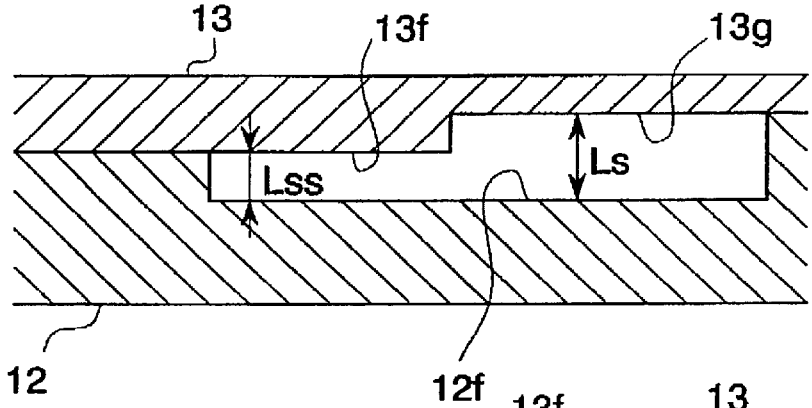
Figure 17D:
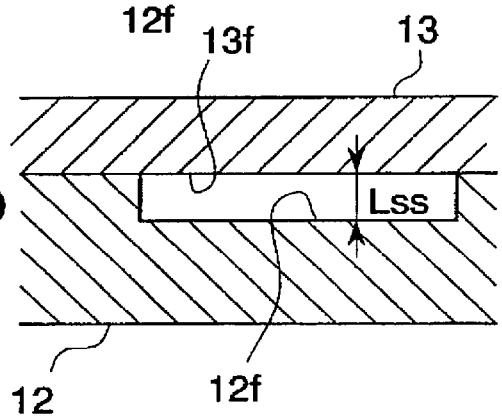

Also in the condition of FIG. 17C, the compression chamber becomes a variable section thin strip shape with the width becoming narrower along the orbit axis direction. This width, at the outer peripheral end side of the scroll compressor becomes a lap length Ls, and at the central portion side, this becomes a lap length Lss (<Ls) approximately equal to the height from the bottom face 12*f* to the upper rim 12*c* (or the height of the wall 13*b* from the bottom face 13*f* to the upper rim 13*c*).

In the condition of minimum volume of FIG. 17, the compression chamber becomes a thin strip shape with the width uniform (lap length Lss).

In the abovementioned scroll compressor, the volume change of the compression chamber is not brought about by only a reduction in the cross-section area parallel to the orbit plane as heretofore, but as shown in FIG. 17A to FIG. 17D, is brought about by a combination of a reduction in the width in the orbit axis direction and a reduction in the cross-sectional area.

Consequently, by making the walls 12*b* and 13*b* a stepped shape, changing the lap length of the walls 12*b* and 13*b* near the outer peripheral end and near the central portion of the scroll compressor, and increasing the maximum volume and reducing the minimum volume of the compression chambers C, then compared to the conventional scroll compressor where the lap length of the wall pairs are constant, the compression ratio can be improved.

Moreover, since the steps 42 and 43 are respectively positioned 2π (rad) from the spiral outer peripheral end of the walls 12*b* and 13*b*, then when the compression chamber is a maximum volume as shown in FIG. 17A, the lap length thereof can be a maximum along the whole area in the spiral direction.

Furthermore, when the steps 42 and 43 come too close to the center of the spiral, the differential pressure of the compression chamber which the walls 12*b* and 13*b* partition on the inside and outside becomes large, and hence the fluid inside the compression chamber on the inside is likely to pass through the steps 42 and 43 and leak to the compression chamber on the outside. However, in this example, since the steps 42 and 43 as described above are positioned 2π (rad) from the spiral outer peripheral end of the walls 12*b* and 13*b*, the maximum volume of the compression chamber can be made a maximum, and at the same time the leakage of the fluid due to the differential pressure can be suppressed. Furthermore, since the wall portions 42 and 43 are provided at a position advanced more than 2π (rad) from the discharge port 25 to the outer peripheral end side, the compression chambers C containing the steps 42 and 43 do not face the discharge port 25. Consequently, the compression chambers containing the steps 42 and 43 do not become discharge pressure, and hence the seal pressure differential between the spiral central portion side and the outer peripheral end side on either side of the steps can be kept small, enabling leakage of refrigerant to be suppressed.

If the step 42 and 43 are not 2π (rad) from the spiral outer peripheral end of the walls 12*b* and 13*b*, but are within a range in the vicinity of 2π (rad), for example, 2π±π/4 (rad), then since this only differs by a few percent from the volume ratio for 2π (rad), the maximum volume of the compression chamber can be kept sufficiently large, and leakage of fluid inside the compression chamber caused by the abovementioned pressure differential can also be prevented.

Moreover, if the steps 42 and 43 are at a position which at least exceeds c from the outer peripheral end of the walls 12*b* and 13*b*, the maximum volume of the compression chamber can be made greater than heretofore, and compression efficiency can be improved.

The places where the steps 42 and 43 are formed need not each be at the same place, and these may be respectively provided at a plurality of places.

In addition, in the abovementioned embodiment, the connecting rims 12*e* and 13*e* are formed perpendicular to the orbit plane of the orbiting scroll 13, and the connecting wall faces 12*h* and 13*h* corresponding to these are also formed perpendicular to the orbit plane. However, if the connecting rims 12*e* and 13*e*, and the connecting wall faces 12*h* and 13*h* maintain a corresponding relationship with each other, then it is not necessary for these to be perpendicular to the orbit plane, and for example, these may be formed at an incline to the orbit plane.

Furthermore, it is not necessary that the connecting rims 12*e* and 13*e* form a semicircle, and these may be any shape. In this case, the envelope drawn by the connecting rims 12*e* and 13*e* does not become a circular arc, and hence the connecting wall faces 12*h* and 13*h* are also no longer a circular arc.

In the above description, the steps 42 and 43 are provided position advanced more than 2π (rad) from the discharge port 25 to the outer peripheral end side. However, in the case of a scroll where the number of turns is small, as long as the steps 42 and 43 are provided at a position exceeding at least a pitch angle π (rad) from the outer peripheral end towards the central portion along the spiral of the scroll wall, these may be provided at a position less than 2π (rad) from the discharge port towards the outer peripheral end side.

A third embodiment of a scroll compressor according to the present invention will now be described while referring to FIG. 18 to FIG. 22. Description is omitted for points similar to those in the first and second embodiment.

Figure 18:
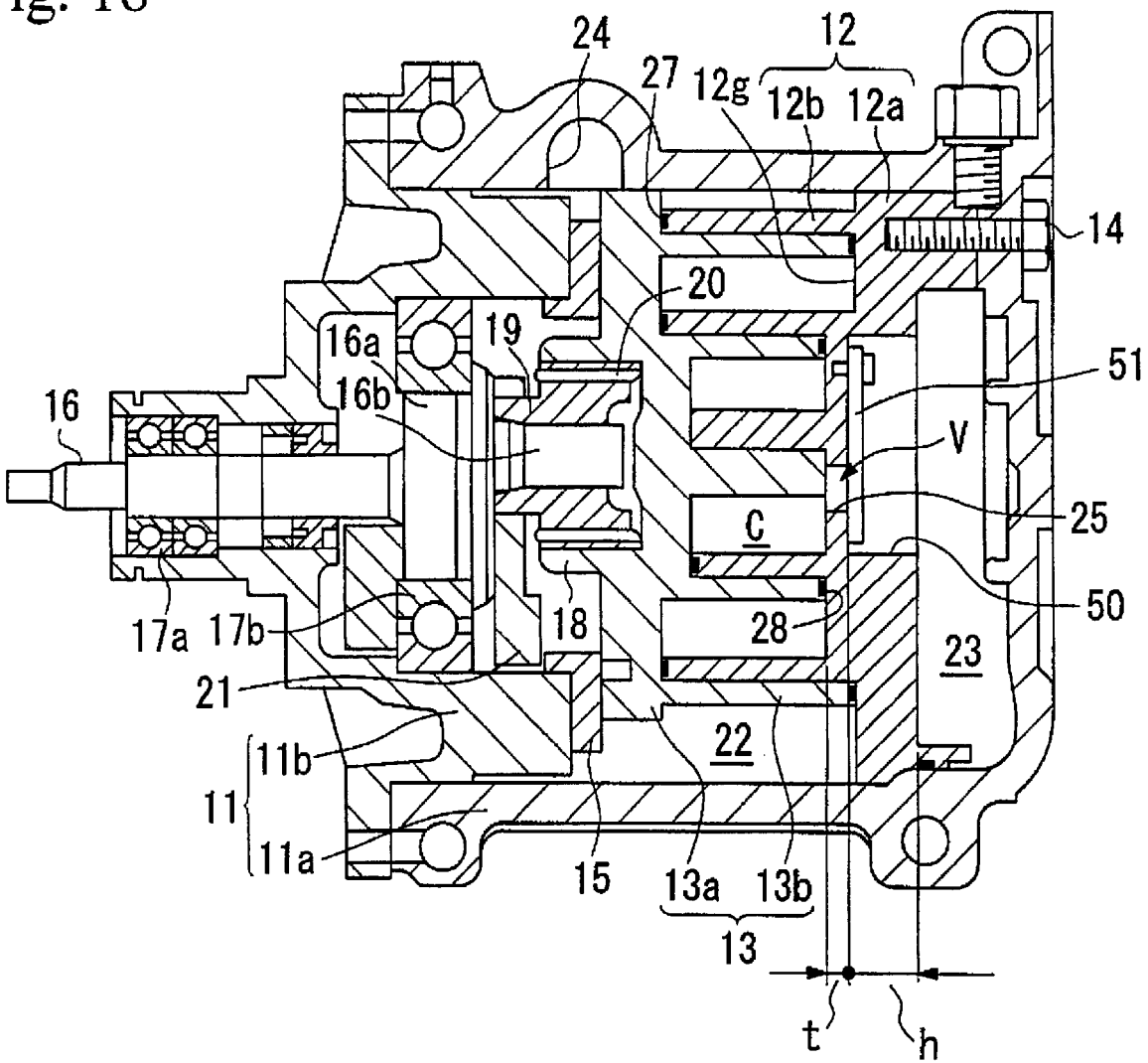
FIG. 18 is a cross-sectional view illustrating an overall construction of a scroll compressor shown as a third embodiment of the present invention.
Figure 19:
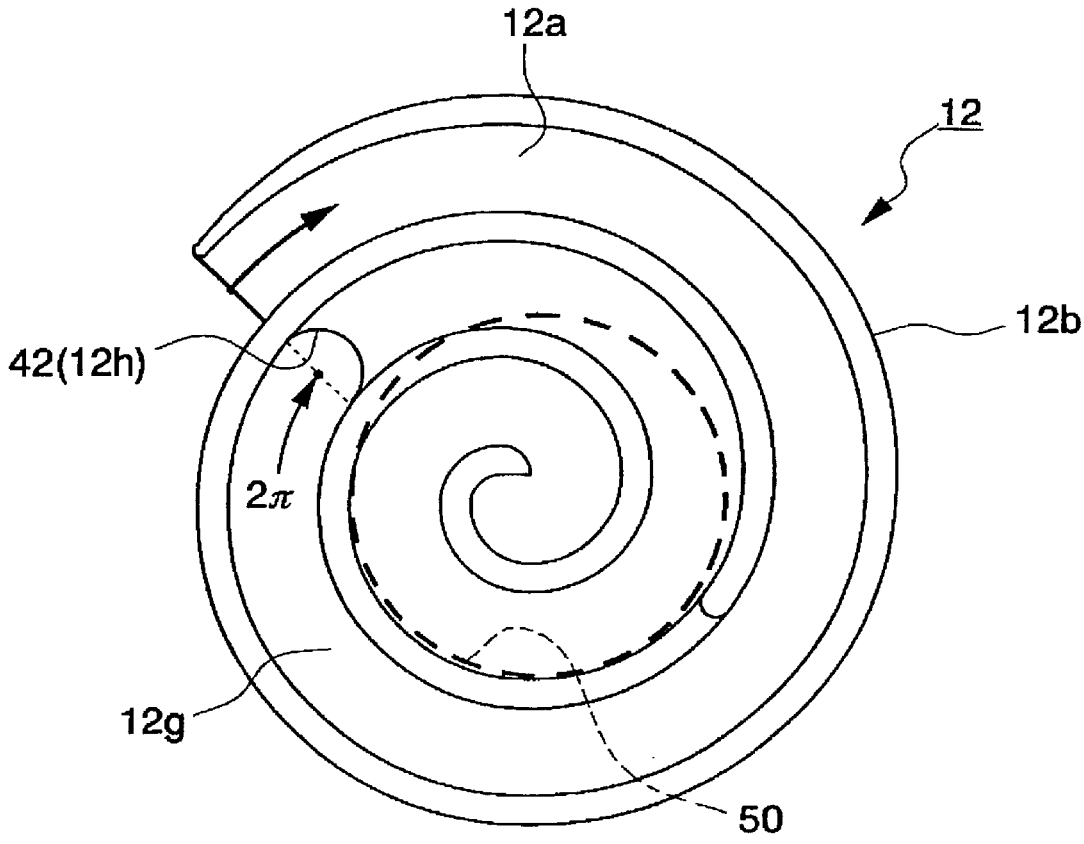
FIG. 19 is a plan view of a fixed scroll used in the scroll compressor.
Figure 20:
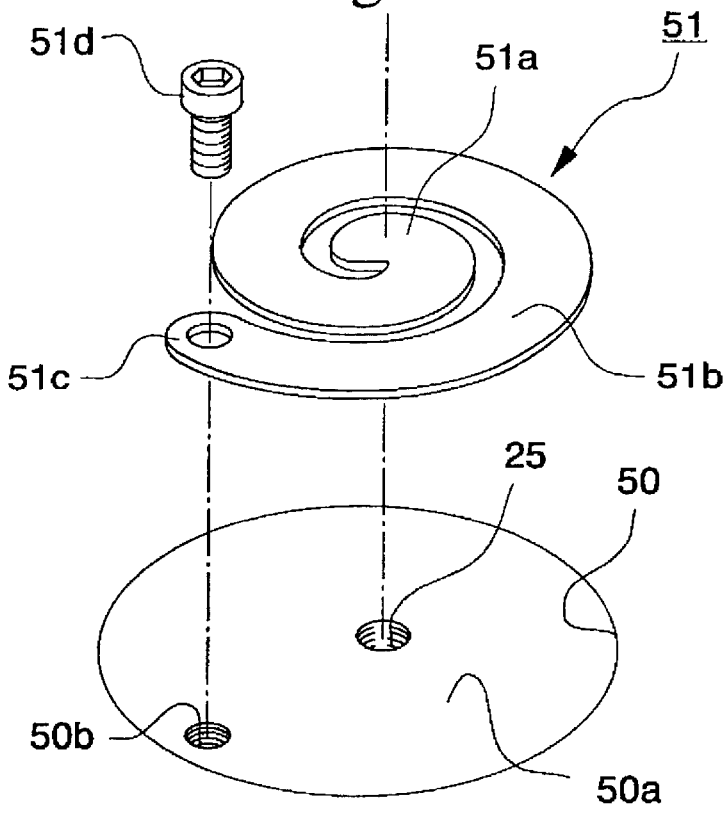
FIG. 20 is a perspective view showing a spiral reed valve being a discharge valve used in the scroll compressor.
Figure 21:
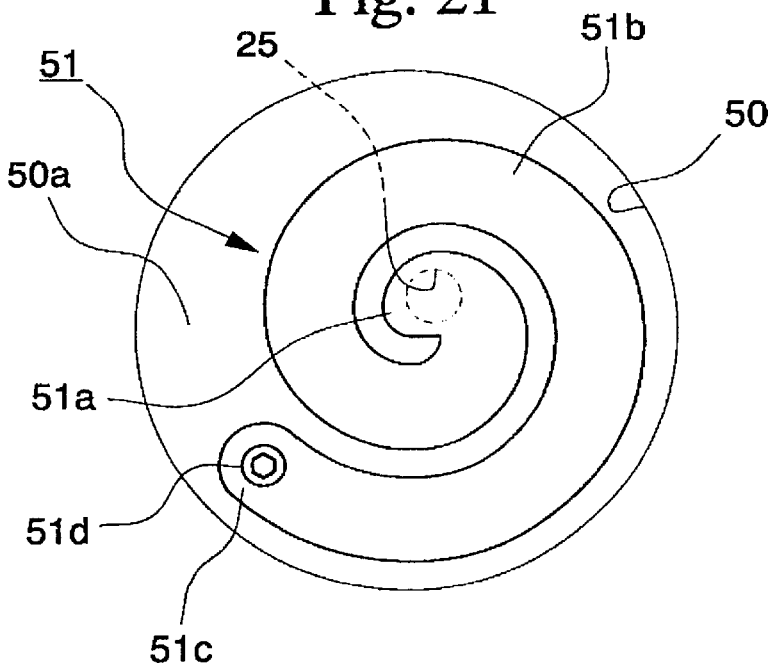
FIG. 21 is a plan view showing a positional relationship between the spiral reed valve and a discharge port in a concavity of the fixed scroll of the scroll compressor.

FIG. 18 is a cross-sectional view showing an overall construction of a scroll compressor of this embodiment. Furthermore, FIG. 19 is a perspective view of the fixed scroll as used in this scroll compressor, viewed from the side on which the wall is provided. Moreover, FIG. 20 is a perspective view showing a spiral reed valve being a discharge valve used in this scroll compressor. Furthermore, FIG. 21 is a plan view showing a positional relationship between the spiral reed valve and an opening of a discharge port, in a concavity on a rear face of the fixed scroll of the scroll compressor.

The scroll compressor of this embodiment is one where the concavity formed on the rear face of the fixed scroll and the discharge valve provided in the concavity have a special characteristic. At first, however a description is given of the overall construction of the scroll compressor, and after this the description will continue for details of the concavity and the discharge valve.

In FIG. 18, in a concavity 50 formed in the other side face center (rear face center) of the end plate 12*a* there is provided a discharge valve 51 which opens a discharge port 25 only when a pressure greater than a predetermined amount acts (details of the concavity 50 and the discharge valve 51 are given later).

Steps 42 and 43 are formed between positions up to $2\pi+\pi/4$ (rad) from the outer peripheral ends of the respective walls 12*b* and 13*b*, with the spiral centers of the wall 12*b* and the wall 13*b* as a reference.

Furthermore, a description of the concavity 50 and the discharge valve 51 which are the features of this embodiment is given hereunder.

As shown in FIG. 19, in the case where the side of the end plate 12*a* of the fixed scroll 12 which is formed with the wall 12*b* is the front face (the face towards the compression chamber C side) and the opposite side is the rear face (the face towards the discharge cavity 23 side), then viewing facing from the rear face side, the concavity 50 is formed so as to be positioned more to the central side than the deep bottom face 12*g* (low position) formed on the front face side.

To explain in more detail, since the step 42 (stepped portion) is formed at a position up to $2\pi\pm\pi/4$ (rad) at a pitch angle from the outer peripheral end towards the central portion along the spiral of the wall 12*b* thereof, then in the case where the end plate 12*a* is viewed facing from the rear face side, the concavity 50 is constructed so as to be positioned on the inside with the periphery surrounded by the annular shape bottom face 12*g* which goes around once from the outer peripheral end up to the step 42.

Furthermore, the shape of the concavity 50 as shown in FIG. 19 constitutes a circle on a line of sight perpendicular to the end plate 12*a*. Moreover, in the thickness direction, as shown in FIG. 18, this is formed so as to be sunken with a constant depth h below the rear face of the end plate 12*b*, thus giving a concave space of an approximate disc shape.

By deepening the depth h of the concavity 50, the thickness t of the portion surrounding the discharge port 25 of the wall 12*b* is thinned. Consequently, the volume V inside the discharge port 25 can be made small without narrowing the flow path area. However, in the design of the depth h of this concavity 50, taking into consideration the fluid pressure applied to the end plate 12*b*, and then of course the design must be such that a thickness t which retains sufficient strength can be maintained.

Furthermore, a description will now be give of the discharge valve 51 housed inside the concavity 50. As shown in FIG. 20 and FIG. 21, the discharge valve 51 of this embodiment is a spiral reed valve having a blocking portion 51*a* for covering and closing the opening of the discharge port 25, a resilient portion 51*b* formed in a spiral shape from the blocking portion 51*a*, and a securing portion 51*c* and bolt 51*d* for securing the outer peripheral end of the resilient portion 51*b* to a bottom face 50*a* of the concavity 50.

The blocking portion 51*a* has a comparatively large surface area as compared to the opening area of the discharge port 25, so that when in contact with the bottom face 50*a*, this can sufficiently cover and close the opening of the discharge port 25.

The resilient portion 51*b* is a spiral shape plate spring connected to the blocking portion 51*a* and formed so as to spiral around the periphery thereof. In the case where a fluid pressure is applied to the blocking portion 51*a* in the plate thickness direction, this can urge the blocking portion 51*a* which is separated from the bottom face 50*a*, so as to again contact with the bottom face 50*a*.

The securing portion 51*c* is a portion at the end of the spiral of the resilient portion 51*b*, and is formed with a through hole for taking the bolt 51*d*. Similarly, the bottom face 50*a* of the concavity 50 is formed with an internal thread 50*b* for threading with the bolt 50*d*. In a condition with the securing portion 51*c* secured to the bottom face 50*a* by the bolt 51*d*, the blocking portion 51*a* is attached in a condition covering the opening of the discharge port 25 and closely contacted with the bottom face 50*a*.

The respective plate thicknesses for the blocking portion 51*a*, the resilient portion 51*b*, and the securing portion 51*c* may all be the same, or other designs may be adopted where for example only the resilient portion 51*b* is made thinner or thicker than the others to adjust the spring strength, or where the plate thickness is different for each part.

Furthermore, in order to prevent excessive deformation of the resilient portion 51*b*, a construction may be adopted as required, with a stopper (not shown in the figure) provided above the blocking portion 51*a* for obstructing raising of the blocking portion 51*a* above a certain height.

According to the scroll compressor of this embodiment having the above described construction, when the rotating shaft 16 is rotated about the axis thereof by a motor (not shown in the figure), the eccentric portion 16*b* moves the orbiting scroll 13 orbitally while rotation with respect to the fixed scroll 12 is prevented. As a result, low pressure fluid drawn in from the suction port 24 is gradually reduced in volume-inside the respective compression chambers C and moves slowly under high pressure, from the outer peripheral end side towards the central portion side, and finally passes through the discharge port 25 and is discharged to the discharge cavity 23.

The fluid at this time pushes the blocking portion 51*a* of the discharge valve 51 (spiral reed valve) against the urging force of the resilient portion 51*b* and the pressure inside the discharge cavity 23, so that an opening is produced in the discharge port 25, and the fluid flows out via this to inside the discharge cavity 23. As a result, the interior of the discharge cavity 23 is raised in pressure by the inflow of high pressure fluid, and the blocking portion 51*a* is again forced so as to tightly close against the bottom face 50*a*.

With the closing of the opening of the discharge port 25 in this way, a little fluid remains inside the discharge port 25. However, since the volume V inside the discharge port 25 is minimized due to the shape of the concavity 50, practically all of the fluid is smoothly discharged to the discharge cavity 23. Hence compared to the conventional scroll compressor, the pressure of the fluid to be compressed next less likely to be raised.

Furthermore, by forming the concavity 50, the thickness t of the part of the end plate 12*a* of the fixed scroll 12 where the discharge port 25 is positioned can be made thin. Consequently, the volume V inside the discharge port 25 can be narrowed. Therefore, the volume of fluid remaining here can be reduced. Consequently, fluid which reverse flows from inside the discharge port 25 towards the compression chamber C can be reduced as much as possible, and hence the pressure of the fluid which is to be compressed next is no longer raised, and the power for rotating the orbiting scroll 13 is minimized. Hence there is no impairment due to fluid remaining inside the discharge port 25, thus enabling operating efficiency to be improved.

Furthermore, since the concavity 50 is constructed positioned on the inside of the annular shape bottom face 12*g* which goes around once from the outer peripheral end along the spiral of the wall 12*b* up to the step 42 at a pitch angle of $2\pi\pm\pi/4$ (rad) towards the center portion, this gives a comparatively narrow space. However, since a spiral reed valve being a comparatively small valve is adopted as the discharge valve 51, this can be easily installed even in this narrow concavity 50.

However, if the discharge valve 51 of the rectangular shape plate form in the conventional technology is to be provided in this narrow concavity 50, since this discharge valve 51 must have a certain length in order to ensure resilience, this cannot be accommodated inside the concavity 50.

On the other hand, in the present embodiment, since a spiral reed valve having a compact resilient portion 51*b* of a spiral shape is adopted, this can be accommodated without difficulty inside the concavity 50 with the resilience ensured.

Furthermore, in this embodiment, since the construction is such that the resilient portion 51*b* presses the blocking portion 51*a* against the opening of the discharge port 25, this is not subjected to the action of gravity. Hence, even if the scroll compressor itself is positioned vertically or horizontally, the function of the discharge valve 51 is not lost, thus giving a scroll compressor for which the installation degree of freedom is high.

Next is a description of a fourth embodiment of a scroll compressor of the present invention with reference to FIG. 22 and FIG. 23A to FIG. 23C. In this embodiment the shape of the concavity 50 and the construction of the discharge valve 51 is particularly different to that in the third embodiment, and hence this point will be explained. For the rest which is the same as for the scroll compressor of the third embodiment, description is omitted.

Figure 22:
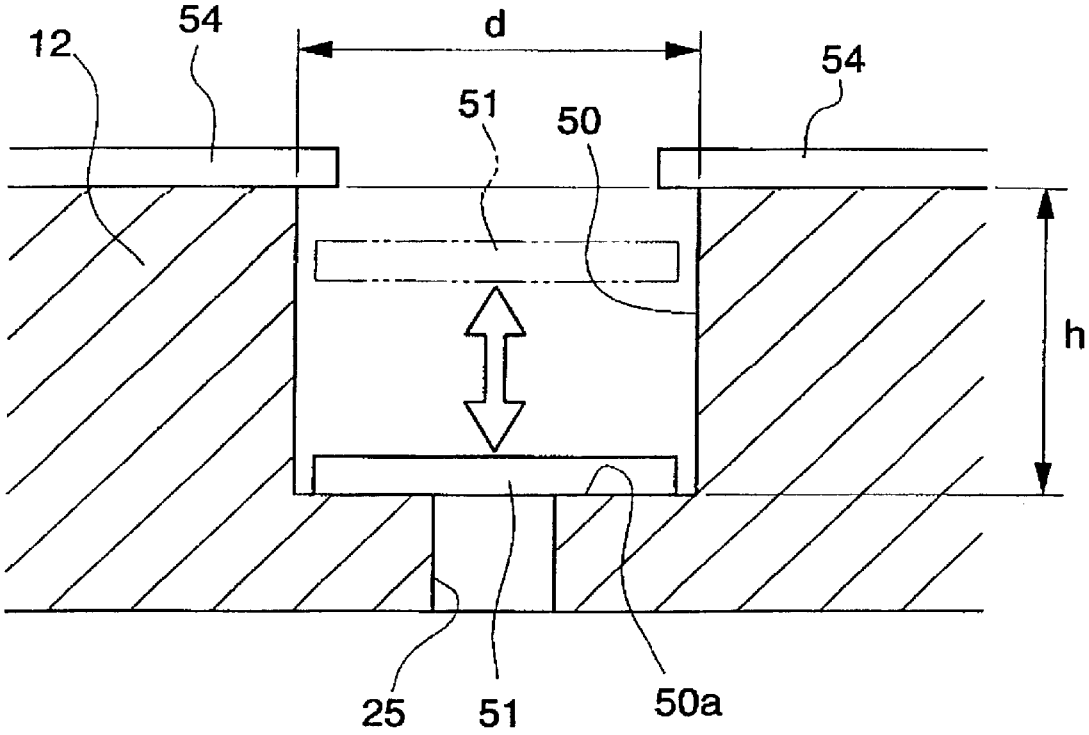
FIG. 22 is a view of a circular reed valve being another form for the discharge valve of the scroll compressor, as seen from a cross-section through which the axis of the discharge port of the fixed scroll passes.
Figure 23A:
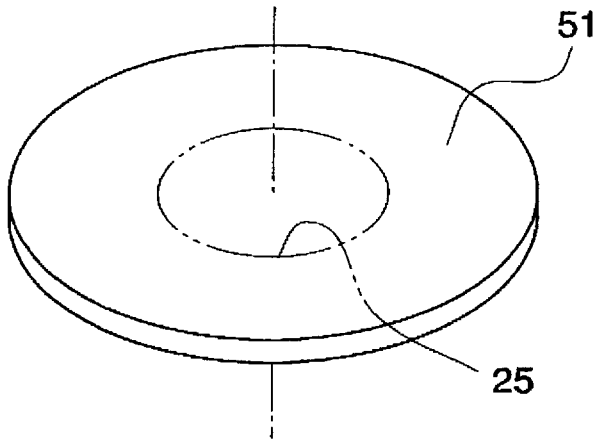
FIG. 23A is a perspective view of the same circular reed valve of the scroll compressor.

FIG. 22 shows a circular free valve (free valve) as a discharge valve 51 of this embodiment, being a perspective view seen from a cross-section through which the axis of the discharge port 25 of the fixed scroll 12 passes. As shown in FIG. 23A, this discharge valve is a metal disk having a predetermined weight, finished with a surface area which is greater than the opening area of the discharge port 25.

Moreover, as shown in FIG. 22, the concavity 50 of this embodiment, compared to that of the third embodiment, has the same depth h, however a narrower shape can be adopted for the internal diameter d. This is because the space for performing bolt fastening is unnecessary. As shown in the same figure, the discharge valve 51 (circular free valve) is able to move up and down inside the concavity 50, and in the case where the circular bottom face is contacted with the bottom face 50*a* of the concavity 50, the opening of the discharge port 25 is closed off, while conversely, in the case where this is subjected to fluid pressure and floats up, the opening is opened. In order to move up and down in this way inside the concavity 50, and so that the fluid passes through a gap formed between the inner wall face of the concavity 50 and the outer peripheral rim of the discharge valve 51, predetermined dimensions according to design requirements are adopted for the gap.

Reference symbol 54 in the same figure denotes a stopper for preventing the discharge valve 51 from floating out to outside of the concavity 50.

According to the scroll compressor of this embodiment having the above described construction, when the rotating shaft 16 is rotated about the axis thereof by a motor (not shown in the figure), the eccentric portion 16*b* moves the orbiting scroll 13 orbitally while rotation with respect to the fixed scroll 12 is prevented. As a result, low pressure fluid drawn in from the suction port 24 is gradually reduced in volume inside the respective compression chambers C and moves slowly under high pressure, from the outer peripheral end side towards the central portion side, and finally passes through the discharge port 25 and is discharged to the discharge cavity 23.

The fluid at this time pushes the discharge valve 51 (circular free valve) against the weight thereof and the pressure inside the discharge cavity 23 so that this floats up. Hence, an opening is produced in the discharge port 25, and the fluid flows out via this to inside the discharge cavity 23. As a result, the interior of the discharge cavity 23 is raised in pressure by the inflow of high pressure fluid, and the discharge valve 51 is again pushed down so as to tightly close against the bottom face 50*a*.

With the closing of the opening of the discharge port 25 in this way, a little fluid remains inside the discharge port 25. However, since the volume V inside the discharge port 25 is minimized due to the shape of the concavity 50, practically all of the fluid is smoothly discharged to the discharge cavity 23. Hence compared to the conventional scroll compressor, the pressure of the fluid to be compressed next less likely to be raised.

Furthermore, by forming the concavity 50, as with the third embodiment, fluid which reverse flows from inside the discharge port 25 towards the compression chamber C can be reduced as much as possible, and hence the pressure of the fluid which is to be compressed next is no longer raised, and the power for rotating the orbiting scroll 13 is minimized. Hence there is no impairment due to fluid remaining inside the discharge port 25, thus enabling operating efficiency to be improved.

Furthermore, in this embodiment, a concavity 50 which is even narrower than-that for the third embodiment is adopted. However, since the circular free valve which is an even smaller valve is adopted as the discharge valve 51, this can be easily installed even in this narrow concavity 50.

Figure 23B:
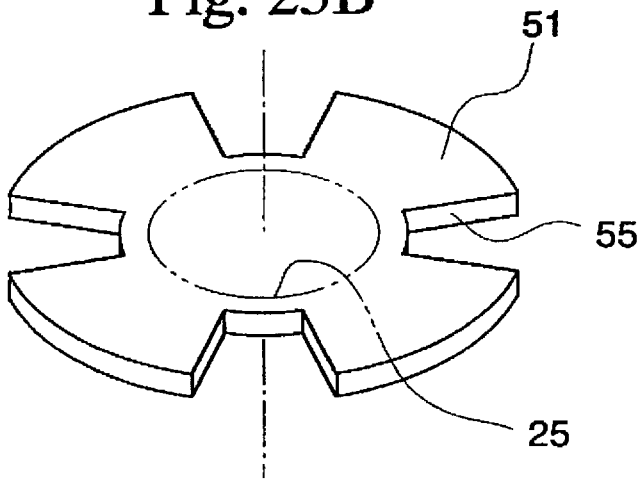
FIG. 23B is a perspective view showing a modified example of the circular reed valve of the scroll compressor.
Figure 23C:
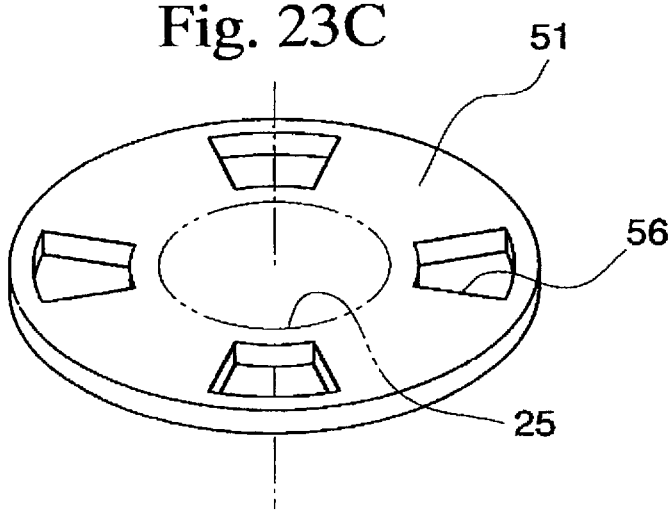
FIG. 23C is a perspective view showing another modified example of the circular reed valve of the scroll compressor.

Here the shape of the discharge valve 51 for the circular free valve is not limited to a simple disk shape, and for example as shown in FIG. 23B and FIG. 23C, a construction may be adopted where, with the exception of the main central portion for the opening of the discharge port 25, a plurality of ventilation areas 55 and 56 placed at equiangular spacing are formed around the periphery centered on the central portion.

That is, for the discharge valve 51 (circular free valve) of FIG. 23B, the ventilation areas 55 are formed by notching out four locations on the outer periphery of the disk including the peripheral rim. Furthermore, for the discharge valve 51 (circular free valve) of FIG. 23C, the ventilation areas 56 are formed by notching out four locations on the outer periphery of the disk but leaving the peripheral rim.

According to the discharge valve 51 (circular free valve) of these modified examples, when the discharge port 25 is closed off, the opening of the discharge port 25 is sufficiently sealed, while when the fluid discharges from the discharge port 25, this can pass through the discharge valve 51 not only via the outer peripheral end, but also through the respective ventilation areas 55 and 56. Therefore, additional resistance to the fluid passing through the discharge valve 51*c* an be reduced. Hence release of the fluid from the discharge port 25 can be improved. Furthermore, since the respective ventilation areas 55 and 56 are arranged at equi-angular spacing around the periphery of the central portion, the disk shaped discharge valve 51 is unlikely to tilt inside the concavity 50, so that reliability can also be improved.

Figure 24:
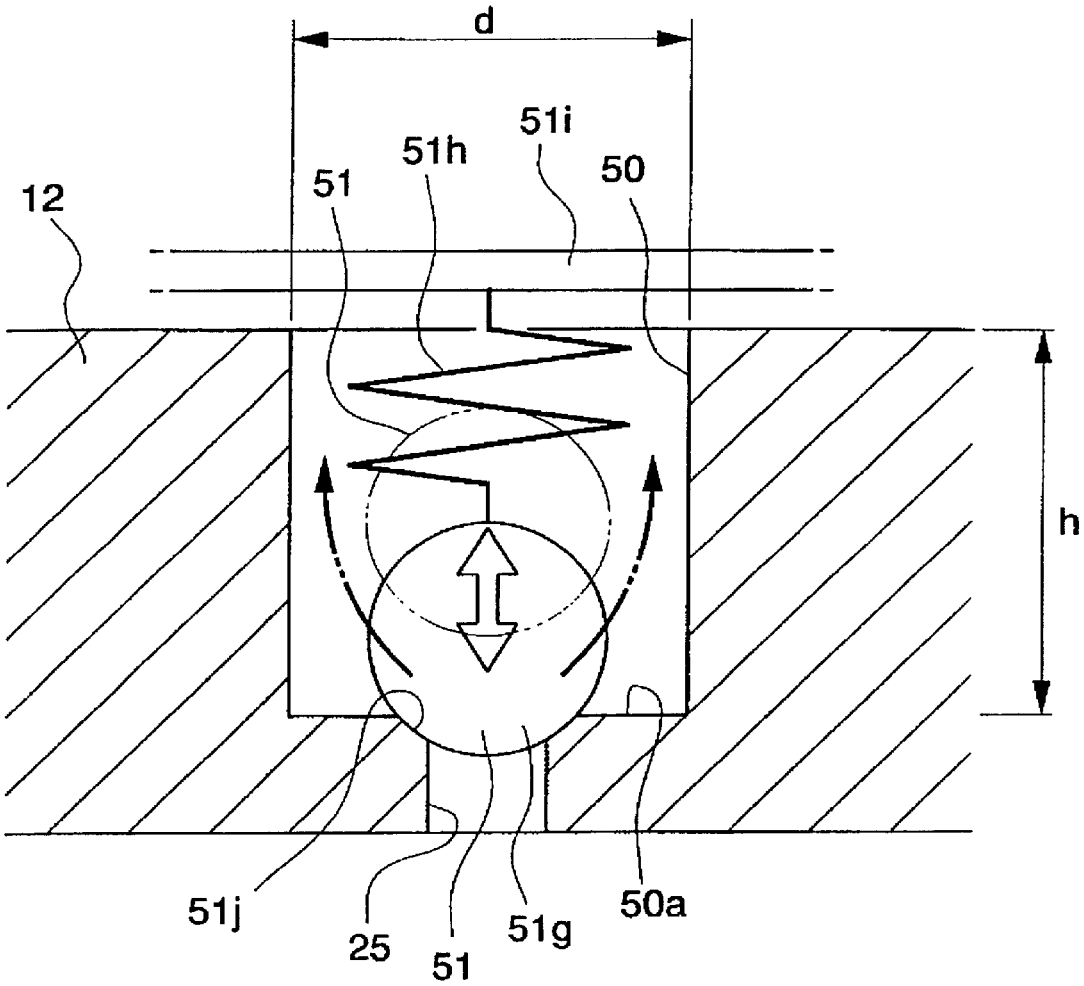
FIG. 24 is a view of a check valve being another form for the discharge valve of the scroll compressor, as seen from a cross-section through which the axis of the discharge port of the fixed scroll passes.

Next is a description of a fifth embodiment of a scroll compressor of the present invention with reference to FIG. 24. In this embodiment the shape of the concavity 50 and the construction of the discharge valve 51 is particularly different to that in the third embodiment, and hence this point will be explained. For the rest which is the same as for the scroll compressor of the third embodiment, description is omitted.

FIG. 24 shows a check valve as a discharge valve 51 of this embodiment, being a perspective view seen from a cross-section through which the axis of the discharge port 25 of the fixed scroll 12 passes. As shown in the same figure, this discharge valve 51 comprises a spherical valve body 51*g* for closing the opening of the discharge port 25, a spring 51*h* being a resilient member for urging the valve body 51*g* towards the opening, and a securing portion 51*i* for securing the spring 51*h* to a rear face side of the fixed scroll 12.

Moreover, as shown in the same figure, the concavity 50 of this embodiment, compared to that of the third embodiment, has the same depth h, however a narrower shape can be adopted for the internal diameter d. This is because the space for performing bolt fastening is unnecessary. Here reference symbol 51*j* denotes an annular shaped chamfer formed on the opening of the discharge port 25, enabling surface contact without causing damage to the surface of the valve body 51*g*.

As shown in the same figure, the valve body 51*g* of the discharge valve 51 (check valve) is able to move up and down inside the concavity 50, and in the case where this is surface contacted with chamfer formed 51*j*, the opening of the discharge port 25 is closed off, while conversely, in the case where this is subjected to fluid pressure and floats up, the opening is opened. In order to move up and down in this way inside the concavity 50, and so that the fluid passes through a gap formed between the inner wall face of the concavity 50 and the surface of the valve body 51*g*, predetermined dimensions according to design requirements are adopted for the gap.

The aforementioned securing portion 51*i* also operates as a stopper for stopping the valve body 51*g* from floating out to outside of the concavity 50.

According to the scroll compressor of this embodiment having the above described construction, when the rotating shaft 16 is rotated about the axis thereof by a motor (not shown in the figure), the eccentric portion 16*b* moves the orbiting scroll 13 orbitally while rotation with respect to the fixed scroll 12 is prevented. As a result, low pressure fluid drawn in from the suction port 24 is gradually reduced in volume inside the respective compression chambers C and moves slowly under high pressure, from the outer peripheral end side towards the central portion side, and finally passes through the discharge port 25 and is discharged to the discharge cavity 23.

The fluid at this time pushes the valve body 51*g* of the discharge valve 51 (check valve) against the combined force of the valve body weight, and the urging force of the spring 51*h*, and the pressure inside the discharge cavity 23 so that this floats up. Hence, an opening is produced in the discharge port 25, and the fluid flows out via this to inside the discharge cavity 23. As a result, the interior of the discharge cavity 23 is raised in pressure by the inflow of high pressure fluid, and the valve body 51*g* is again pushed down so as to tightly close against the chamfer 51*j*.

With the closing of the opening of the discharge port 25 in this way, a little fluid remains inside the discharge port 25. However, since the volume V inside the discharge port 25 is minimized due to the shape of the concavity 50, practically all of the fluid is smoothly discharged to the discharge cavity 23. Hence compared to the conventional scroll compressor, the pressure of the fluid to be compressed next is less likely to be raised.

Furthermore, by forming the concavity 50, as with the third embodiment, fluid which reverse flows from inside the discharge port 25 towards the compression chamber C can be reduced as much as possible, and hence the pressure of the fluid which is to be compressed next is no longer raised, and the power for rotating the orbiting scroll 13 is minimized. Hence there is no impairment due to fluid remaining inside the discharge port 25, thus enabling operating efficiency to be improved.

Furthermore, in the scroll compressor of this embodiment, a concavity 50 which is even narrower than that for the third embodiment is adopted. However, since the check valve having the even smaller valve body 51*g* is adopted as the discharge valve 51, this can be easily installed even in this narrow concavity 50.

Furthermore, in this embodiment, since the construction is such that the spring 51*h* pushes the valve body 51*g* against the opening of the discharge port 25, this is not subjected to the action of gravity. Hence, even if the scroll compressor itself is positioned vertically or horizontally, the function of the discharge valve 51 is not lost, thus giving a scroll compressor for which the installation degree of freedom is high.

Here in the abovementioned third through fifth embodiments, description is given for the case where for the discharge valve 51, a spiral spring valve, a circular free valve, or a check valve is adopted. However, the discharge valve is not limited to these, and provided this can be arranged in the comparatively narrow concavity 50, and then other types of valves may be adopted.

Furthermore, in the above described third through fifth embodiments, the concavity 50 is arranged on the inside with the periphery enveloped by an annular shape bottom face 12*g* formed between a position at a pitch angle from an outer peripheral end towards the central portion, up until $2\pi\pm\pi/4$ (rad). However, the range of the bottom face 12*g* is not limited to $2\pi\pm\pi/4$ (rad), and may be suitably modified.

Moreover, in the above-described third through fifth embodiments, the shape of the concavity 50 is a disk shape. However, the shape is not limited to this, and other shapes such as an inverted truncated cone or the like may be adopted as required.

A sixth embodiment of a scroll compressor according to the present invention will now be described referring to FIG. 25 through FIG. 27. Description is omitted for points similar to those in the first through fifth embodiments.

Figure 25:
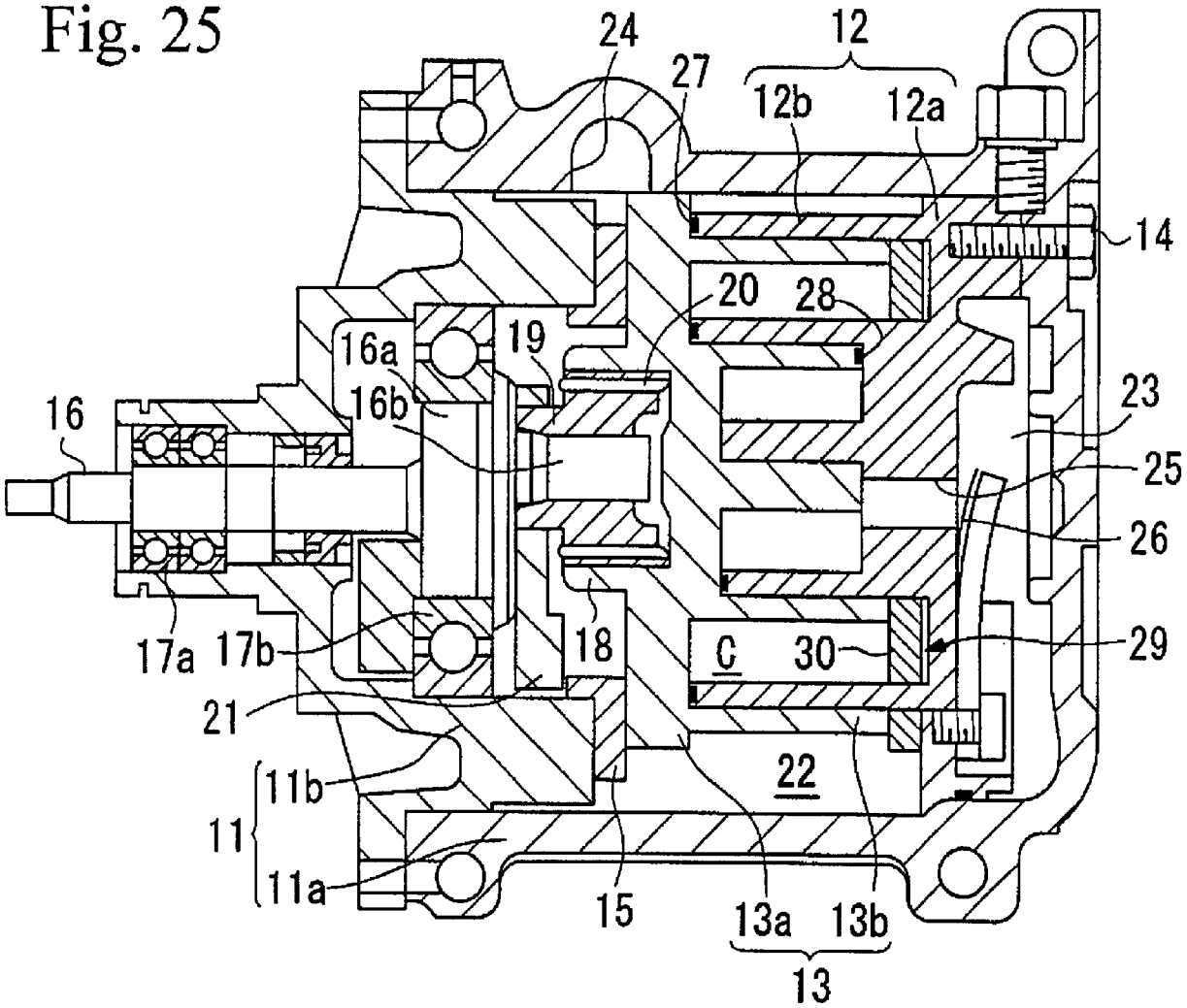
FIG. 25 is a cross-sectional view illustrating an overall construction of a scroll compressor shown as a fourth embodiment of the present invention.

FIG. 25 is a cross-sectional view showing an overall construction of a scroll compressor according to the present invention.

A discharge valve 26 which opens a discharge port 25 only when a pressure greater than a predetermined amount acts, is provided on the other side face center of an end plate 12*a*.

Figure 26:
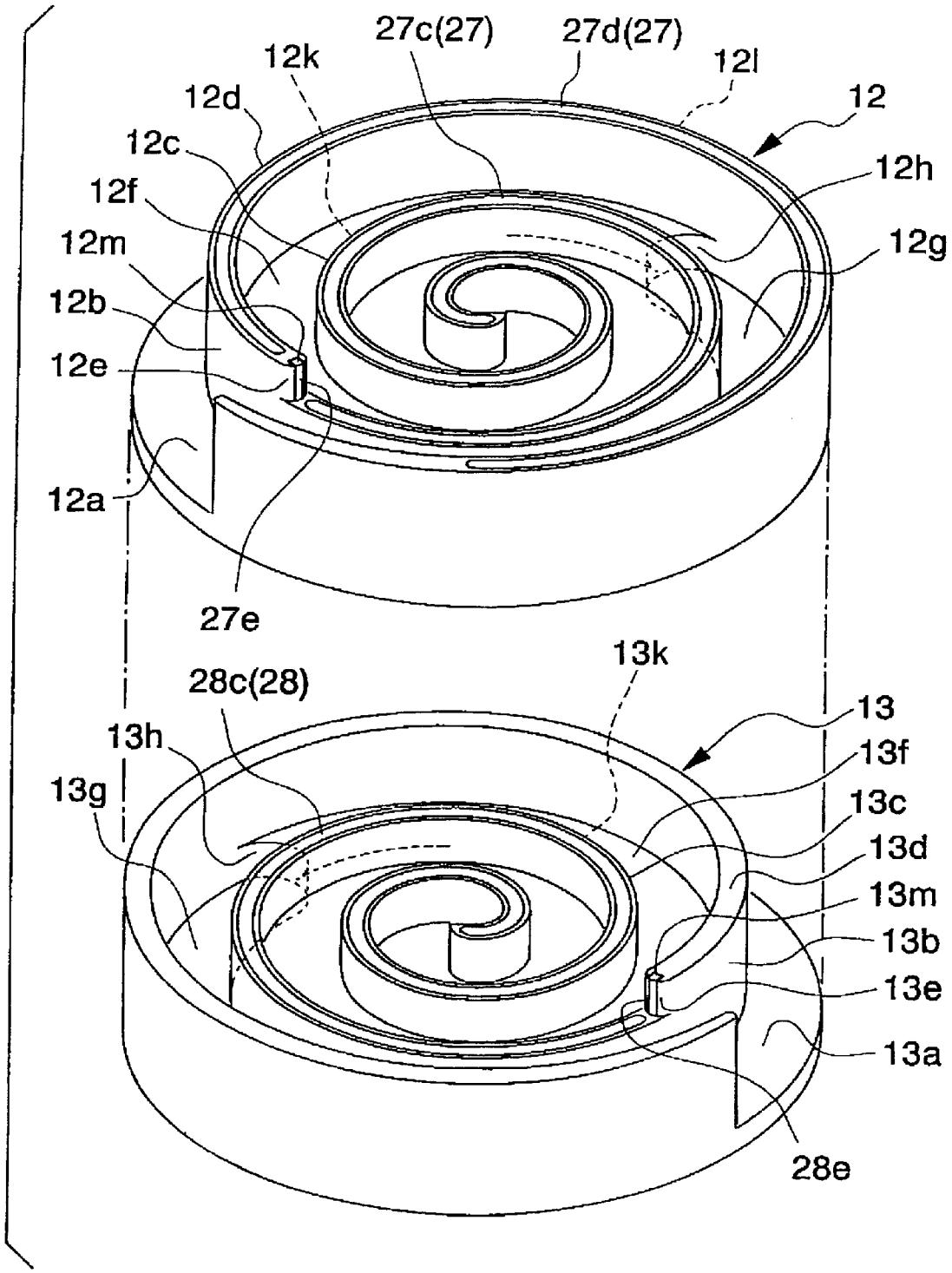
FIG. 26 is perspective views of a fixed scroll and an orbiting scroll used in the scroll compressor.
Figure 27:
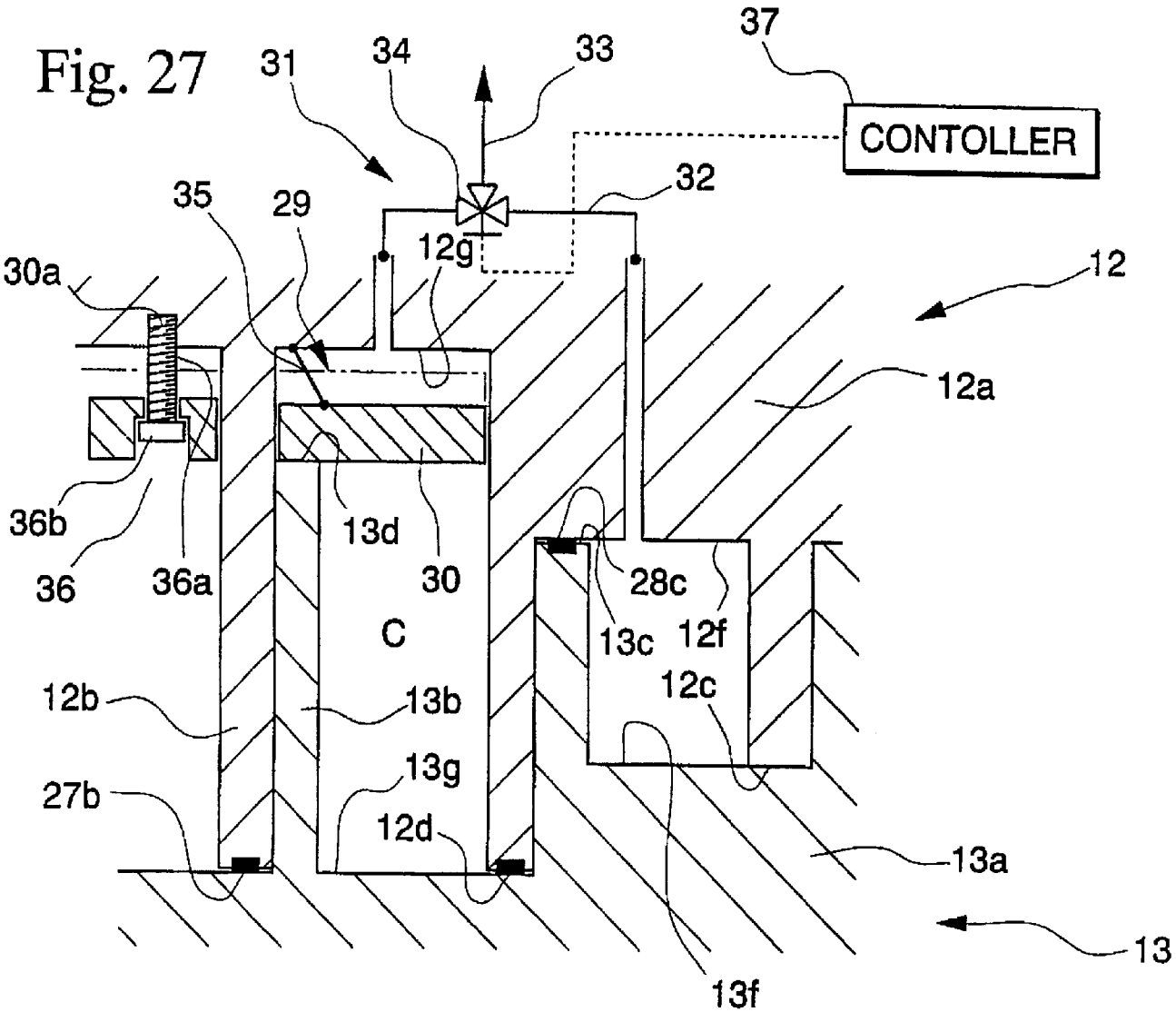
FIG. 27 is a side cross-sectional view showing a fixed scroll and plate, and a pressing device.

FIG. 26 is respective perspective views of a fixed scroll 12 and an orbiting scroll 13.

Furthermore, the end plate 12*a* for the fixed scroll 12 side is a stepped shape having two parts corresponding to respective parts on an upper rim of a wall 13*b*, with the height of one side face high at the center of the spiral and low at the outer peripheral end. An end plate 13*a* for the orbiting scroll 13 side also is a stepped shape as with the end plate 12*a*, having two parts with the height of one side face high at the center of the spiral and low at the outer peripheral end.

Moreover, tip seals 27*c* and 27*d* are respectively disposed on upper rims 12*c* and 12*d* of the wall 12*b*, and a tip seal (sealing member) 27*e* is disposed on a connecting rim 12*e*. A tip seal 28*c* is disposed on an upper rim 13*c* of the wall 13*b*, and a tip seal (sealing member) 28*e* is disposed on a connecting rim 13*e*.

The tip seals 27*c* and 27*d* constitute a spiral shape, and are provided in grooves 12*k* and 12*l* formed along the spiral direction in the upper rim 12*c*. At the time of operation of the compressor, these are subjected to a back pressure due to high pressure fluid introduced into the grooves 12*k* and 12*l*, and are pressed against the bottom faces 13*f* and 13*g* to exhibit a function as a seal.

The tip seal 28*c* also is formed in a spiral shape, and is provided in a groove 13*k* formed along the spiral direction in the upper rim 13*c*. At the time of operation of the compressor, this is subjected to a back pressure due to high pressure fluid introduced into the groove 13*k*, and is pressed against the bottom face 12*f* to exhibit a function as a seal.

The tip seal 27*e* is formed in a rod shape, and is seated in a groove 12*m* formed along the connecting rim 12*e*, and a structure is adopted for preventing removal from the groove 12*m*. At the time of operation of the compressor, as described later, this is pressed against the connecting wall face 13*h* by an urging device (not shown in the figure) so as to exhibit a function as a seal. The tip seal 28*e* also as with the tip seal 27*e*, is seated in a groove 13*m* formed along the connecting rim 13*e*, and a structure is adopted for preventing removal from the groove 13*m*. At the time of operation of the compressor, this is pressed against the connecting wall face 12*h* by an urging device (not shown in the figure) so as to exhibit a function as a seal.

When the orbiting scroll 13 is assembled to the fixed scroll 12, the low upper rim 12*c* abuts against the shallow bottom face 13*f*, and the high upper rim 12*d* abuts against the deep bottom face 13*g*. At the same time, the low upper rim 13*c* abuts against the shallow bottom face 12*f*, but the high upper rim 13*d* does not abut against the deep bottom face 12*g*. This is because the bottom face 12*g* is formed so as to deepen more than the height from the end plate 13*a* to the upper rim 13*d*. As a result a space 29 is provided between the bottom face 12*g* and the upper rim 13*d*, and a plate 30 is disposed in this space 29 along the bottom face 12*g* (refer to FIG. 25).

The plate 30 is formed with a uniform thickness and with sufficient rigidity, and has a shape when viewed from the orbit axis direction, which approximately coincides with that of the bottom face 12*g*. The plate 30 is embedded between the spiral walls 12*b* and can move freely in the orbit axis direction (however the movable range is limited to between the bottom face 12*g* and the wall 13*b*, by the assembly of the orbiting scroll 13).

In the scroll compressor with the assembled fixed scroll 12 and orbiting scroll 13, there is provided a pressing device 31 for pressing the plate 30 against the upper rim 13*d* of the wall 13*b*. The pressing device 31, as shown in FIG. 27 comprises an introduction path 32 for introducing fluid inside the compression chamber which is developed on the central side in the spiral direction with the bottom face 12*f* as one wall face, to the rear face side of the plate 30 in the space 29. A part of the introduction path 32 is formed by boring into the end plate 12*a* of the fixed scroll 12.

A discharge pipe 33 for discharging fluid inside the path to the outside, is connected to the introduction path 32, and at the connection portion of the introduction path 32 and the discharge pipe 33, there is provided a three-way valve (shut-off valve) 34 for opening and closing the introduction path 32 as required, and discharging fluid on the space 29 side to outside when the introduction path 32 is closed. The three-way valve 34 is controlled by a controller 37 for controlling the operating conditions of the compressor. This is operated such that when volume control is not performed, the introduction path 32 is opened and the discharge pipe 33 is closed, while when volume control is performed, the introduction path 32 is closed and the discharge pipe 33 is opened.

Between the plate 30 and the bottom face 12*g* there is provided a spring (urging device) 35 for urging the plate 30 in a direction towards the bottom face 12*g*. For the spring 35, a material with excellent corrosion resistance is used. The spring 35, in the case where volume control is not carried out, is bent and extended by the force of the fluid introduced to the space 29, permitting the plate 30 to be pushed against the upper rim 13*d* of the wall 13*b*. However, in the case where volume control is performed, the plate 30 is drawn towards the bottom face 12*g*, so that a space is actively formed between the upper rim 13*d* and the plate 30.

A stopper 36 is provided for the plate 30 to restrict the movement range in the orbit axis direction. The stopper 36 has an enlarged portion 36*b* provided on a base end of a bolt 36*a*, and the bolt 36*a* is passed through a through hole formed in the thickness direction of the plate 30. Furthermore, the bolt 36*a* is threaded into to a screw hole 30*a* formed in the end plate 12*a* of the fixed scroll 12. A step shape is adopted for the through hole 30*a* of the plate 30 so that the overhang part of the enlarged portion 36*b* is accommodated therein, and the plate 30 abuts against the upper rim 13*d* of the wall 13*b*.

In the case of performing volume control, the plate 30 is pressed against the upper rim 13*d* of the wall 13*b* due to the operation of the pressing device 31 to thereby function as a seal. Therefore, a compression chamber C compartmentalized by the facing end plates 12*a* and 13*a* and the walls 12*b* and 13*b* is developed between the two scrolls (refer to FIG. 5 to FIG. 8).

In the case of performing volume control, the plate 30 is drawn towards the bottom face 12*g* by the operation of the spring 35 so that the function as a seal is lost. Therefore, from the outer peripheral end of the walls 12*b* and 13*b* up to the connecting wall faces 12*h* and 13*h*, a compression chamber C furnished with gas tightness is not developed, but at the point in time where this passes the connecting wall faces 12*h* and 13*h*, then for the first time gas tightness is provided and the compression chamber C is developed.

In the scroll compressor constructed as described above, the process of fluid compression in the case where volume control is not carried out is the same as for in FIG. 5 to FIG. 8 and FIG. 9A to FIG. 9D in the first embodiment, and description is omitted.

In the above described scroll compressor, in the case where volume control is performed, the plate 30 does not actually function as a seal. Therefore a pressure chamber furnished with gas tightness further on the outer peripheral end side than the connecting wall faces 12*h* and 13*h* is not developed, and the preceding compression chamber CO at this point in time, at first has gas tightness and is developed.

Consequently, the volume change of the compression chamber from after compression being performed until discharge is small, so that the discharge volume is reduced. Furthermore, since it is considered that power for compressing the fluid up is not applied until the compression chambers C pass the connecting wall faces 12*h* and 13*h*, then in the case where volume control is performed, the power for driving the compressor can be reduced. Hence the power loss which was heretofore wastefully consumed disappears, and operating efficiency can thus be increased.

Furthermore, in the case where volume control is not performed, by introducing the pressure inside the compression chamber C which develops on the central side of the connecting wall faces 12*h* and 13*h* and becomes a high pressure, via the introduction path 32 into the space 29, the plate 30 is pressed against the urging force of the spring 35 and the pressure inside the low pressure compression chamber C which is again developed on the outer peripheral end side from the connecting wall faces 12*h* and 13*h*, so that the gas tightness of the compression chamber C is maintained. Therefore, compression efficiency can be increased and performance of the compressor thus improved. Furthermore, the plate can be pressed without providing another drive source.

Moreover, by providing the spring 35 to draw the plate 30 towards the bottom face 12*g*, then in the case where pressing of the plate 30 by the pressing device 31 in order to perform volume control is cancelled, a space is produced between the plate 30 and the facing wall 13*b* so that leakage of fluid at the outer peripheral end side is positively produced and an increase in excessive pressure is thus prevented. Therefore, wasteful power consumption no longer occurs, and operating efficiency can be increased.

In addition, by providing the stopper 36 to restrict the movement range of the plate 30, pressing of the plate 30 too far to the wall 13*b* is prevented, and deformation of the plate 30 or the occurrence of heat due to excessive friction with the wall 13*b* is minimized. Therefore, stabilized operation of the compressor is possible.

In this embodiment, the plate 30 is disposed on the fixed scroll 12 side, however the construction may be such that the plate 30 is disposed on the orbiting scroll 13 side. Moreover, in this embodiment, the stopper 36 is provided for restricting the movement range of the plate 30. However, since the movement range of the plate 30 is restricted by the bottom face 12*g* and the upper rim 13*d* of the wall 13*b*, the stopper need not necessarily be provided.

In this embodiment, the connecting rims 12*e* and 13*e* are formed perpendicular to the orbit plane of the orbiting scroll 13, and the connecting wall faces 12*h* and 13*h* corresponding to these are also formed perpendicular to the orbit plane. However, if the connecting rims 12*e* and 13*e*, and the connecting wall faces 12*h* and 13*h* maintain a corresponding relationship with each other, then it is not necessary for these to be perpendicular to the orbit plane, and for example, these may be formed at an incline to the orbit plane.

In this embodiment, a stepped shape having one step is adopted for both the fixed scroll 12 and the orbiting scroll 13. However, a scroll compressor according to the present invention is also feasible with a plurality of steps.

A seventh embodiment of a scroll compressor according to the present invention will now be described referring to FIG. 28 through FIG. 31. Description is omitted for points similar to those in the first through sixth embodiments.

Figure 28:
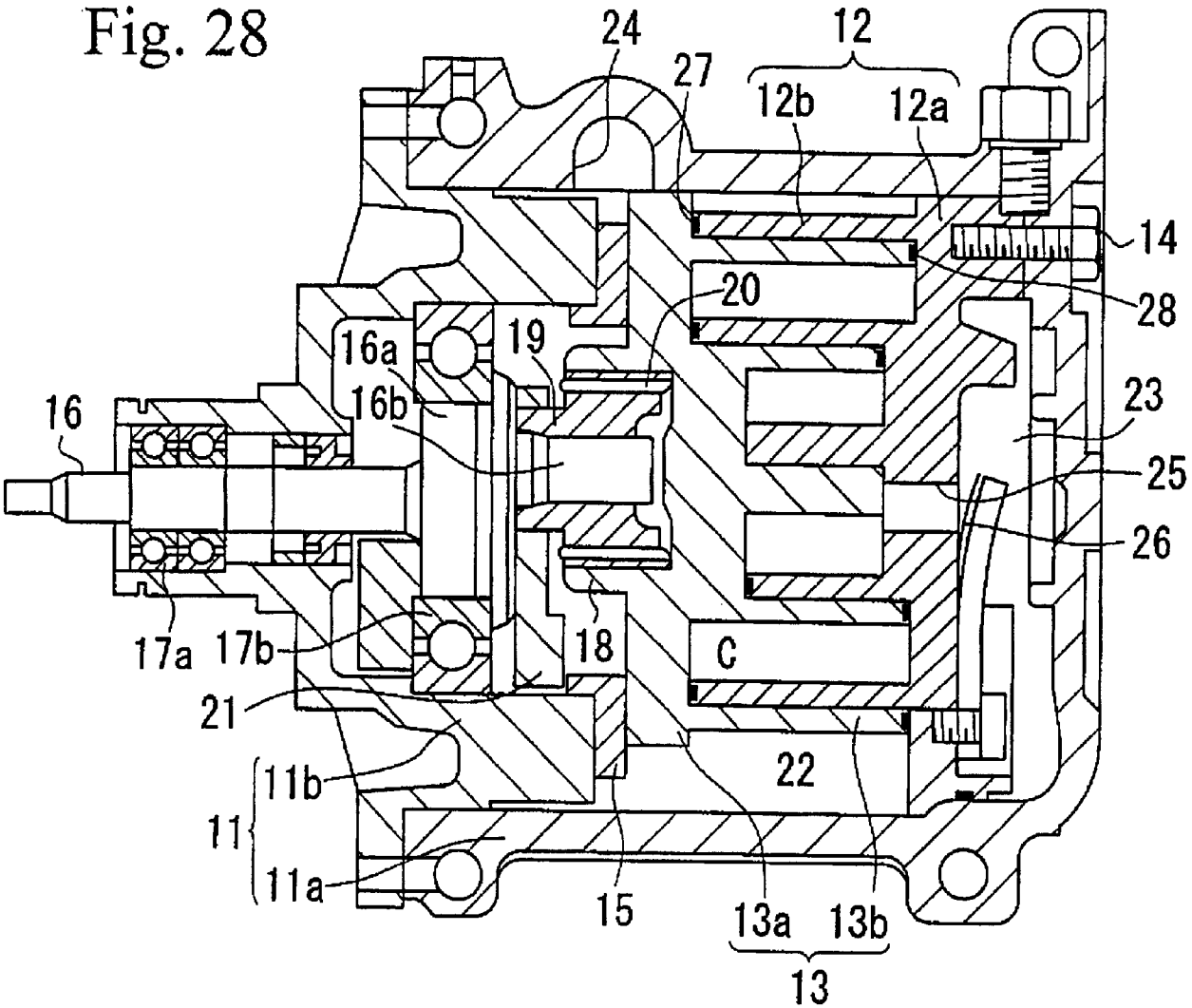
FIG. 28 is a cross-sectional view illustrating an overall construction of a scroll compressor shown as a fifth embodiment of the present invention.

FIG. 28 is a cross-sectional view showing an overall construction of a scroll compressor according to the present invention.

A discharge valve 26 which opens a discharge port 25 only when a pressure greater than a predetermined amount acts, is provided on the other side face center of the end plate 12*a*.

Figure 29:
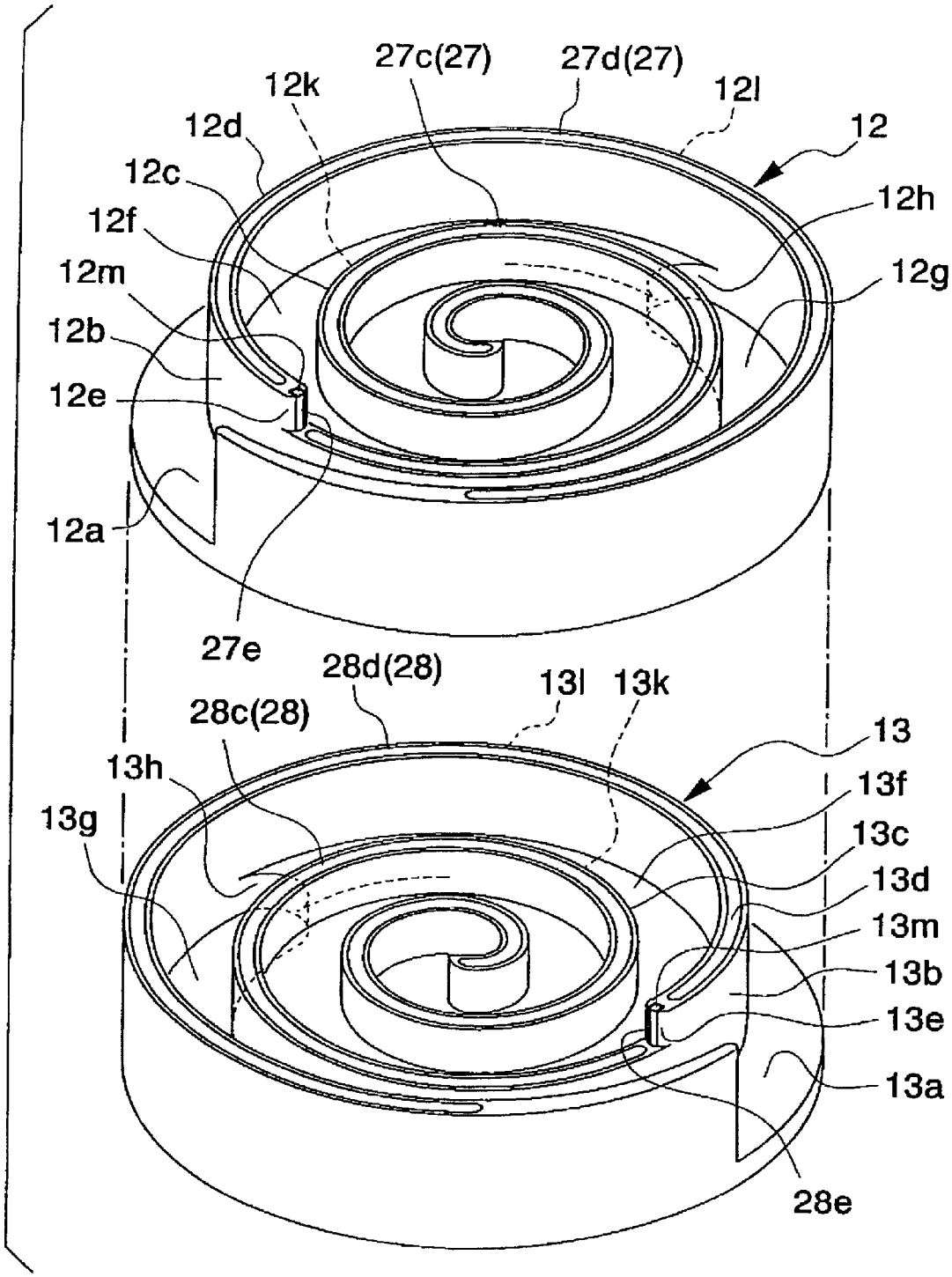
FIG. 29 is perspective views of a fixed scroll and an orbiting scroll used in the scroll compressor.

FIG. 29 is respective perspective views of a fixed scroll 12 and an orbiting scroll 13.

Figure 30:
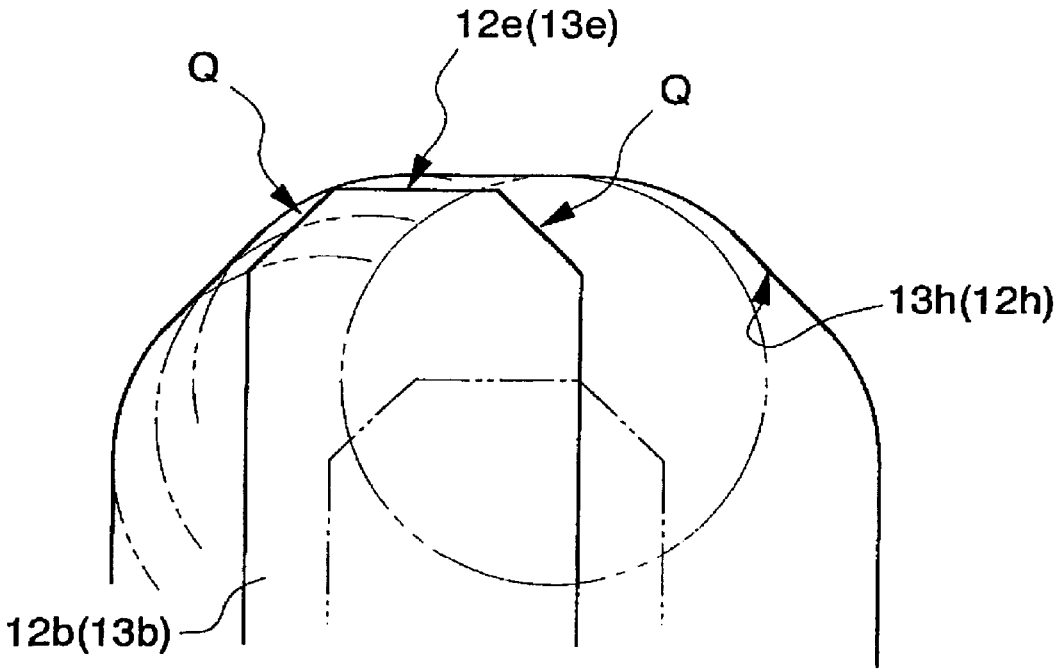
FIG. 30 is a plan view of a connecting rim and a connecting wall face as seen from an orbit axis direction.

A connecting rim 12*e*, as shown in FIG. 30, forms an upright plane on a wall 12*b* when the wall 12*b* is viewed from the orbiting scroll 13 direction. Furthermore, the angle between inside and outside faces of the wall 12*b* is chamfered to form corner faces Q.

Moreover, in FIG. 29, tip seals 27*c* and 27*d* are respectively disposed on upper rims 12*c* and 12*d* of the wall 12*b*, and a tip seal (seal member) 27*e* is disposed on the connecting rim 12*e*. Similar to this, tip seals 27*c* and 27*d* are respectively disposed on upper rims 13*c* and 13*d* of a wall 13, and a tip seal (seal member) 28*e* is disposed on a connecting rim 13*e*.

The tip seals 27*c* and 27*d* both constitute a spiral shape, and are seated in grooves 12*k* and 121 formed along the spiral direction in the upper rims 12*c* and 12*d*. At the time of operation of the compressor, these are subjected to a back pressure due to high pressure fluid introduced into the grooves 12*k* and 12*l*, and are pressed against the bottom faces 13*f* and 13*g* so as to exhibit a function as a seal.

The tip seals 28*c* and 28*d* also are formed in a spiral shape; and are seated in grooves 13*k* and 13*l* formed along the spiral direction in the upper rims 13*c* and 13*d*. At the time of operation of the compressor, these are subjected to a back pressure due to high pressure fluid introduced into the grooves 13*k* and 13*l*, and are pressed against the bottom faces 12*f* and 12*g* so as to exhibit a function as a seal.

The tip seal 27*e* is formed in a rod shape, and is seated in a groove 12*m* formed along the connecting rim 12*e*, and a structure is adopted for preventing removal from the groove 12*m*. At the time of operation of the compressor, as described later, this is pressed against the connecting wall face 13*h* by an urging device (not shown in the figure) so as to exhibit a function as a seal. The tip seal 28*e* also as with the tip seal 27*e*, is seated in a groove 13*m* formed along the connecting rim 13*e*, and a structure is adopted for preventing removal from the groove 13*m*. At the time of operation of the compressor, this is pressed against the connecting wall face 12*h* by an urging device (not shown in the figure) so as to exhibit a function as a seal.

Furthermore, between the connecting rim 12*e* and the connecting wall face 13*h* and the between the connecting rim 13*e* and the connecting wall face 12*h*, a small gap is provided in consideration of thermal expansion of the two scrolls at the time of driving.

In the abovementioned scroll compressor, by forming the connecting rims 12*e* and 13*e* in the shape shown in FIG. 30, then, in the case of machining, the processability is significantly improved. Since the connecting rims 12*e* and 13*e* are formed as three planes rather than the heretofore semicircle, then also in the case of machining using a lathe, these can be machined by repeating a simple plane machining process. Furthermore, since the corner faces Q are formed at the connecting rims 12*e* and 13*e*, the strength of the edges of the connecting rims 12*e* and 13*e* of the walls 12*b* and 13*b* can be maintained, and machining accuracy is improved.

Moreover, in the above described scroll compressor, by providing a small gap between the connecting rim 12*e* and the connecting wall face 13*h*, and between the connecting rim 13*e* and the connecting wall face 12*h* after assembly, then even if the fixed scroll 12 and the orbiting scroll 13 thermally expand, the contact pressure between the two scrolls does not become higher than necessary. As a result, a stabilized drive of the scroll compressor can be realized.

Figure 31A:
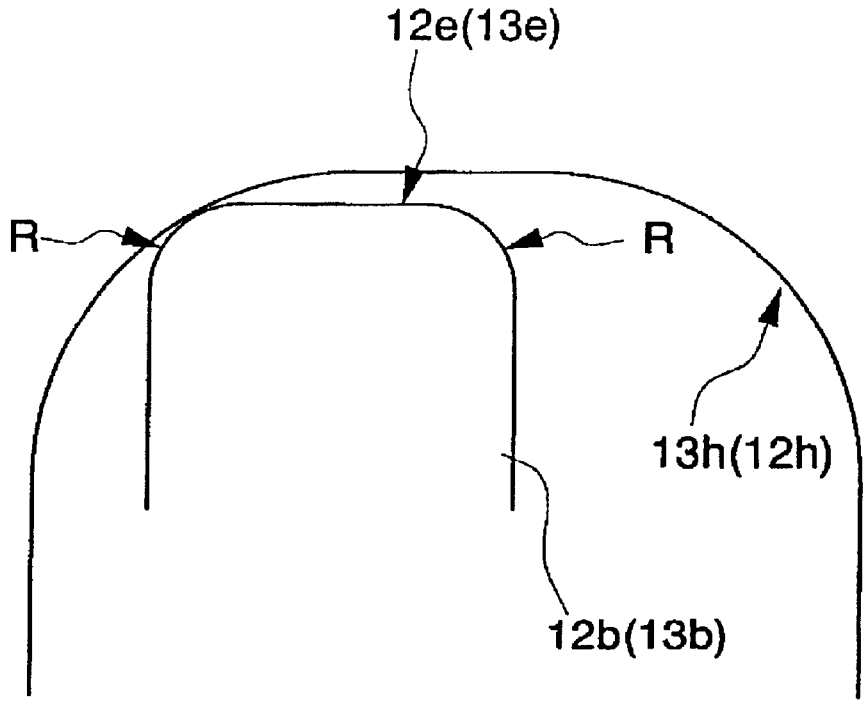
FIGS. 31A and 31B are plan views of other forms for the connecting rim and the connecting wall face as seen from the orbit axis direction.
Figure 31B:
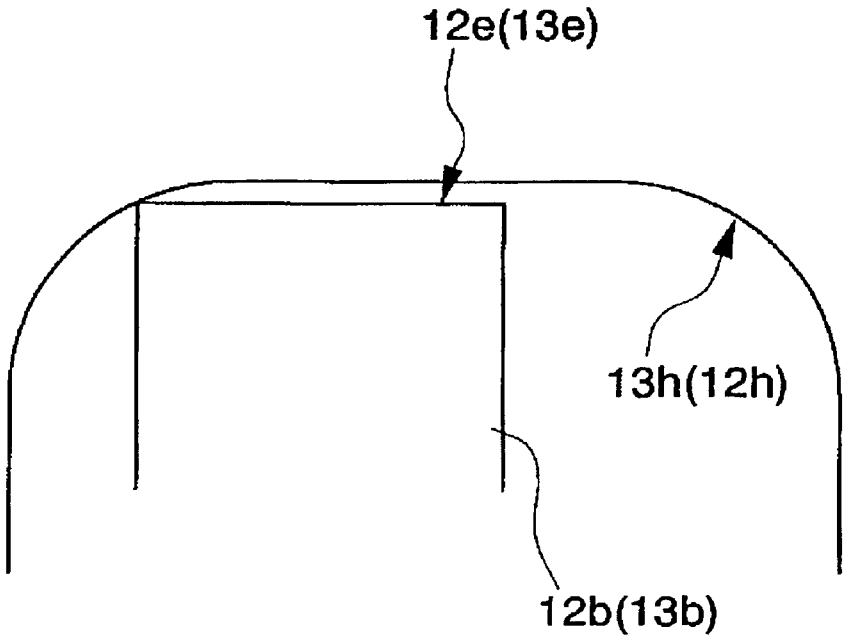

Incidentally, in this embodiment, the connecting rims 12*e* and 13*e* are formed as shown in FIG. 30, and in particular, in the corners between the walls, the corner faces Q are provided. However, for example instead of the corner faces, round faces R smoothly continuous with the two adjacent faces as shown in FIG. 31A may be adopted. Furthermore, instead of providing the corner faces, a square shape as shown in FIG. 31B may be adopted.

In the above described respective embodiments, the connecting rims 12*e* and 13*e* are formed perpendicular to the orbit plane of the orbiting scroll 13, and the connecting wall faces 12*h* and 13*h* corresponding to these are also formed perpendicular to the orbit plane. However, if the connecting rims 12*e* and 13*e*, and the connecting wall faces 12*h* and 13*h* maintain a corresponding relationship with each other, then it is not necessary for these to be perpendicular to the orbit plane, and for example, these may be formed at an incline to the orbit plane.

Moreover, in the above respective embodiments, a stepped shape having one step is adopted for both the fixed scroll 12 and the orbiting scroll 13. However, a scroll compressor according to the present invention is also feasible with a plurality of steps.

An eighth embodiment of a scroll compressor according to the present invention will now be described referring to FIG. 32 through FIG. 39A to FIG. 39G. Description is omitted for points similar to those in the first through seventh embodiments.

Figure 32:
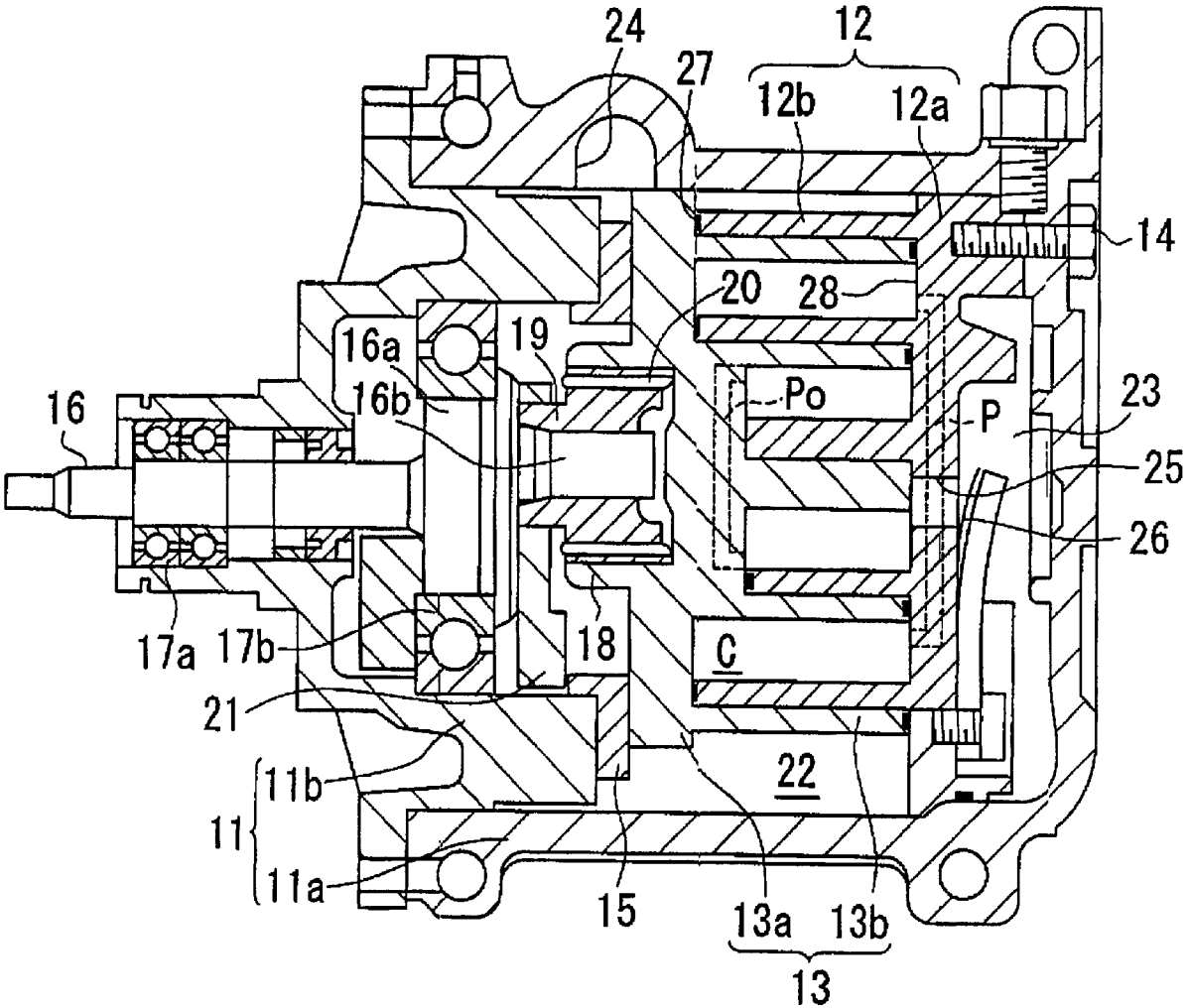
FIG. 32 is a cross-sectional view illustrating an overall construction of a scroll compressor shown as a sixth embodiment of the present invention.

FIG. 32 is a cross-sectional view showing an overall construction of a scroll compressor according to the present invention.

In the fixed scroll 12 there is proved a communication path P for communicating between the two facing compression chambers (while described in detail later, compression chambers $C_a$ and $C_b$ compartmentalized by the end plates 12*a* and 13*a* and walls 12*b* and 13*b*, and developed by contact of connecting rims 12*e* and connecting wall faces 13*h*) on either side of the center of the scroll compressor. Furthermore, in the orbiting scroll 13*a* there is provided a communication path $P_o$ for communicating between the two facing compression chambers ($C_{ao}$, $C_{bo}$ described in detail later) on either side if the center of the scroll compressor.

The communication path P is formed by piercing a plurality of holes in the fixed scroll 12 and covering the unnecessary places. One end of the communication path P is provided so as to follow along an outside face (rear) of the wall 12*b* contacted with the connecting rim 12*e*, and the other end is provided so as to follow along the inside face (front) of the facing wall 12*b*, on the other side of the center of the scroll compressor. The opposite ends of the communication path P are respectively opened at two places where the outside face and the inside face of the wall 12*b* simultaneously engage.

The communication path $P_o$ also, similarly to the above, is formed by piercing a plurality of holes in the orbiting scroll 13 and covering the unnecessary places. One end of the communication path $P_o$ is provided so as to follow along an outside face (rear) of the wall 13*b* contacted with the border of the connecting rim 13*h* and the wall 13*b*, and the other end is provided so as to follow along the inside face (front) of the facing wall 13*b*, on the other side of the center of the scroll compressor. The opposite ends of the communication path $P_o$ are respectively opened at two places where the outside face and the inside face of the wall 13*b* simultaneously engage.

Figure 33:
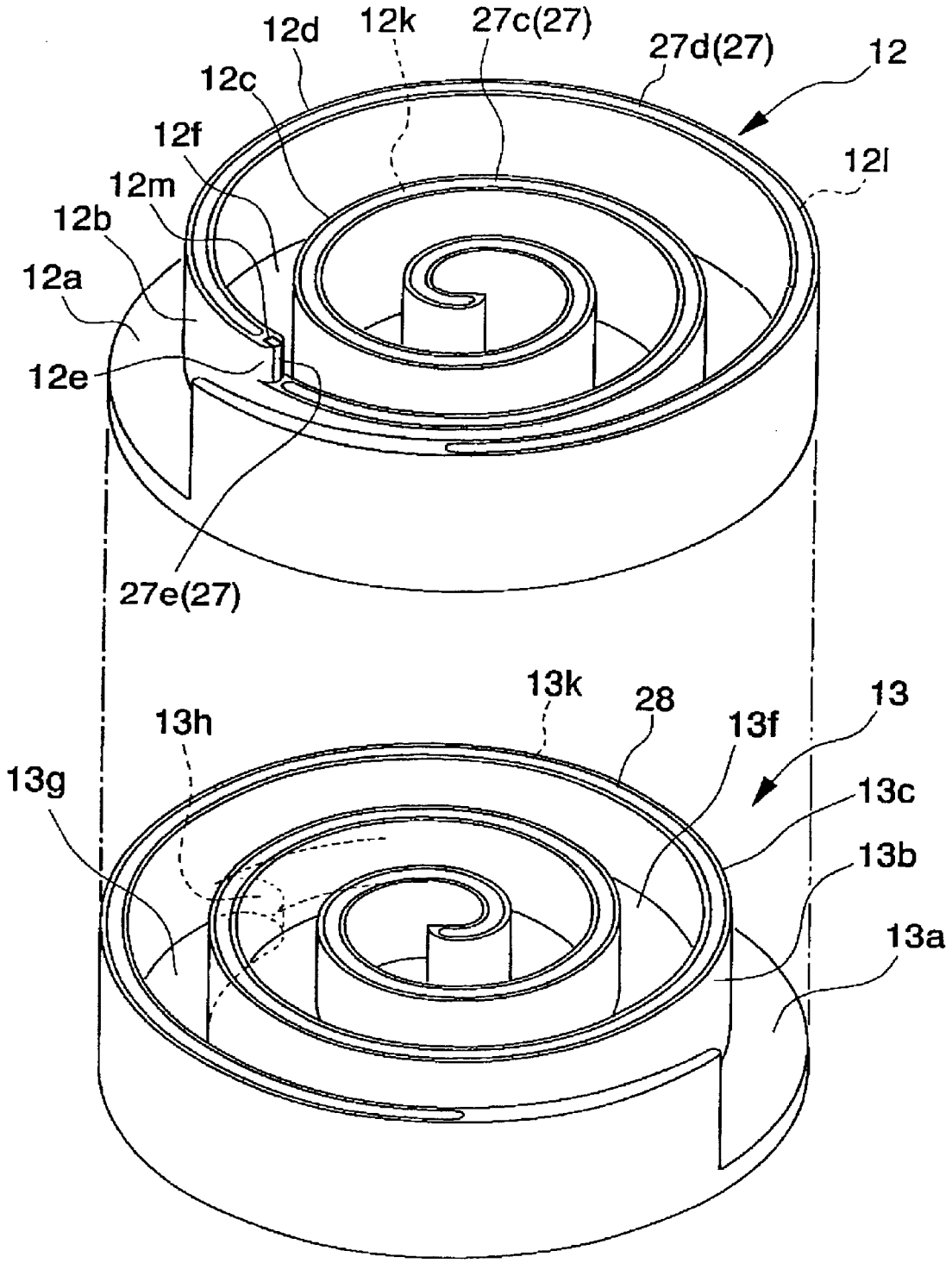
FIG. 33 is perspective views of a fixed scroll and an orbiting scroll used in the scroll compressor.

FIG. 33 is respective perspective views of the fixed scroll 12 and the orbiting scroll 13.

For the wall 12*b* on the fixed scroll 12 side, the spiral shaped upper rim thereof is divided into two parts, resulting in a stepped shape which is low at the central portion side of the spiral and high at the outer peripheral end side. The wall 13*b* on the orbiting scroll 13 side, is a spiral shape as with the wall 12*b* but this is not a stepped shape, the upper rim being formed flush.

Furthermore, the end plate 12*a* for the fixed scroll 12 side is formed with one side face flush corresponding to the upper rim of the wall 13*b*. The end plate 13*a* for the orbiting scroll 13 side is a stepped shape having two parts corresponding to the step shape of the wall 12*b*, with the height of one side face high at the center of the spiral direction and low at the outer peripheral end.

The upper rim of the wall 12*b* is divided into two parts, namely the low upper rim 12*c* provided towards the center and the high upper rim 12*d* provided towards the outer peripheral end, and between the adjacent upper rims 12*c* and 12*d*, there exists a vertical connecting rim 12*e* perpendicular to the orbit plane, which connects the two.

Furthermore, the bottom face of the end plate 13*a* is divided into two parts, namely the shallow bottom face 13*f* provided towards the center and the deep bottom face 13*g* provided towards the outer peripheral end, and between the adjacent bottom faces 13*f* and 13*g* there exists a vertical sheer connecting wall face 13*h* connecting the two.

The connecting rim 12*e*, when the wall 12*b* is viewed in the direction from the orbiting scroll 13, is smoothly continuous with the inner and outer two side faces of the wall 12*b*, and forms a semicircle having a diameter equal to the thickness of the wall 12*b*. Furthermore, the connecting wall face 13*h*, when the end plate 13*a* is viewed from the orbit axial direction, forms a circular arc coinciding with an envelope drawn by the connecting rim 12*e* along the orbit of the orbiting scroll 13.

Figure 34:
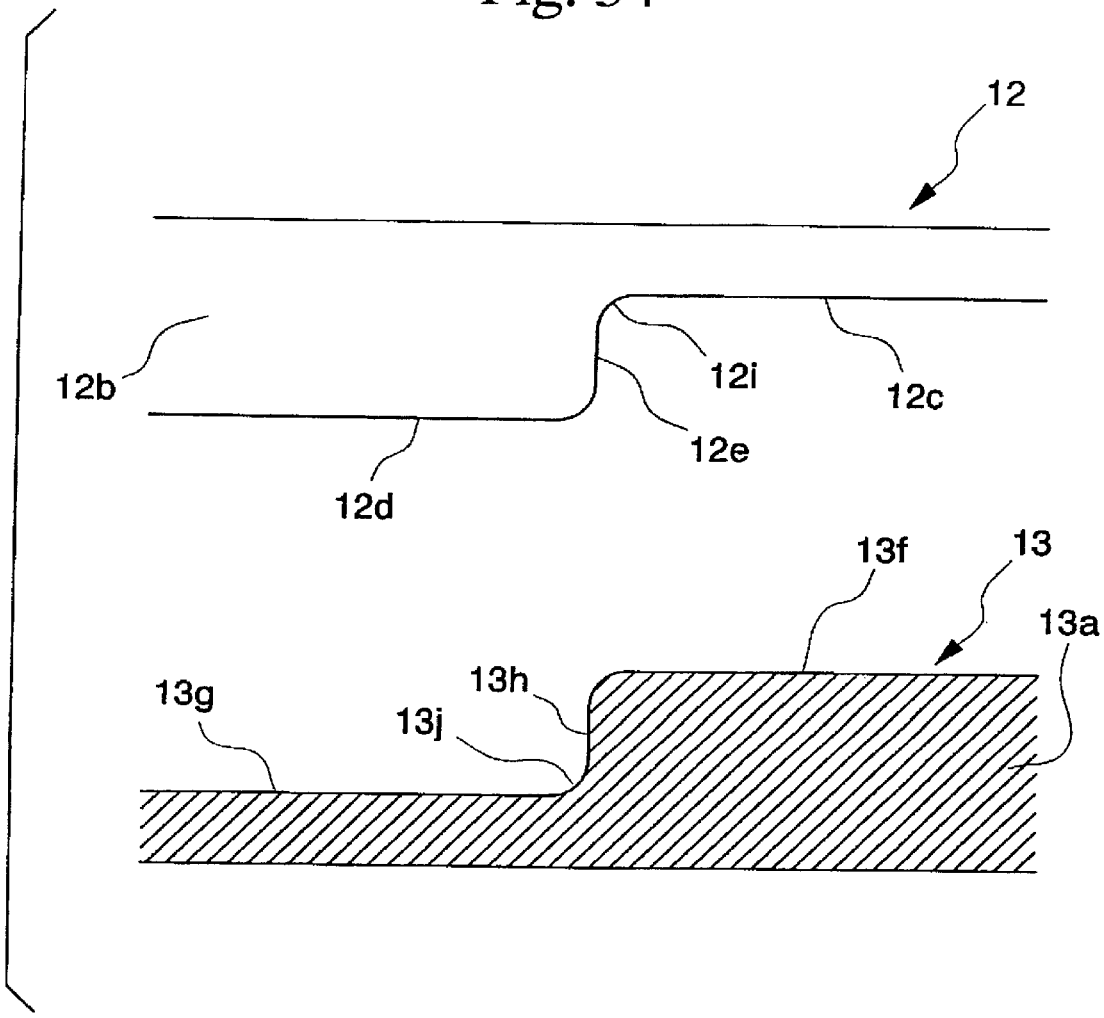
FIG. 34 is a side cross-sectional view showing a lip provided between an upper rim and a connecting rim, and a lip provided between a bottom face and a connecting wall face.

As shown in FIG. 34, on the wall 12*b* at the portion where the upper rim 12*c* and the connecting rim 12*e* approach each other, a rib 12*i* is provided. The rib 12*i* is for avoiding stress concentration, and constitutes a concave surface formed integral with the wall 12*b* and smoothly continuous with the upper rim 12*c* and the connecting rim 12*e*.

On the end plate 13*a* also, at the portion where the bottom face 13*g* and the connecting wall face 13*h* approach each other, a rib 13*j* is provided to give build up. The rib 13*j* is for avoiding stress concentration, and constitutes a concave surface formed integral with the wall 13*b* and smoothly continuous with the bottom face 13*g* and the connecting wall face 13*h*.

On the wall 12*b*, the portion where the upper rims 12*c* and 12*d* approach each other are respectively chamfered in order to avoid interference with the rib 13*j* at the time of assembly.

Furthermore, tip seals 27*c* and 27*d* are respectively disposed on the upper rims 12*c* and 12*d* of the wall 12*b*, and a tip seal 27*e* is disposed on the connecting rim 12*e*. Moreover, a tip seal 28 is disposed in the upper rim 13*c* of the wall 13.

The tip seals 27*c* and 27*d* constitute a spiral shape, and are provided in grooves 12*k* and 12*l* formed along the spiral direction in the upper rim 12*c*. At the time of operation of the compressor, these are subjected to a back pressure due to high pressure fluid introduced into the grooves 12*k* and 12*l*, and are pressed against the bottom faces 13*f* and 13*g* to exhibit a function as a seal.

The tip seal 28 also is formed in a spiral shape, and is provided in a groove 13*k* formed along the spiral direction in the upper rim 13*c*. At the time of operation of the compressor, this is subjected to a back pressure due to high pressure fluid introduced into the groove 13*k*, and is pressed against the bottom face 12*f* to exhibit a function as a seal.

The tip seal 27*e* is formed in a rod shape, and is seated in a groove 12*m* formed along the connecting rim 12*e*, and a structure is adopted for preventing removal from the groove 12*m*. At the time of operation of the compressor, as described later, this is pressed against the connecting wall face 13*h* by an urging device (not shown in the figure) so as to exhibit a function as a seal.

When the orbiting scroll 13 is assembled to the fixed scroll 12, the low upper rim 12*c* abuts against the shallow bottom face 13*f*, and the high upper rim 12*d* abuts against the deep bottom face 13*g*. At the same time, the upper rim, 13*c* abuts against the bottom face 12*f*. As a result, a compression chamber C compartmentalized by the facing end plates 12*a* and 13*a* and the walls 12*b* and 13*b* is formed between the two scrolls.

In the scroll compressor constructed as described above, the process of fluid compression at the time of driving is explained sequentially as shown in FIG. 35 through FIG. 38.

Figure 35:
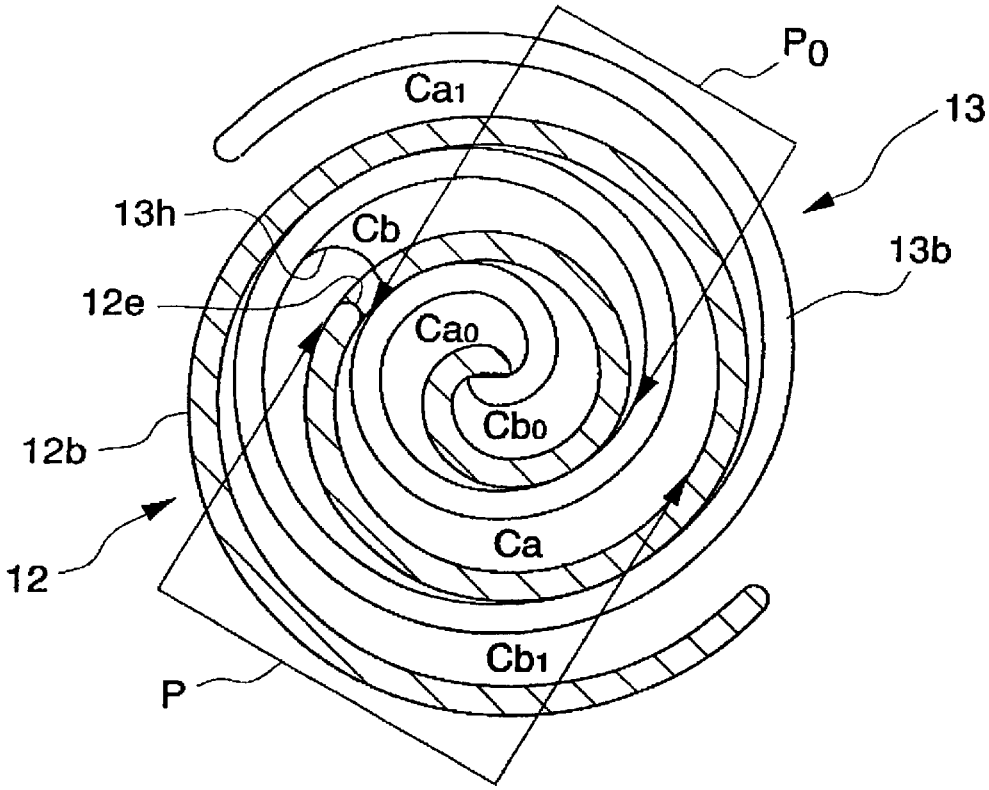
FIG. 35 is a view showing a process of fluid compression at the time of driving the scroll compressor.

In the condition shown in FIG. 35, two compression chambers $C_a$ and $C_b$ of maximum volume are developed at opposite positions on either side of the center of the scroll compression mechanism, by abutting the outer peripheral end of the wall 12*b* against the outside face of the wall 13*b*, and abutting the outer peripheral end of the wall 13*b* against the outside face of the wall 12*b*, and a fluid is introduced to between the end plates 12*a* and 13*a*, and the walls 12*b* and 13*b*. The connecting rim 12*e* and the connecting wall face 13*h*, at this point in time, commence sliding contact, and the compression chamber $C_b$ and the preceding compression chamber $C_{bo}$ respectively become separately sealed off.

Figure 36:
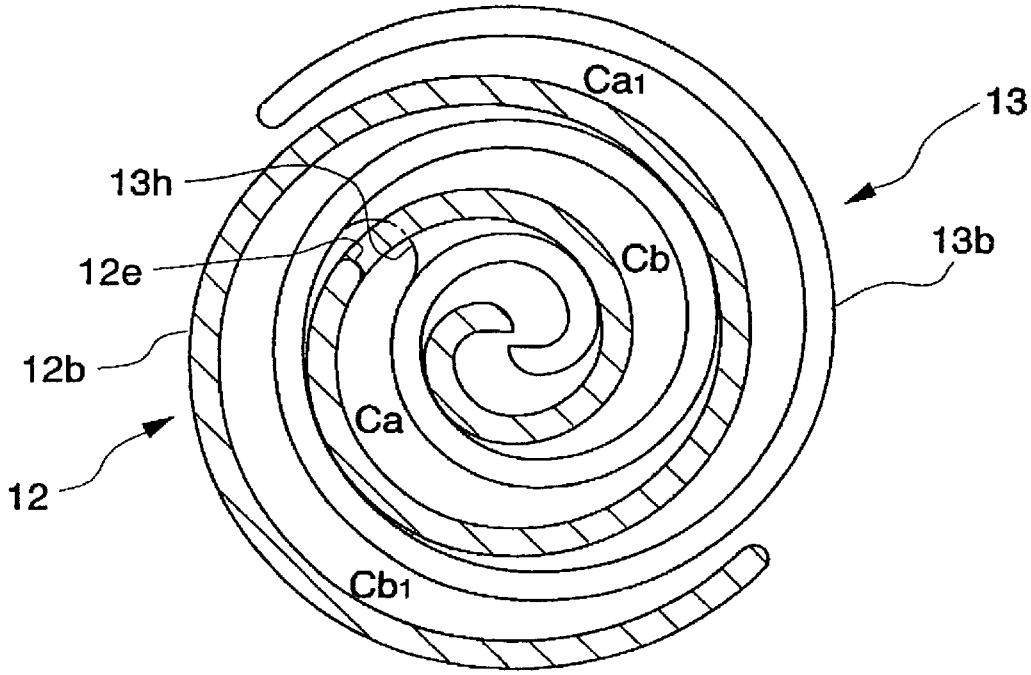
FIG. 36 is a view showing a process of fluid compression at the time of driving the scroll compressor.

In the process where the orbiting scroll 13 orbits by $\pi/2$ from the condition of FIG. 35 to reach the condition shown in FIG. 36, the compression chambers $C_a$ and $C_b$ respectively proceed towards the central portion while maintaining the sealed condition, and the volume is gradually reduced and the fluid compressed. The preceding compression chambers $C_{ao}$ and $C_{bo}$ also respectively proceed towards the center while maintaining the sealed condition and the volume is gradually reduced and the fluid is continuously compressed. In this process, the sliding contact of the connecting rim 12*e* and the connecting wall face 13*h* continues, and the compression chamber $C_b$ and the preceding compression chamber $C_{bo}$ respectively maintain the separately sealed off condition.

Figure 37:
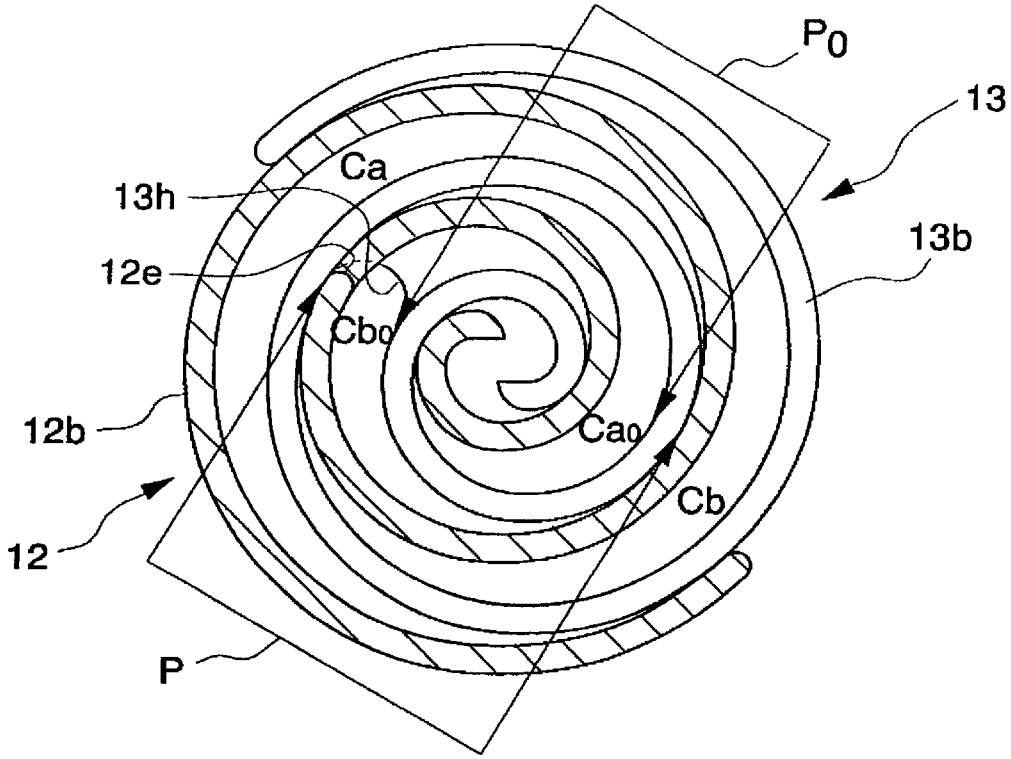
FIG. 37 is a view showing a process of fluid compression at the time of driving the scroll compressor.

In the process where the orbiting scroll 13 rotates by $\pi/2$ from the condition of FIG. 36 to reach the condition shown in FIG. 37, the compression chambers $C_a$ and $C_b$ respectively proceed towards the center while maintaining the sealed condition, and the volume is gradually reduced and the fluid further compressed. The preceding compression chambers $C_{ao}$ and $C_{bo}$ also respectively proceed towards the center while maintaining the sealed condition and the volume is gradually reduced and the fluid is continuously compressed. In this process, the sliding contact of the connecting rim 12*e* and the connecting wall face 13*h* continues, and the compression chamber $C_b$ and the preceding compression chamber $C_{bo}$ respectively maintain the separately sealed off condition.

In the condition shown in FIG. 37, between the inside face of the wall 13*b* close to the outer peripheral end and the outside face of the wall 12*b* positioned inwards thereof, there is developed a space $C_{a1}$ which subsequently becomes a compression chamber, and between the inside face of the wall 12*b* close to the outer peripheral end and the outside face of the wall 13*b* positioned inwards thereof, there is developed a space $C_{b1}$ which subsequently becomes a compression chamber, and a low pressure fluid flows from the suction chamber 22 to these spaces $C_{a1}$ and $C_{b1}$. The compression chambers $C_a$ and $C_b$ proceed towards the center while maintaining a sealed condition, and the volume is gradually reduced and the fluid further compressed. The preceding compression chambers $C_{ao}$ and $C_{bo}$ at this point in time become a minimum volume, and the fluid is increased in pressure to a predetermined pressure and discharged through the discharge port 25. Up to this point in time, the sliding contact between the connecting rim 12*e* and the connecting wall face 13*h* continues, and the compression chamber $C_b$ and the preceding compression chamber $C_{bo}$ maintain their separately sealed conditions. However, immediately after, this is cancelled.

Figure 38:
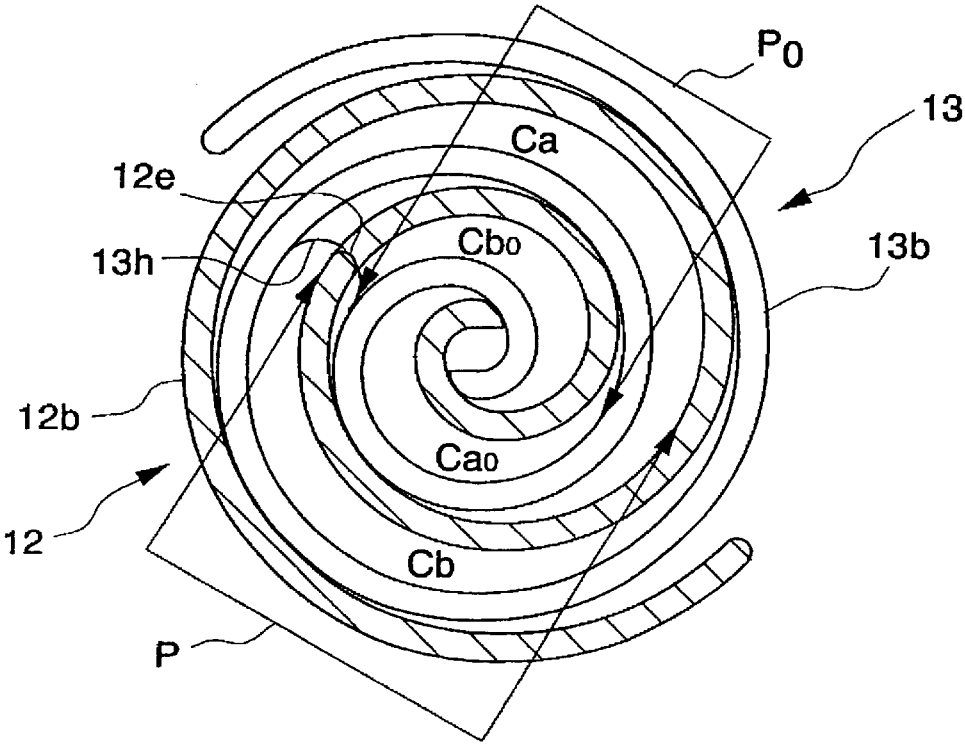
FIG. 38 is a view showing a process of fluid compression at the time of driving the scroll compressor.

In the process where the orbiting scroll 13 orbits by $\pi/2$ from the condition of FIG. 37 to reach the condition shown in FIG. 38, the spaces $C_{a1}$ and $C_{b1}$ proceed towards the center while their size expands, and the compression chambers $C_a$ and $C_b$ preceding the spaces $C_{a1}$ and $C_{b1}$ also proceed towards the center while their sealed condition is maintained, and the volume is gradually reduced to compress the fluid. In this process, the sliding contact between the connecting rim 12*e* and the connecting wall face 13*h* is cancelled so that the two facing compression chambers $C_a$ and $C_b$ on either side of the center are communicated with each other and become equal pressure.

In the process where the orbiting scroll 13 orbits further by $\pi/2$ from the condition of FIG. 38 to again reach the condition shown in FIG. 35, the spaces $C_{a1}$ and $C_{b1}$ proceed towards the center of the scroll compressor mechanism while the size is further increased, and the preceding compression chambers $C_a$ and $C_b$ respectively proceed towards the center while maintaining the sealed condition, so that the volume is gradually reduced to compress the fluid. In this process also, the sliding contact between the connecting rim 12*e* and the connecting wall face 13*h* is cancelled, so that the two facing compression chambers $C_a$ and $C_b$ on either side of the center are communicated with each other and become equal pressure.

The change of the size of the compression chambers from the maximum volume to the minimum volume (the volume when the discharge valve 26 is open) is shown by: Process A; (the compression chamber $C_a$ in FIG. 35→the compression chamber $C_a$ in FIG. 36→the compression chamber $C_a$ in FIG. 37→the compression chamber $C_a$ in FIG. 38→the compression chamber $C_{b1}$, in FIG. 35→the compression chamber $C_{bo}$ in FIG. 36 →the compression chamber $C_{bo}$ in FIG. 37) or Process B; (compression chamber $C_b$ in FIG. 35→the compression chamber $C_b$ in FIG. 36→the compression chamber $C_b$ in FIG. 37→the compression chamber $C_b$ in FIG. 38 →the compression chamber $C_{ao}$ in FIG. 35→the compression chamber $C_{ao}$ in FIG. 36→the compression chamber $C_{ao}$ in FIG. 37). Here the developed shapes of the compression chamber in the respective conditions are shown in FIG. 39A to FIG. 39G. In the above two processes, even though the timing is the same, there are times when the volumes of the compression chamber $C_a$ and $C_b$ are different. Hence in order to compare the shapes of the two, these figures are arranged in parallel.

Figures 39A, 39B, 39C, 39D, 39E, 39F, 39G:
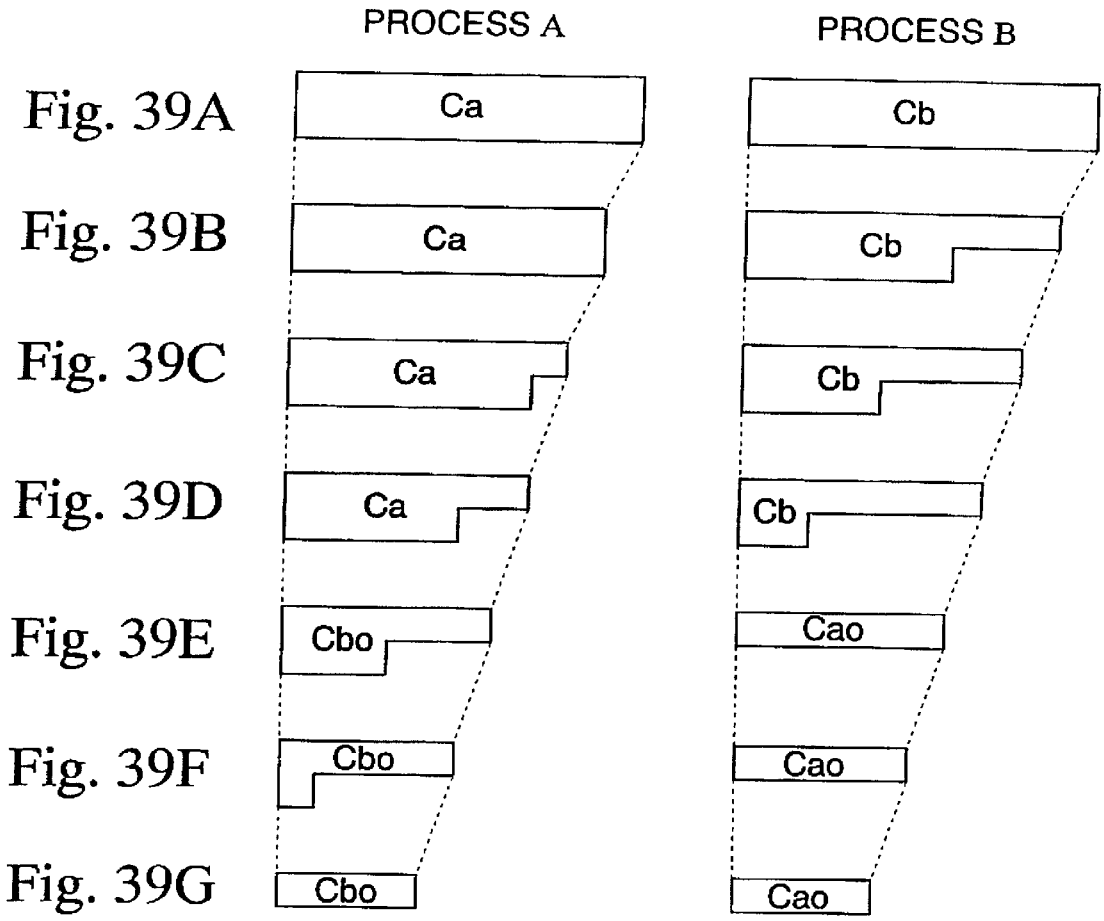
FIGS. 39A to 39G are diagrams showing a transition in shape of the compression chamber from maximum volume up to minimum volume, in the scroll compressor.

At the maximum volume timing of FIG. 39A, the compression chambers $C_a$ and $C_b$ are both thin strips (refer to FIG. 35) and the width in the orbit axis direction at the outer peripheral end side of the scroll compression mechanism becomes a lap length L1 approximately equal to the height of the wall 12*b* from the bottom face 12*f* to the upper rim 12*d* (or the height of the wall 13*b* from the bottom face 13*g* to the upper rim 13*c*), so that the volume of the compression chambers $C_a$ and $C_b$ is equal.

At the timing of FIG. 39B, the compression chamber $C_a$ becomes a thin strip the same as for the condition of FIG. 39A; however, the length in the orbit direction is shorter (refer to FIG. 36). The compression chamber $C_b$ changes to a variable section thin strip shape with the width becoming narrower along the orbit axis direction. Since this width at the central side becomes a length Ls (<L1) approximately equal to the height from the bottom face 12*f* to the upper rim 12*c* (or the height of the wall 13*b* from the bottom face 13*f* to the upper rim 13*c*), the volume becomes less than for the compression chamber $C_a$.

At the timing of FIG. 39C, the compression chamber $C_a$ also changes to a variable section thin strip shape with the width becoming narrower along the orbit axis direction (refer to FIG. 37). For the compression chamber $C_b$, the part for the lap length L1 becomes shorter, and the part for the lap length Ls becomes longer. Here the length of the part for the lap length L1 of the compression chamber $C_a$ is longer than that for the compression chamber $C_b$, while the length of the part for the lap length Ls of the compression chamber $C_a$ is shorter than that for the compression chamber $C_b$. Hence the volume of the compression chamber $C_a$ is larger.

At the timing of FIG. 39D, the compression chambers $C_a$ and $C_b$ both move towards the central side and hence the length in the orbit direction becomes even shorter (refer to FIG. 38). Here also, the length of the part for the lap length L1 of the compression chamber $C_a$ is longer than that of the compression chamber $C_b$, and the length of the part for the lap length Ls of the compression chamber $C_a$ is shorter than that of the compression chamber $C_b$, and hence the volume of the compression chamber $C_a$ is larger.

At the timing of FIG. 39E, the compression chambers $C_{bo}$ and $C_{ao}$ both move towards the central side and hence the length in the orbit direction becomes even shorter (refer to FIG. 35). Furthermore, for the compression chamber $C_{ao}$, the portion for the lap length L1 disappears, and the width becomes a uniform (lap length Ls) thin strip.

At the timing of FIG. 39F, the compression chambers $C_b$, and $C_{ao}$ both move towards the central side and hence the length in the orbit direction becomes even shorter (refer to FIG. 36).

At the minimum volume timing of FIG. 39G, the portion for the lap length L1 for both of the compression chambers $C_{ao}$ and $C_{bo}$ disappears, and the width becomes a uniform (lap length Ls) thin strip (refer to FIG. 37). After this, the discharge valve 26 is opened, and the fluid is discharged from the discharge port 25.

In the case of driving this scroll compressor, as will be understood from FIG. 39A to FIG. 39G, the volume of the two facing compression chambers is different for the processes of FIGS. 39B to 39F, and the internal pressures between the two compression chambers falls into an imbalance. However, between FIG. 39C to FIG. 39E, the sliding contact between the connecting rim 12*e* and the connecting wall face 13*h* is cancelled, and hence in practice, the occurrence of the imbalance condition of the internal pressures is in the process from FIGS. 39A to 39C, and the process from FIGS. 39E to 39G.

Consequently, in the above described scroll compressor, in the process from FIGS. 39A to 39C, the fluid flows through the communication path P between the facing compression chambers $C_a$ and $C_b$ so that the imbalance of internal pressures between the two compression chambers is corrected. Furthermore, in the process from FIGS. 39E to 39G, the fluid flows through the communication path Po between the facing compression chambers $C_{ao}$ and $C_{bo}$ so that the imbalance of internal pressures between the two compression chambers is corrected.

Consequently, according to the above described scroll compressor, even with the condition where the volumes of the two facing compression chambers are not equal in the compression process, the fluid flows through the communicating paths P and Po so that the imbalance of the internal pressures is corrected, and the pressure balance between the facing compression chambers ($C_a$ and $C_b$, and $C_{ao}$ and $C_{bo}$) is maintained. Therefore, the compressor can be safely driven.

Furthermore, by providing the step only on the wall 12*b* of the fixed scroll 12, and providing the step only on the end plate 13*a* of the orbiting scroll 13 which is to correspond with this, processing of the two scrolls becomes simpler than heretofore. Hence processability can be improved and the cost required for processing can be reduced.

Moreover, by providing the discharge port 25 in the fixed scroll 12 which does not have the step, the internal volume of the discharge port 25 is reduced, and the power loss due to reverse flow of the fluid from the discharge port 25 to the compression chamber C is suppressed, and hence an improvement in compression efficiency is achieved.

In this embodiment, the construction is such that a step is only provided in the wall 12*b* of the fixed scroll 12 and a step is only provided in the end plate 13*a* of the orbiting scroll 13 which is to corresponds to this. However conversely, the construction may be such that a step is only provided in the wall 13*b* of the orbiting scroll 13 and a step is only provided in the end plate 12*a* of the fixed scroll 12 which is to correspond to this.

In this embodiment, the communication path P is provided in the fixed scroll 12, and the communication path Po is provided in the orbiting scroll 13. However, in the case where the two compression chambers which have moved to the center are continuous, the fluid can be made to flow other than via the communication path Po. Hence the communication path need not necessarily be provided.

Furthermore, in this embodiment, the connecting rim 12*e* is formed perpendicular to the orbit plane of the orbiting scroll 13, and the connecting wall face 13*h* corresponding to this is also formed perpendicular to the orbit plane. However, if the connecting rim 12*e* and the connecting wall face 13*h* maintain a corresponding relationship with each other, then it is not necessary for these to be perpendicular to the orbit plane, and for example these may be formed at an incline to the orbit plane.

Moreover, in this embodiment, a step shape having one step is adopted for the fixed scroll 12. However, a scroll compressor according to the present invention is also feasible with a plurality of steps.

A ninth embodiment of a scroll compressor according to the present invention will now be described referring to FIG. 40. Description is omitted for points similar to those in the first through eighth embodiments.

Figure 40:
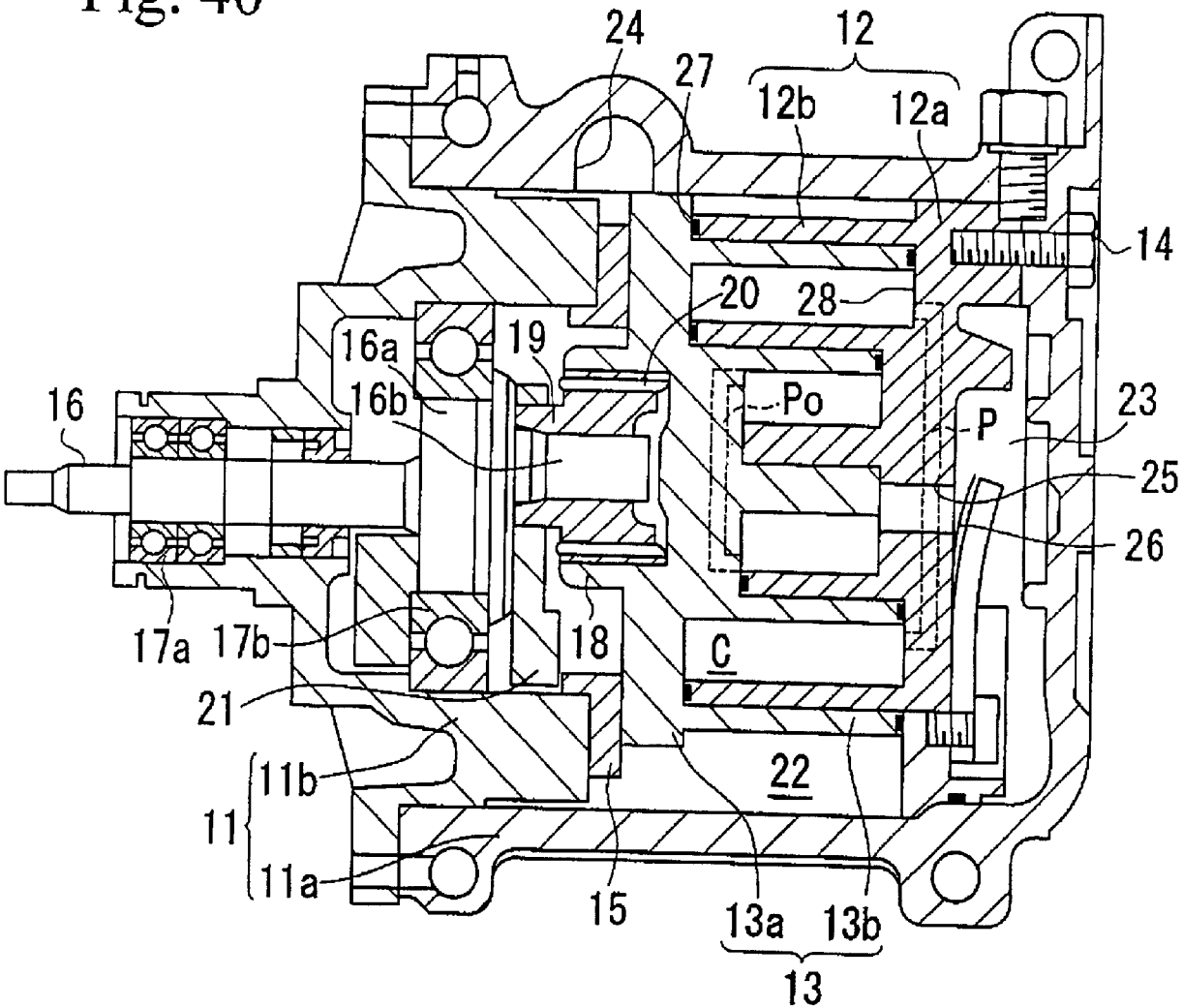
FIG. 40 is a cross-sectional view illustrating an overall construction of a scroll compressor shown as a seventh embodiment of the present invention.
Figure 41A:
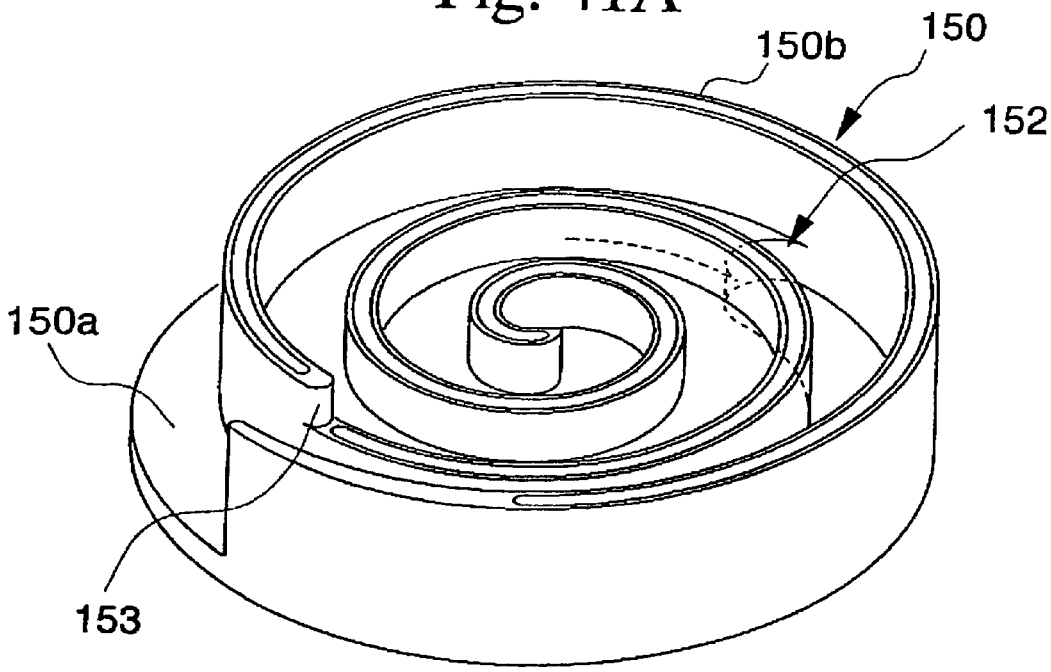
PRIOR ART Fig. 41A
FIG. 41A is a perspective view showing a fixed scroll used in a conventional scroll compressor.
Figure 41B:
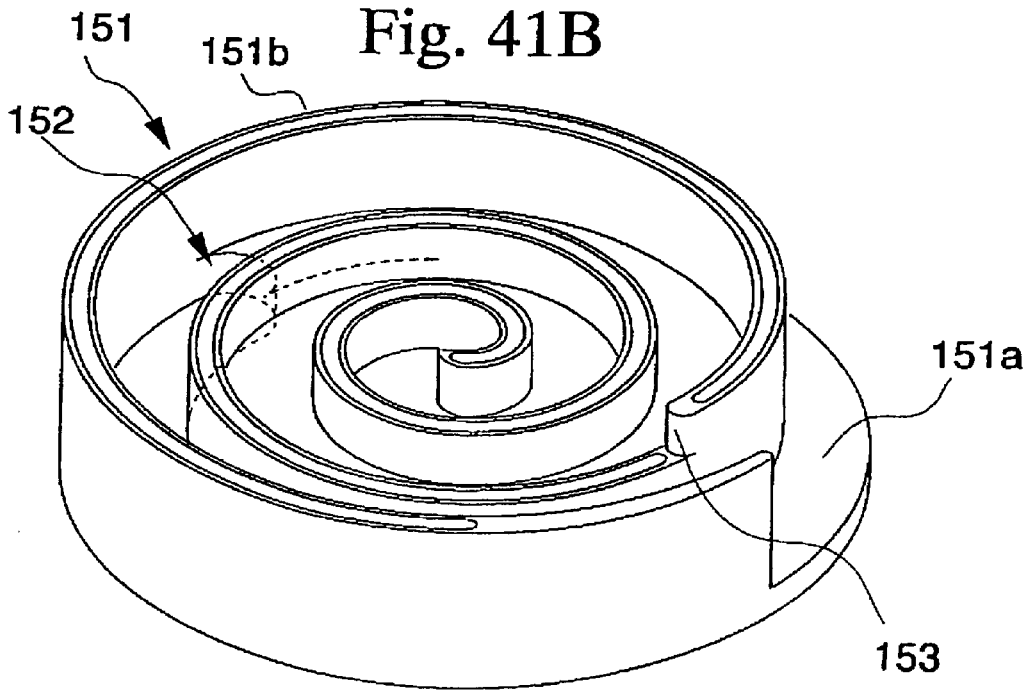
PRIOR ART Fig. 41B
FIG. 41B is a perspective view showing an orbiting scroll used in a conventional scroll compressor.
Figure 42A:
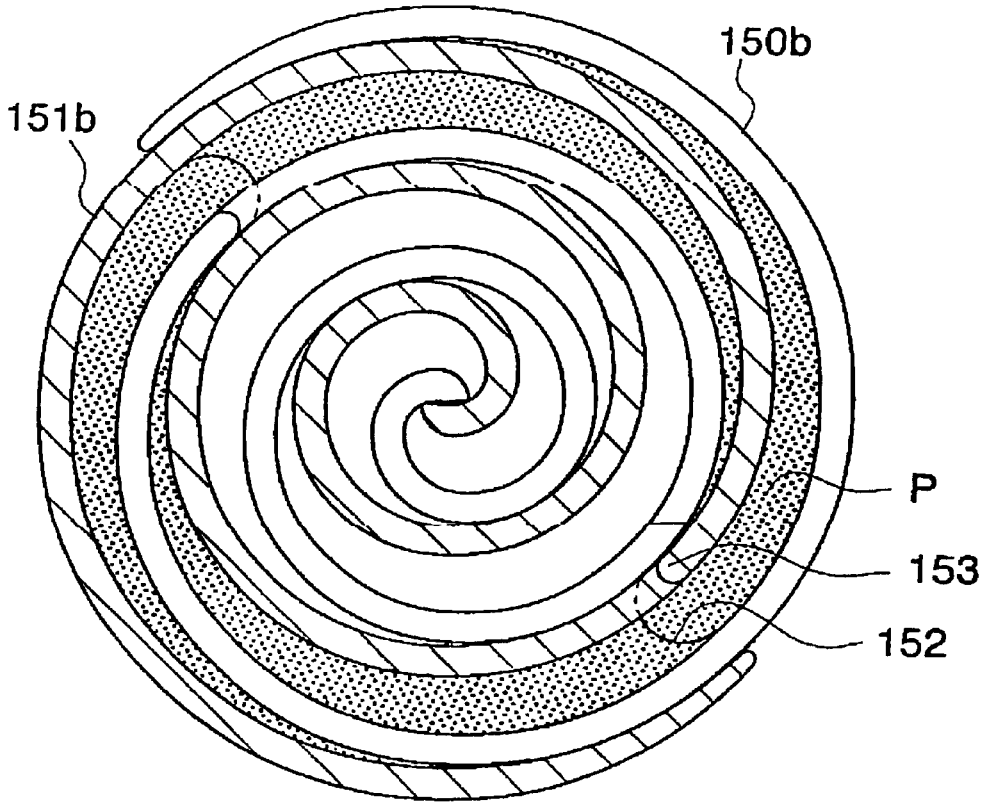
PRIOR ART Fig. 42A
FIG. 42A is a plan view showing a state of engagement of the fixed scroll and the orbiting scroll, for a compression chamber at the time of maximum volume, in the conventional scroll compressor.
Figure 42B:
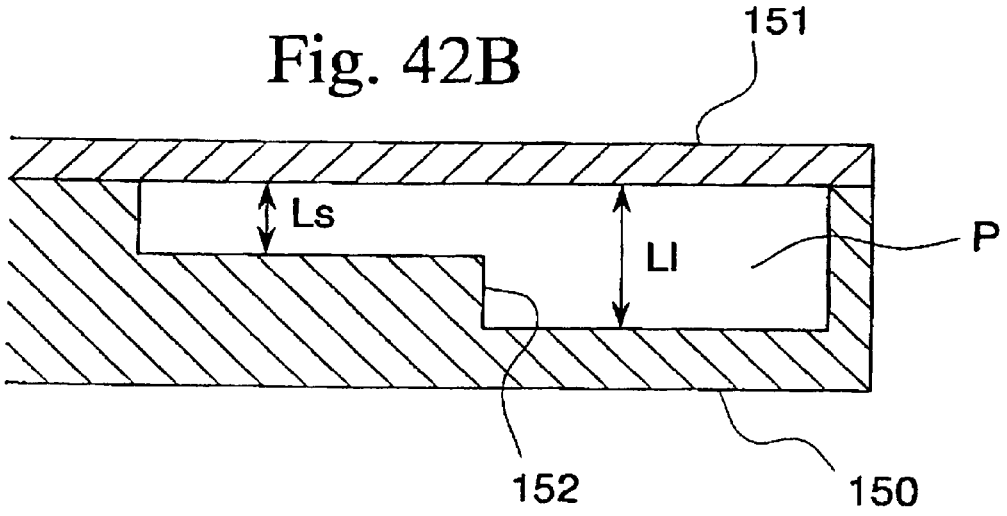
PRIOR ART Fig. 42B
FIG. 42B is a cross-sectional view of the compression chamber formed at the outer peripheral end side, for the compression chamber at the time of maximum volume, in the conventional scroll compressor, as seen from a cross-section along the spiral direction.
Figure 43:
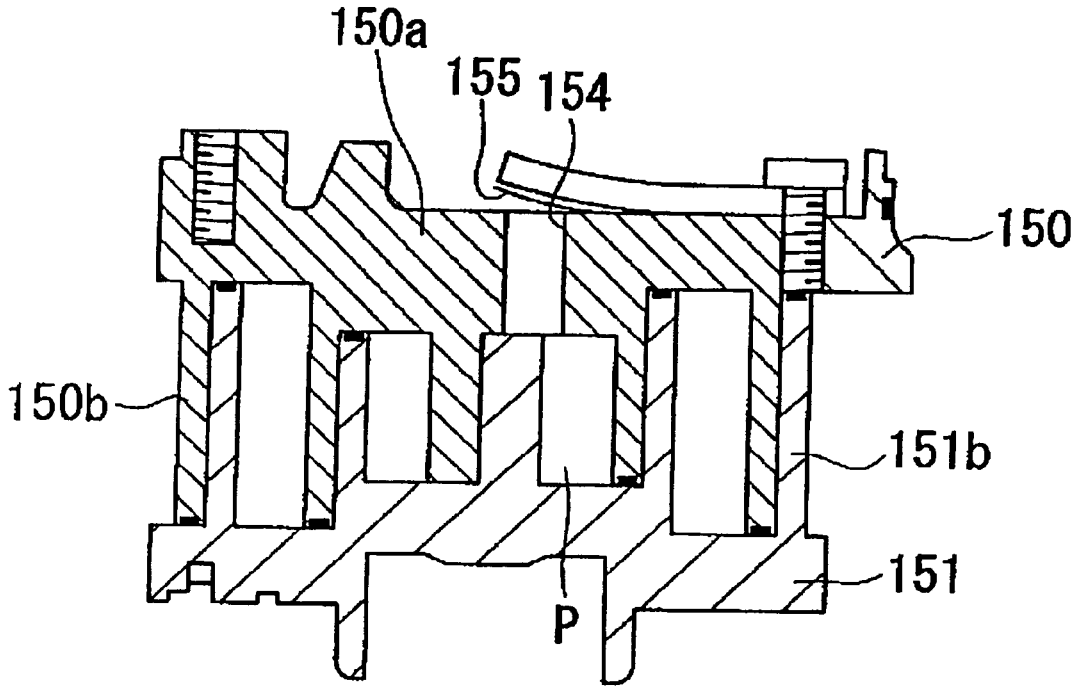
PRIOR ART Fig. 43
FIG. 43 is a cross-sectional view illustrating an engaged condition of the fixed scroll and the orbiting scroll of the conventional scroll compressor as seen from a cross-section through which the axis of the discharge port passes.

FIG. 40 is a cross-sectional view showing an overall construction of a scroll compressor according to the present invention. The characteristic of this scroll compressor is that both a fixed scroll 12 and an orbiting scroll 13 have a step shape. However, a step of an upper rim of a wall 12*b* is set larger than a step of an upper rim of a wall 13*b*, and a step of one side face of an end plate 13*a* is set smaller than a step of one side face of an end plate 12*a*.

In the case of driving this scroll compressor also, as with the eighth embodiment, the volumes of the two facing compression chambers are different for some processes, and the internal pressures between the two compression chambers fall into an imbalance condition. However, fluid flows through communication paths P and Po so that the imbalance of the internal pressures between the two compression chambers is corrected, and a pressure balance between the facing compression chambers is maintained. Therefore the compressor can be safely driven.

Industrial Applicability

As described above, in the scroll compressor of the present invention, there are the following effects.

(1) Even if the wall thermally expands with operation of the scroll compressor, the upper rim of the wall does not interfere with the facing end plate. Consequently, an improvement in compression efficiency can be realized without hindrance to the orbital movement of the orbiting scroll.

Furthermore, in the central portion side, interference of the wall with the end plate is prevented, and also at both the central portion side from the step and the outer peripheral end side, a post thermal expansion gap height can be suitably formed.

(2) The maximum volume of the compression chamber can be made larger, and the compression ratio can be improved.

Furthermore, leakage of fluid of the inside compression chamber through the step to the outside compression chamber can be prevented.

Moreover, by providing the step at a pitch angle of $2\pi\pm\pi/4$ (rad), the maximum volume of the compression chamber can be made sufficiently large, and leakage of fluid inside the compression chamber caused by the differential pressure can also be prevented.

(3) By forming the concavity, the thickness of the portion for positioning the discharge port of the end plate of the fixed scroll can be made thin. Furthermore, since the internal volume of the discharge port can be made small, the volume of fluid remaining here can be reduced. Consequently, the fluid which reverse flows from inside the discharge port towards the compression chamber can be reduced as much as possible, and hence the pressure of the fluid which is to be compressed next is no longer raised, and the power for rotating the orbiting scroll is minimized. Hence there is no impairment due to fluid remaining inside the discharge port, so that an improvement in operating efficiency can be obtained.

Furthermore, by adopting the spiral reed valve, since this has a comparatively small size valve body, this can be easily installed even in a narrow concavity.

Moreover, by adopting the free valve, since this is a simple plate with a comparatively small size valve body, this can be easily installed even in a narrow concavity.

Furthermore, according to this free valve, when the discharge port is closed off, the opening of the discharge port is sufficiently sealed, while when the fluid discharges from the discharge port, this can pass through the free valve not only via the outer peripheral end of the free valve, but also through the respective ventilation areas. Therefore, additional resistance to the fluid in passing through the free valve can be reduced. Hence release of fluid from the discharge port can be improved. Furthermore, since the respective ventilation areas are arranged at equi-angular spacing around the periphery of the central portion, the free valve is unlikely to tilt inside the concavity, so that reliability can also be improved.

Furthermore, by adopting the check valve, since this has a comparatively small size valve body, this can be easily installed even in a narrow concavity.

(4) In the case of performing volume control, by freely moving the plate in the orbit axis direction without operating the pressing device, then in the scroll compressor comprising the fixed scroll and the orbiting scroll, a compression chamber is not developed between the two scroll walls at the part positioned on the outer peripheral end face where the walls are high, and not until reaching the part positioned on the central side where the walls are low, and passing the connecting wall face is the compression chamber developed. Therefore, the volume change of the compression chamber from once compression starts until discharge, becomes small so that discharge volume is reduced. Furthermore, until the compression chamber passes the connecting wall face, power for compressing the fluid is not consumed. That is, in the case of performing volume control, the power for driving the compressor can be reduced. Hence the power loss which was heretofore wastefully consumed disappears, and operating efficiency can thus be increased.

Moreover, by forming the plate to approximately coincide with the part positioned on the outer peripheral end side, then in the case where volume control is not performed, the gas tightness of the compression chamber which is developed at the portion positioned on the outer peripheral end side where the wall is high, is maintained. Therefore, compression efficiency can be increased and performance of the compressor thus improved. Furthermore, the plate can be pressed without providing another drive source.

Furthermore, in the case where volume control is not performed, the pressure inside the compression chamber positioned on the central side of the spiral direction, which becomes a high pressure, is introduced to between the plate and the part positioned on the outer peripheral end side, so that the plate is pressed against the pressure inside the compression chamber which becomes a lower pressure than for the central side, so that the gas tightness of the compression chamber is maintained. Therefore, compression efficiency can be increased and performance of the compressor thus improved.

Moreover, by providing an urging device, and pulling the plate to a part positioned on the outer peripheral end side, then in the case where the pressing force on the plate by the pressing device for performing volume control is released, a gap occurs between the plate and the opposite wall, so that leakage of fluid occurs easily, and leakage of fluid at the outer peripheral end side is positively produced and an increase in excessive pressure is thus prevented. Therefore, wasteful power consumption no longer occurs, and compressor operating efficiency can be increased.

Furthermore, by providing a stopper to restrict the movement range of the plate, pressing of the plate too far to the facing wall is prevented, and deformation of the plate or the occurrence of heat due to excessive friction with the wall is minimized. Therefore, stabilized operation of the compressor is possible.

(5) By determining the shape of the connecting wall face by the envelope which the orbit locus draws at the time of orbital motion of the connecting rim, the gas tightness of the connecting wall face can be maintained irrespective of the shape of the connecting rim. Therefore, if a relatively simple shape is adopted for the connecting rim, processability is improved and cost reduced.

Moreover, by forming the connecting rim by a plane which intersects the spiral direction of the wall, then for example in the case of machining the connecting rim, processability can be significantly improved. Hence cost can be reduced In addition, by chamfering between the plane and the side face of the wall, the strength near the connecting rim of the wall is maintained, and an improvement of machining accuracy achieved.

Moreover, by providing a small gap beforehand between the connecting rim and the connecting wall face, then even if the two scrolls thermally expand, the contact pressure does not increase more than necessary. Therefore, stabilized drive can be achieved.

(6) By providing the communication path, then although in some processes of compression in the two facing compression chambers the volumes are different, in these compression processes the fluid flows through the communication path between the two compression chambers, and hence an imbalance in internal pressure is corrected. As a result, the compressor can be safely driven.

Furthermore, by providing a step only on the wall of the scroll of either one of the fixed scroll and the orbiting scroll, and providing a step only on the end plate of the other scroll which is to correspond to this, processing of the scrolls becomes simpler than heretofore. Hence processability can be improved and the cost required for processing can be reduced.

Moreover, by providing a discharge port in the scroll having no step, the discharge port volume is reduced, and power loss due to reverse flow of the fluid from the discharge port to the compression chamber is suppressed. Hence compression efficiency is improved.

What is claimed is:

1. A scroll compressor comprising:

a fixed scroll having a spiral wall upstanding on one side face of an end plate, and secured in place;

an orbiting scroll having a spiral wall upstanding on one side face of an end plate, and supported so as to be orbitally movable while being prevented from rotation, with pairs of said walls engaged with each other;

a stepped portion on one side face of at least one of the end plates of said fixed scroll and said orbiting scroll, having a high part with a height thereof which is high at a central side in a spiral direction, a low part with a height thereof which is low at an outer peripheral end side, and a step which constitutes a border of these high and low parts; and a stepped shape formed by dividing an upper rim of the wall of at least one of said fixed scroll and said orbiting scroll into a plurality of parts which are corresponding to said stepped portion, having a low upper rim where the height of the part is low at a central side in the spiral direction, and a high upper rim where the height of the part is high at an outer peripheral end side in the spiral direction;

wherein a gap is provided between said end plate and a corresponding upper rim of said wall of at least one of said fixed scroll and said orbiting scroll, and a height of said gap in a height direction of said wall at room temperature is formed higher than a height for a case where said wall is thermally expanded in a height direction of said wall at a time of scroll compressor operation, and the height of said gap formed on the central side in the spiral direction from said stepped portion is formed higher than the height of said gap formed on the outer peripheral end side from said stepped portion.

2. A scroll compressor comprising:

a fixed scroll having a spiral wall upstanding on one side face of an end plate, and secured in place;

an orbiting scroll having a spiral wall upstanding on one side face of an end plate, and supported so as to be orbitally movable while being prevented from rotation, with pairs of said walls engaged with each other;

a stepped portion on one side face of at least one of the end plates of said fixed scroll and said orbiting scroll, having a high part with a height thereof which is high at a central side in a spiral direction, a low part with a height thereof which is low at an outer peripheral end side, and a step which constitutes a border of these high and low parts; and a stepped shape formed by dividing an upper rim of the wall of at least one of said fixed scroll and said orbiting scroll into a plurality of parts which are corresponding to said stepped portion, having a low upper rim where the height of the part is low at a central side in the spiral direction, and a high upper rim where the height of the part is high at an outer peripheral end side in the spiral direction;

wherein said stepped portion is provided at a position which exceeds a pitch angle of $\pi$ (rad) and within range of a pitch angle of $2\pi+\pi/4$ (rad) along the spiral of said wall from the outer peripheral end of said wall towards said central portion.

3. A scroll compressor comprising:

a fixed scroll having a spiral wall upstanding on one side face of an end plate, and secured in place;

an orbiting scroll having a spiral wall upstanding on one side face of an end plate, and supported so as to be orbitally movable while being prevented from rotation, with pairs of said walls engaged with each other;

a stepped portion on one side face of at least one of the end plates of said fixed scroll and said orbiting scroll, having a high part with a height thereof which is high at a central side in a spiral direction, a low part with a height thereof which is low an outer peripheral end side, and a step which constitutes a border of these high and low parts; and a stepped shape formed by dividing an upper rim of the wall of at least one of said fixed scroll and said orbiting scroll into a plurality of parts which are corresponding to said stepped portion, having a low upper rim where the height of the part is low at a central side in the spiral direction, and a high upper rim where the height of the part is high at an outer peripheral end side in the spiral direction;

wherein a discharge port in said fixed scroll is formed in a central portion of said end plate, and said stepped portion is provided at a position which exceeds a pitch angle of $\pi$ (rad) along the spiral of said wall from the outer peripheral end of said wall towards said central portion and which exceeds a pitch angle of $2\pi$ (rad) along the spiral of said wall from said discharge port towards the outer peripheral end side.

* * * * *